US011079153B2

(12) United States Patent
Song et al.

(10) Patent No.: US 11,079,153 B2
(45) Date of Patent: Aug. 3, 2021

(54) REFRIGERATOR AND CONTROL METHOD THEREOF

(71) Applicant: Samsung Electronics Co., Ltd, Suwon-si (KR)

(72) Inventors: Myung-Seob Song, Yongin-si (KR); Jin Seung Choi, Suwon-si (KR); Min Soo Kim, Seoul (KR); Dae Hwan Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 138 days.

(21) Appl. No.: 15/897,050

(22) Filed: Feb. 14, 2018

(65) Prior Publication Data

US 2018/0231294 A1 Aug. 16, 2018

(30) Foreign Application Priority Data

Feb. 14, 2017 (KR) ..... 10-2017-0020083

(51) Int. Cl.
*F25C 1/04* (2018.01)
*F25C 5/04* (2006.01)
(Continued)

(52) U.S. Cl.
CPC ..... *F25C 1/20* (2013.01); *F25C 1/24* (2013.01); *F25C 5/182* (2013.01); *F25C 5/185* (2013.01);
(Continued)

(58) Field of Classification Search
CPC .... F25C 1/43; F25C 1/246; F25C 5/04; F25C 5/08; F25C 2305/00; F25C 2400/06;
(Continued)

(56) References Cited

U.S. PATENT DOCUMENTS 1,954,073 A 4/1934 Edwards
2,955,442 A * 10/1960 Loewenthal ..... F25C 1/04 62/351
(Continued)

FOREIGN PATENT DOCUMENTS

EP 1522805 A1 4/2005
EP 1918663 A1 5/2008
(Continued)

OTHER PUBLICATIONS

European Search Report dated Jul. 18, 2018 in connection with European Patent Application No. 18 15 6340.
(Continued)

*Primary Examiner* — Frantz F Jules
*Assistant Examiner* — Erik Mendoza-Wilkenfel

(57) ABSTRACT

Disclosed herein are a refrigerator includes an ice making tray, a cooling system, a stirrer, at least a portion of which is submerged in the ice making tray, a stirring motor coupled to the stirrer, and a controller storing instructions and configured to execute the stored instructions to control the stirring motor to drive the stirrer while controlling the cooling system to cool water stored in the ice making tray. While the cooling system cools the water stored in the ice making tray, the stirrer stirs the water stored in the ice making tray.

19 Claims, 51 Drawing Sheets

(51) Int. Cl.

| | |
|---|---|
| ***A23G 9/00*** | (2006.01) |
| ***F25C 1/20*** | (2006.01) |
| ***F25C 1/24*** | (2018.01) |
| ***F25C 5/20*** | (2018.01) |
| ***F25C 5/182*** | (2018.01) |
| ***F25C 5/185*** | (2018.01) |

(52) U.S. Cl.
CPC ..... *F25C 5/22* (2018.01); *F25C 2400/06* (2013.01); *F25C 2700/12* (2013.01); *F25D 2317/061* (2013.01); *F25D 2400/02* (2013.01)

(58) Field of Classification Search
CPC ..... F25C 2700/06; F25C 2700/08; F25C 2700/14; F25C 2305/022; F25C 2500/08; A23G 9/00
See application file for complete search history.

(56) References Cited

U.S. PATENT DOCUMENTS

| | | | | |
|---|---|---|---|---|
| 3,393,531 | A * | 7/1968 | Douglas | F25C 1/04 62/353 |
| 5,056,321 | A * | 10/1991 | Patrick | F25C 1/04 62/351 |
| 5,212,955 | A * | 5/1993 | Hogan | F25C 1/04 62/353 |
| 5,596,182 | A * | 1/1997 | Edwards | F25C 1/04 200/38 R |
| 7,017,354 | B2 * | 3/2006 | Lee | F25C 1/04 62/353 |
| 9,568,232 | B2 | 2/2017 | Kim et al. | |
| 2006/0016207 | A1 * | 1/2006 | Tremblay | F25C 1/20 62/342 |
| 2011/0265498 | A1 | 11/2011 | Hall | |
| 2012/0324916 | A1 | 12/2012 | Bortoletto et al. | |
| 2013/0276468 | A1 | 10/2013 | Buehrle et al. | |
| 2013/0327076 | A1 | 12/2013 | Jeong et al. | |
| 2015/0107276 | A1 | 4/2015 | Bortoletto et al. | |
| 2016/0245574 | A1 * | 8/2016 | Jeong | F25C 1/24 |

FOREIGN PATENT DOCUMENTS

| | | | |
|---|---|---|---|
| JP | H05157424 | A | 6/1993 |
| JP | 2001272145 | A | 10/2001 |
| KR | 10-2010-0138374 | A | 12/2010 |
| KR | 10-2014-0088693 | A | 7/2014 |
| KR | 10-2015-0044308 | A | 4/2015 |

OTHER PUBLICATIONS

China National Intellectual Property Administration, First Office Action regarding Application No. 201810144982.X, dated Dec. 12, 2019, 20 pages.
Communication pursuant to Article 94(3) EPC dated Mar. 17, 2020 in connection with European Patent Application No. 18 156 340.4, 4 pages.
Office Action dated Aug. 6, 2020 in connection with Chinese Patent Application No. 201810144982.X, 8 pages.

* cited by examiner

REFRIGERATOR AND CONTROL METHOD THEREOF

CROSS-REFERENCE TO RELATED APPLICATION(S)

This application is related to and claims benefit of Korean Patent Application No. 10-2017-0020083 filed on Feb. 14, 2017, the contents of which are incorporated herein by reference.

TECHNICAL FIELD

The present disclosure relates to a refrigerator, and more particularly, to a refrigerator having an ice making device capable of making ice and control method thereof.

BACKGROUND

Refrigerators are devices having a storeroom and a cold air supply for supplying cold air into the storeroom to keep groceries fresh. The refrigerator may be equipped with an ice making device to make ice.

An automatic ice making device includes an ice maker for forming ice and an ice storage for storing the ice formed by the ice maker.

Among ice making methods for freezing water, there is a direct cooling method in which the refrigerant tube extends to the inside of the ice making chamber to freeze water and comes into direct contact with the ice making tray. In this direct cooling method, the ice making tray may receive cooling energy by heat conduction from the refrigerant tube.

Accordingly, in the direct cooling method, freezing speed of water for ice making is fast, so the ice making may be performed quickly. With the direct cooling method, however, a gas dissolved in the water may be supersaturated to form bubbles, and due to the bubbles, the ice may be opaquely formed.

SUMMARY

The present disclosure provides a refrigerator having an ice making device capable of forming transparent ice.

In accordance with one aspect of the present disclosure, a refrigerator includes an ice making tray, a cooling system, a stirrer, at least a portion of which is submerged in the ice making tray, a stirring motor coupled to the stirrer, and a controller storing instructions and configured to execute the stored instructions to control the stirring motor to drive the stirrer while controlling the cooling system to cool water stored in the ice making tray. While the cooling system cools the water stored in the ice making tray, the stirrer stirs the water stored in the ice making tray.

The stirrer may include a shaft, a stirring member protruding from the shaft to stir water stored in the ice making tray while ice is being formed, and a scooping member protruding from the shaft to separate ice from the ice making.

The stirring member may include at least one stirring blade, the at least one stirring blade protruding in a different direction from the scooping member.

The stirring member may include a plurality of stirring blades, the plurality of stirring blades spirally arranged along the outer surface of the shaft.

The stirring member may include a plurality of stirring blades, the plurality of stirring blades having different protruding lengths.

The stirrer may include an ice-maker heater arranged inside the shaft. The controller may activate the ice-maker heater while controlling the cooling system to cool water stored in the ice making tray.

The ice making tray may include a first ice making tray having first heat conductivity, and a second ice making tray contacting the bottom surface of the first ice making tray and having second heat conductivity which is larger than the first heat conductivity.

The ice making tray forms an ice making cell, and the ice making tray may include a first ice making tray forming a side wall of the ice making cell and having first heat conductivity and a second ice making tray forming the bottom side of the ice making cell and having second heat conductivity, which is larger than the first heat conductivity.

The stirrer may rotate at a first speed in a first stage to stir the water stored in the ice making tray, and rotate at a second speed which is higher than the first speed in a second stage to stir the water stored in the ice making tray.

The stirrer may include a shaft, a first blade protruding from the shaft in a first direction, and a second blade protruding from the shaft in a second direction. The first blade may stir water stored in the ice making tray in a first stage, and the second blade may stir the water stored in the ice making tray in a second stage. The protruding length of the first blade is larger than the protruding length of the second blade.

The stirrer may rotate at a third speed to stir water stored in the ice making tray, and rotate a fourth speed to separate ice from the ice making tray. The third speed is higher than the fourth speed.

In accordance with one aspect of the present disclosure, a control method of a refrigerator includes supplying water to an ice making tray, stirring water stored in the ice making tray using a stirrer, at least a portion of which is submerged in the water, while cooling the water stored in the ice making tray, and separating ice from the ice making tray using the stirrer.

The control method may further include heating an upper portion of water stored in the ice making tray using a heater included in the stirrer while the water is being cooled.

The stirring of the water stored in the ice making tray may include stirring the water stored in the ice making tray at first speed of the stirrer, and stirring the water stored in the ice making tray at second speed of the stirrer. The first speed is higher than the second speed.

The stirring of the water stored in the ice making tray may include stirring the water stored in the ice making tray using a first blade included in the stirrer, and stirring the water stored in the ice making tray using a second blade included in the stirrer. The first blade is longer than the second blade.

In accordance with one aspect of the present disclosure, a refrigerator includes a first ice making tray having first heat conductivity, a second ice making tray contacting the bottom surface of the first ice making tray and having second heat conductivity, a cooling system contacting the second ice making tray, a stirrer, at least a portion of which is submerged in the first ice making tray, and a stirring motor coupled to the stirrer. The second heat conductivity is higher than the first heat conductivity.

The stirrer may include a shaft, an ice-maker heater arranged inside the shaft, a stirring member protruding from the shaft and configured to stir water stored in the ice making tray, and a scooping member protruding from the shaft and configured to separate ice from the ice making tray.

The water stored in the first ice making tray is frozen from the bottom while the second ice making tray is being cooled.

The refrigerator may further include a transmission device configured to transfer rotation force generated by the stirring motor to the stirrer. The transmission device may include a plurality of reduction gears outputting rotational force of the stirring motor at reduced speed, and a clutch device selectively transferring rotation of one of the plurality of reduction gears to the stirrer.

The clutch device may transfers rotation of the stirring motor to the stirrer in its original form to stir water stored in the ice making tray, and transfers rotation of the stirring motor to the stirrer at reduced speed to separate ice from the ice making tray.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
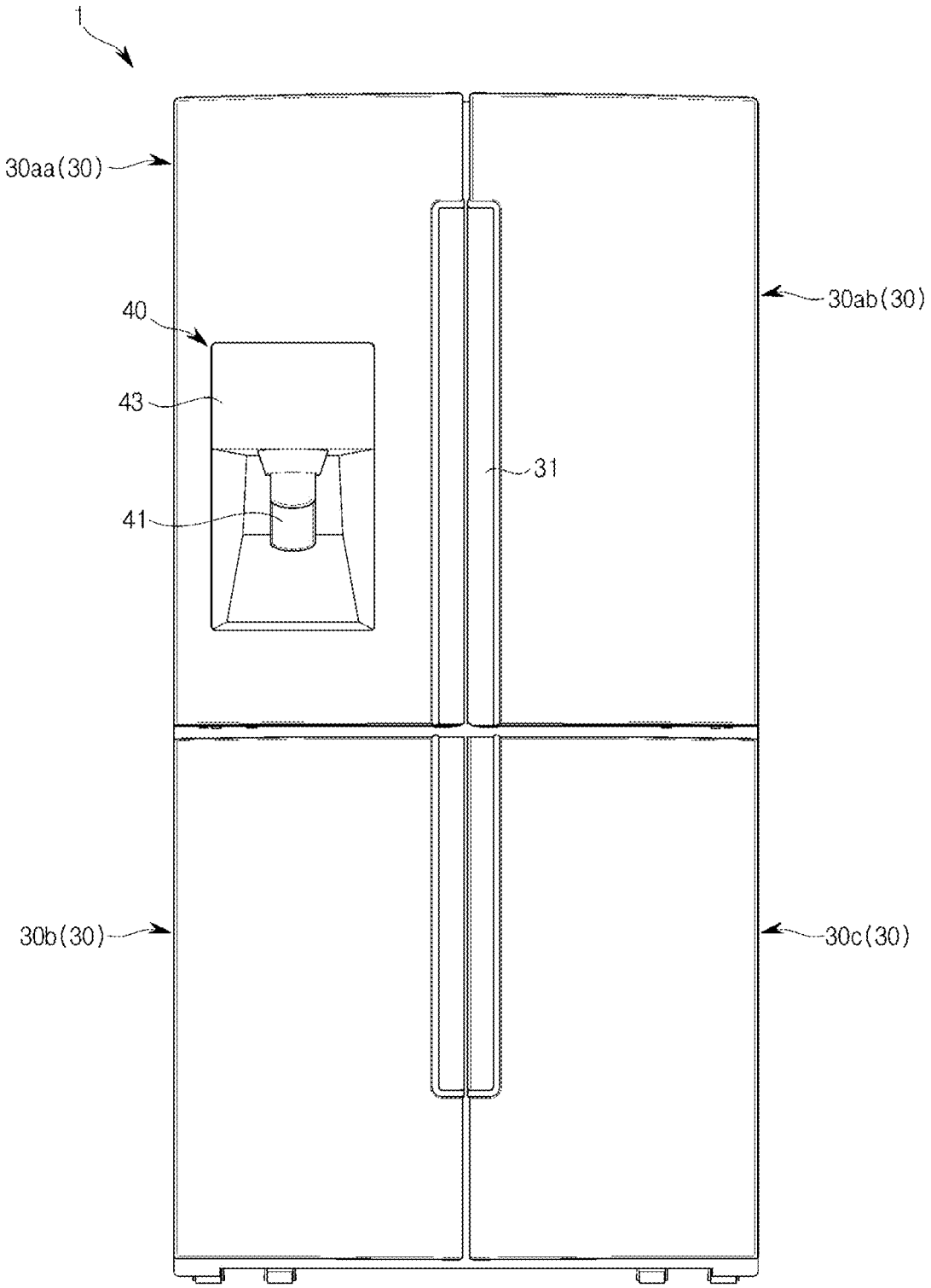
FIG. 1 shows the exterior of a refrigerator, according to an embodiment.

FIGS. 1 through 46, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing operations described is an example; however, the sequence of and/or operations is not limited to that set forth herein and may be changed as is known in the art, with the exception of operations necessarily occurring in a particular order. In addition, respective descriptions of well-known functions and constructions may be omitted for increased clarity and conciseness.

Additionally, exemplary embodiments will now be described more fully hereinafter with reference to the accompanying drawings. The exemplary embodiments may, however, be embodied in many different forms and should not be construed as being limited to the embodiments set forth herein. These embodiments are provided so that this disclosure will be thorough and complete and will fully convey the exemplary embodiments to those of ordinary skill in the art. Like numerals denote like elements throughout.

It will be understood that, although the terms first, second, etc. may be used herein to describe various elements, these elements should not be limited by these terms. These terms are only used to distinguish one element from another. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present.

The terminology used herein is for the purpose of describing particular embodiments only and is not intended to be limiting. As used herein, the singular forms "a," "an," and "the," are intended to include the plural forms as well, unless the context clearly indicates otherwise.

Reference will now be made in detail to the exemplary embodiments of the present disclosure, examples of which are illustrated in the accompanying drawings, wherein like reference numerals refer to like elements throughout.

The expression, "at least one of a, b, and c," should be understood as including only a, only b, only c, both a and b, both a and c, both b and c, or all of a, b, and c.

The principle and embodiments of the present disclosure will now be described with reference to accompanying drawings.

Figure 2:
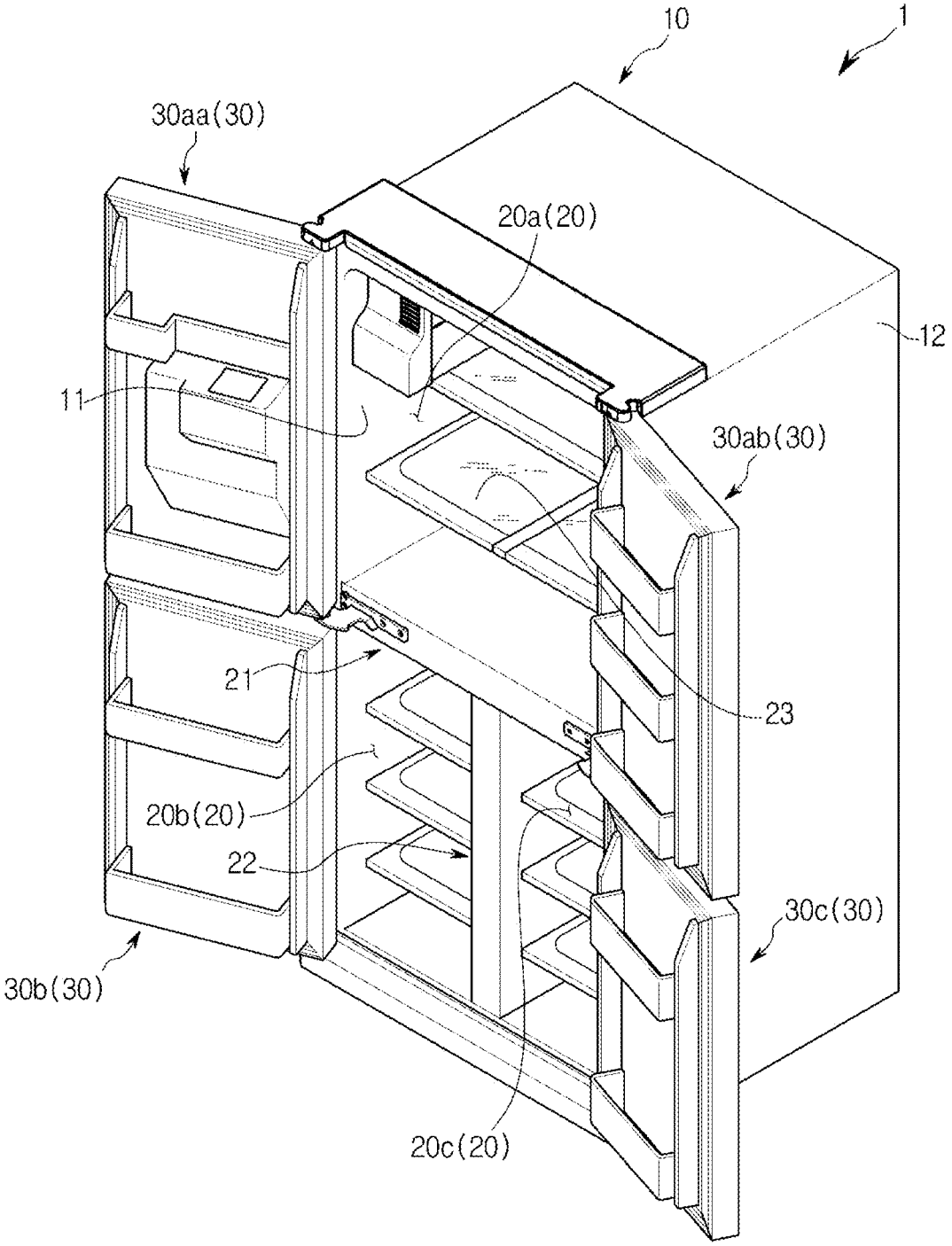
FIG. 2 shows the front of a refrigerator, according to an embodiment.
Figure 3:
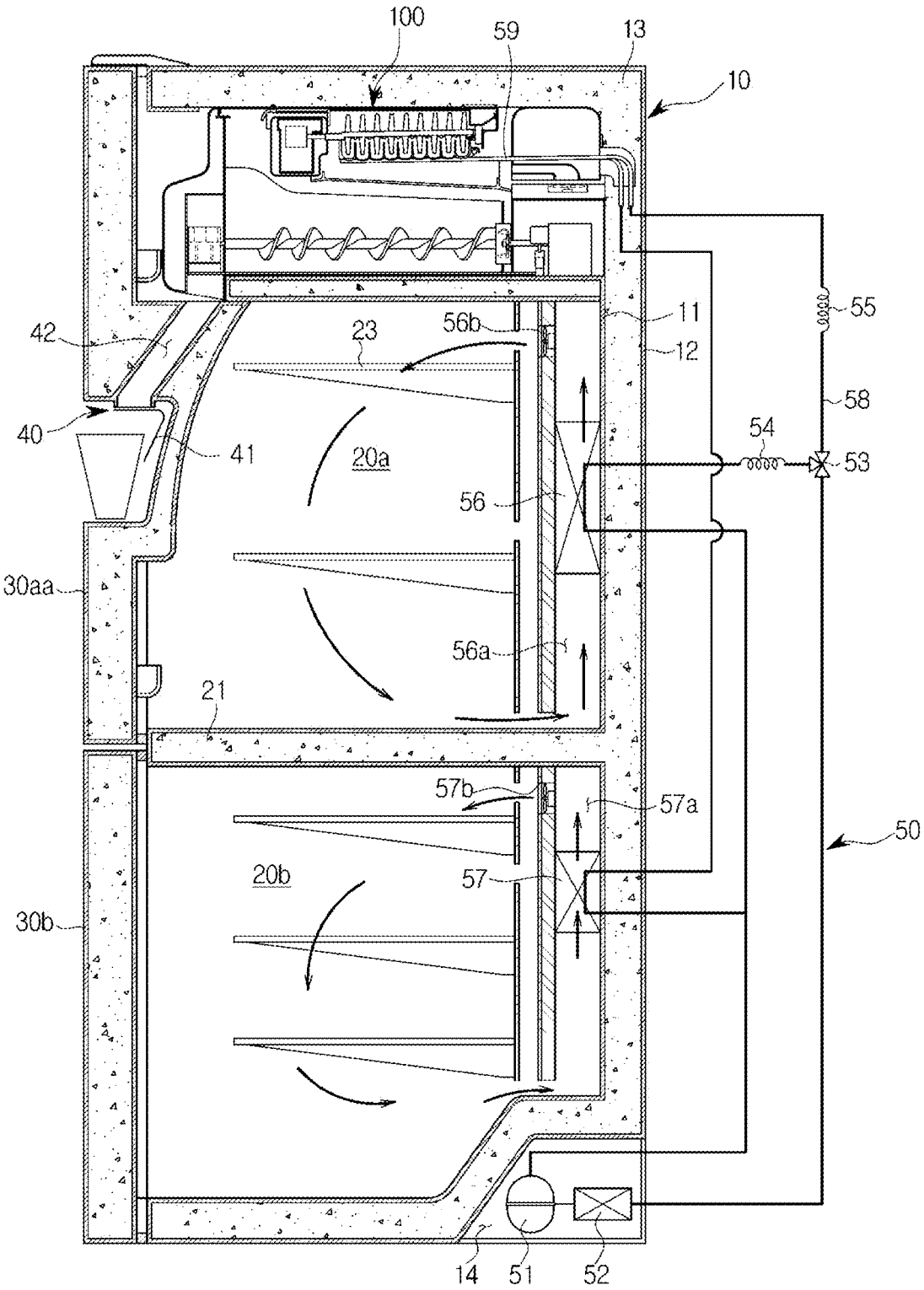
FIG. 3 is a vertical section of a side of a refrigerator, according to an embodiment.

FIG. 1 shows the exterior of a refrigerator, according to an embodiment. FIG. 2 shows the interior of a refrigerator, according to an embodiment. FIG. 3 is a vertical section of a side of a refrigerator, according to an embodiment.

Referring to FIGS. 1, 2, and 3, a refrigerator 1 may include a main body 10 with the open front, a storeroom 20 formed inside the main body 10 to keep groceries cool and/or frozen, a door 30 for opening or closing the open front of the main body 10, a cooling system 50 for cooling the storeroom 20, and an ice making device 100 for making ice.

The main body 10 forms the exterior of the refrigerator 1. The main body 10 includes an inner case 11 that forms the storeroom 20, and an outer case 12 coupled with the outer side of the inner case 11. An insulation member 13 may be packed between the inner case 11 and the outer case 12 of the main body 10 to prevent leakage of the cold air from the storeroom 20.

The storeroom 20 may be divided by horizontal and vertical partition walls 21 and 22 into a plurality of rooms. For example, as shown in FIG. 2, the storeroom 20 may be divided into an upper storeroom 20*a*, a first lower storeroom 20*b*, and a second lower storeroom 20*c*. The upper storeroom 20*a* may keep groceries cool and the lower storerooms 20*b*, 20*c* may store groceries frozen.

The storeroom 20 may have shelves 23 to put groceries thereon.

The storeroom 20 may be opened or closed by the door 30. For example, as shown in FIG. 2, the upper storeroom 20*a* may be opened or closed by first and second upper doors 30*aa* and 30*ab*. The first lower storeroom 20*b* may be opened or closed by a first lower door 30*b*, and the second lower storeroom 20*c* may be opened or closed by a second lower door 30*c*.

A handle 31 may be mounted on the door 30 to easily open or close the door 30. The handle 31 may be formed to run in the vertical direction between the first and second upper doors 30*aa* and 30*ab* and between the first and second lower doors 30*b* and 30*c*. This makes the handle 31 look like a single unit while the door 30 is closed.

A dispenser 40 may be provided on one side of the door 30. The dispenser 40 may dispense water or ice in response to the user's input. In other words, the user may take out water or ice directly through the dispenser 40 without opening the door 30.

The dispenser 40 includes a dispenser lever 41 to receive the user's discharge command, a dispenser suit 42 through which ice is discharged from the ice making device 100, and a dispenser display panel 43 for displaying an operation state of the dispenser 40.

The dispenser 40 may be installed on the outer side of the door 30 or the main body 10. For example, as shown in FIG. 1, the dispenser 40 may be installed on the first upper door 30*aa*. The dispenser 40 is not, however, exclusively installed on the first upper door 30*aa*, but may be installed at any place, such as on the second upper door 30*ab*, the first lower door 30*b*, the second lower door 30*c*, and the outer case 12 of the main body 10, from which the user may take out water or ice.

The cooling system 50 includes a compressor 51 for compressing the refrigerant at high pressure, a condenser 52 for condensing the compressed refrigerant, an expander 54, 55 for expanding the refrigerant at low pressure, an evaporator 56, 57 for evaporating the refrigerant, and refrigerant tube 58 for guiding the refrigerant.

The compressor 51 and the condenser 52 are arranged in a machine room 14 equipped in a rear bottom portion of the main body 10.

The evaporator 56, 57 may include a first evaporator 56 for supplying cold air into the upper storeroom 20*a*, and a second evaporator 57 for supplying cold air into the lower storeroom 20*b*, 20*c*. The first evaporator 56 is arranged in a first cold air duct 56*a* provided in a rear portion of the upper storeroom 20*a*, and the second evaporator 57 is arranged in a second cold air duct 57*a* provided in a rear portion of the lower storeroom 20*b*, 20*c*.

A first blower fan 56*b* for supplying cold air produced by the first evaporator 56 to the upper storeroom 20*a* is provided in the first cold air duct 56*a*, and a second blower fan 57*b* for supplying cold air produced by the second evaporator 57 to the lower storeroom 20*b*, 20*c* is provided in the second cold air duct 57*a*.

The refrigerant tube 58 may guide the refrigerant compressed by the compressor 51 to the first evaporator 56 or the second evaporator 57/ice making device 100. A switching valve 53 may be arranged in the refrigerant tube 58 to distribute the refrigerant to the first evaporator 56 or the second evaporator 57/ice making device 100.

A part 59 of the refrigerant tube 58 (hereinafter, called an "ice-maker refrigerant tube") may extend to the inside of the ice making device 100, and the ice-maker refrigerant tube 59 arranged inside the ice making device 100 may be used to freeze water in the ice making device 100 into ice.

The ice making device 100 may be provided on one side of the storeroom 20 to make ice using cold air of the ice-maker refrigerant tube 59. For example, as shown in FIG. 2, the ice making device 100 may be placed in an upper left portion of the upper storeroom 20*a* to correspond to the dispenser 40 installed on the first upper door 30*aa*. The position of the ice making device 100 is not limited to what is shown in FIG. 2, but the ice making device 100 may be arranged in the lower storeroom 20*b*, 20*c* or in a horizontal partition wall 21 between the upper storeroom 20*a* and the lower storeroom 20*b*, 20*c*.

Figure 4:
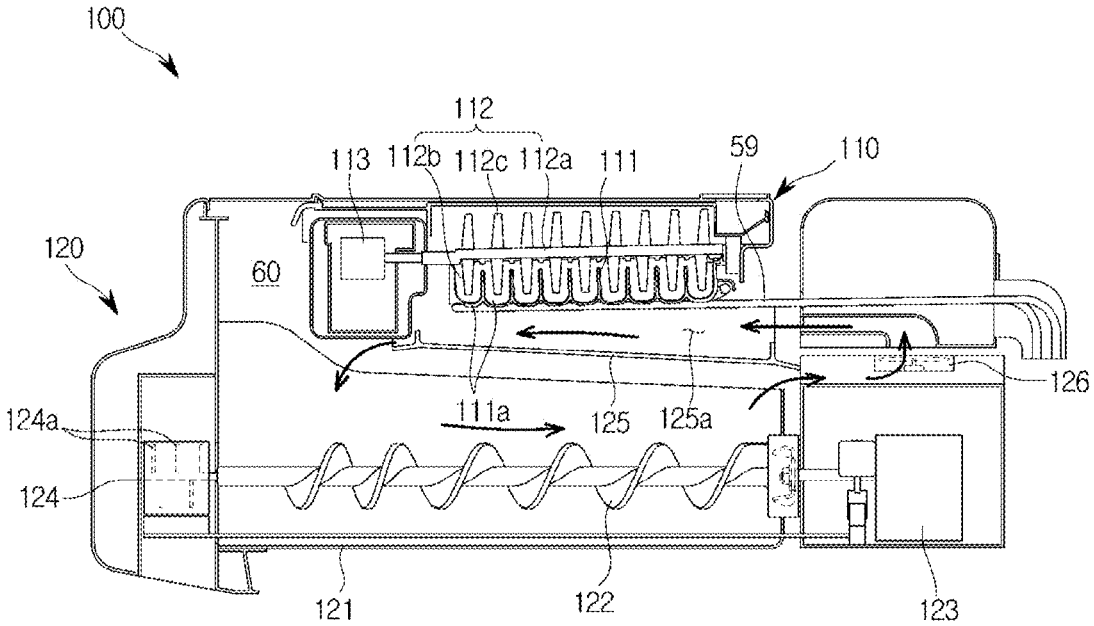
FIG. 4 is a cross-section of a side of an ice making device included in a refrigerator, according to an embodiment.

FIG. 4 is a vertical section of a side of an ice making device included in a refrigerator, according to an embodiment.

Referring to FIG. 4, the ice making device 100 may include an ice maker 110 for forming ice and an ice storage 120 for storing the ice formed by the ice maker 110.

The ice maker 110 may include an ice making tray 111 for storing water for ice making, a stirrer 112 for stirring the water stored in the ice making tray 111 or separating the ice from the ice making tray 111, and a stirring motor 113 for swinging or rotating the stirrer 112.

The ice making tray 111 may include a plurality of ice making cells 111*a*, each of which may store water for ice making. The ice-maker refrigerant tube 59 may be arranged underneath the ice making tray 111, and due to the ice-maker refrigerant tube 59, the ice making tray 111 may be frozen below the freezing point of water (0 degree Celsius). The water stored in the ice making cell 111*a* of the ice making tray 111 is frozen into ice.

The stirrer 112 is arranged above the ice making tray 111 for stirring the water stored in the ice making tray 111 while ice is being formed and for separating ice from the ice making tray 111 after the ice is formed.

The stirrer 112 includes a rotary shaft 112*a*, a stirring blade 112*b* for stirring the water stored in the ice making tray 111, and a scooping blade 112*c* protruding from a side wall of the shaft 112*a* to separate ice from the ice making tray 111.

The stirring blade 112*b* may be formed to protrude from the side wall of the shaft 112*a*, for stirring water in the ice making tray 111 while the water is being frozen in the ice making tray 111. For example, the stirring blade 112*b* may be swung or rotated clockwise or counterclockwise around the shaft 112*a* and may stir the water in the ice making tray 111 while being swung or rotated.

The scooping blade 112*c* may be formed to protrude from the side wall of the shaft 112*a*, for separating ice from the ice making tray 111 after the water in the ice making tray 111 is frozen into the ice. For example, the scooping blade 112*c* may be rotated clockwise or counterclockwise around the shaft 11 2*a* and may separate the ice from the ice making tray 111 while being rotated.

As such, the stirring blade 112*b* and the scooping blade 112*c* may be formed to protrude from the side wall of the shaft 112*a*, and rotated clockwise or counterclockwise around the shaft 112*a*.

Hardness of the stirring blade 112*b* may be different from that of the scooping blade 112*c*. For example, the scooping blade 112*c* for moving ice may be harder than the stirring blade 112*b* for stirring water.

The shape of the stirring blade 112*b* may or may not be different from that of the scooping blade 112*c*. For example, the stirring blade 112*b* and the scooping blade 112*c* may have the same form of a plate, or the scooping blade 112*c* may have the plate form but the stirring blade 112*b* may have a spiral form.

The stirring motor 113 swings or rotates the stirrer 112 clockwise or counterclockwise. The stirring motor 113 may be coupled to the shaft 112*a* of the stirrer 112, and the rotational force of the stirring motor 113 may be transferred to the shaft 112*a* of the stirrer 112.

The stirring motor 113 may be rotated at different speeds for ice making and ice scooping. For example, while ice is being made, the stirring motor 113 may be rotated at about 60 revolution per minute (rpm) for the stirring blade 112*b* to stir the water in the ice making tray 111. After the ice is made, the stirring motor 113 may be rotated at about 6 rpm for the scooping blade 112*c* to separate the ice from the ice making tray 111.

The stirring motor 113 may be swung or rotated clockwise or counterclockwise within a certain angle. For example, while ice is being made, the stirring motor 113 may be alternately rotated clockwise and counterclockwise within about 180 degrees for the stirring blade 112*b* to be swung in the ice making tray 111. Furthermore, after the ice is made, the stirring motor 113 may be rotated clockwise or counterclockwise within about 360 degrees for the scooping blade 112*c* to be swung in the ice making tray 111.

The stirring motor 113 may employ a direct current (DC) motor that rotates in response to supply of DC power, an alternate current (AC) motor that rotates in response to supply of AC power, or a step motor that rotates in response to supply of a plurality of pulses.

The ice storage 120 may include an ice container 121 for storing ice made by the ice maker 110, a transporter 122 for carrying the ice stored in the ice container 121 to a discharge port 127, a transporting motor 123 for driving the transporter 122, a cutter 124 for cutting ice to be discharged through the discharge port 127, a cold air duct 125 for providing cold air of the ice-maker refrigerant tube 59 to the ice container 121, and a ice storage fan 126 for circulating the air inside the ice storage 120.

The ice container 121 is arranged under the ice making tray 111 for storing the ice separated from the ice making tray 111 by the stirrer 112. The ice may be separated by the stirrer 112 from the ice making tray 111 and may fall to the ice container 121. The ice falling to the ice container 121 may be stored in the ice container 121 until an ice discharge command is input from the user.

The transporter 122 may carry the ice stored in the ice container 121 to the discharge port 127 of the ice container 121. For example, the transporter 122 may have a spiral form as shown in FIG. 4, so that the ice of the ice container 121 may be transported to the discharge port 127 while the spiral transporter 122 is rotating.

The transporting motor 123 may rotate the spiral transporter 122. For example, in response to pressure on the dispenser lever 41 (see FIG. 1), the transporting motor 123 may be rotated, causing the spiral transporter 122 to transport the ice of the ice container 121 to the discharge port 127. The ice transported to the discharge port 127 may be discharged by passing through the dispenser suit 42 from the ice container 121.

The cutter 124 may cut the ice to be discharged through the discharge port 127. For example, if ice is stored in the ice container 121 for a long time, the surface of the ice may melt by friction between ice pieces. Furthermore, to facilitate smooth separation of the ice from the ice making tray 111, the ice making tray 111 may be heated to melt the surface of the ice. When the ice pieces with the melted surface are frozen again in the ice container 121, they may stick together.

The cutter 124 may separate the stuck ice pieces. The cutter 124 may include a plurality of cutting blades 124*a*. When the cutting blades 124*a* are rotated by rotation of the transporting motor 123, the cutting blades 124*a* may separate the stuck ice pieces by cutting them while being rotated.

The cold air duct 125 may be arranged under the ice making tray 111, and may form a cold air path 125*a* in which cold air flows to provide the cold air of the ice-maker refrigerant tube 59 to the ice container 121.

Air inside the cold air duct 125 may be cooled by the ice-maker refrigerant tube 59 and/or the ice making tray 111. The air cooled by the ice-maker refrigerant tube 59 and/or the ice making tray 111 may flow in the cold air duct 125, i.e., along the cold air path 125*a*. Especially, the cooled air may flow to the ice container 121 along the cold air path 125*a*. The cooled air may keep the ice container 121 below the freezing point and prevent the ice stored in the ice container 121 from melting.

The ice storage fan 126 may circulate the air in the cold air duct 125 and the air in the ice container 121. For example, the ice storage fan 126 may suck in the air in the ice container 121 and discharge the air to the cold air duct 125, as shown in FIG. 4. Consequently, the air may be cooled inside the cold air duct 125 by the ice-maker refrigerant tube 59 and/or the ice making tray 111, and the cooled air may flow to the ice container 121.

Figure 5:
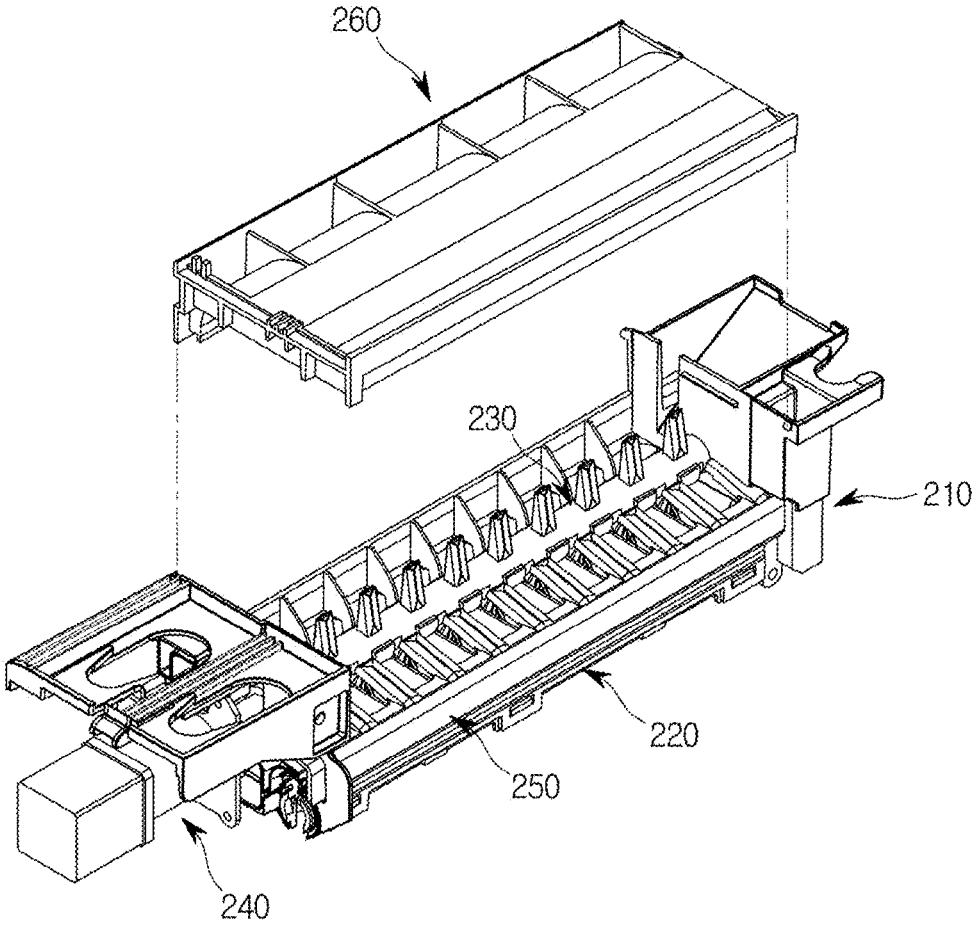
FIG. 5 is a top view of an ice maker included in a refrigerator, according to an embodiment.
Figure 6:
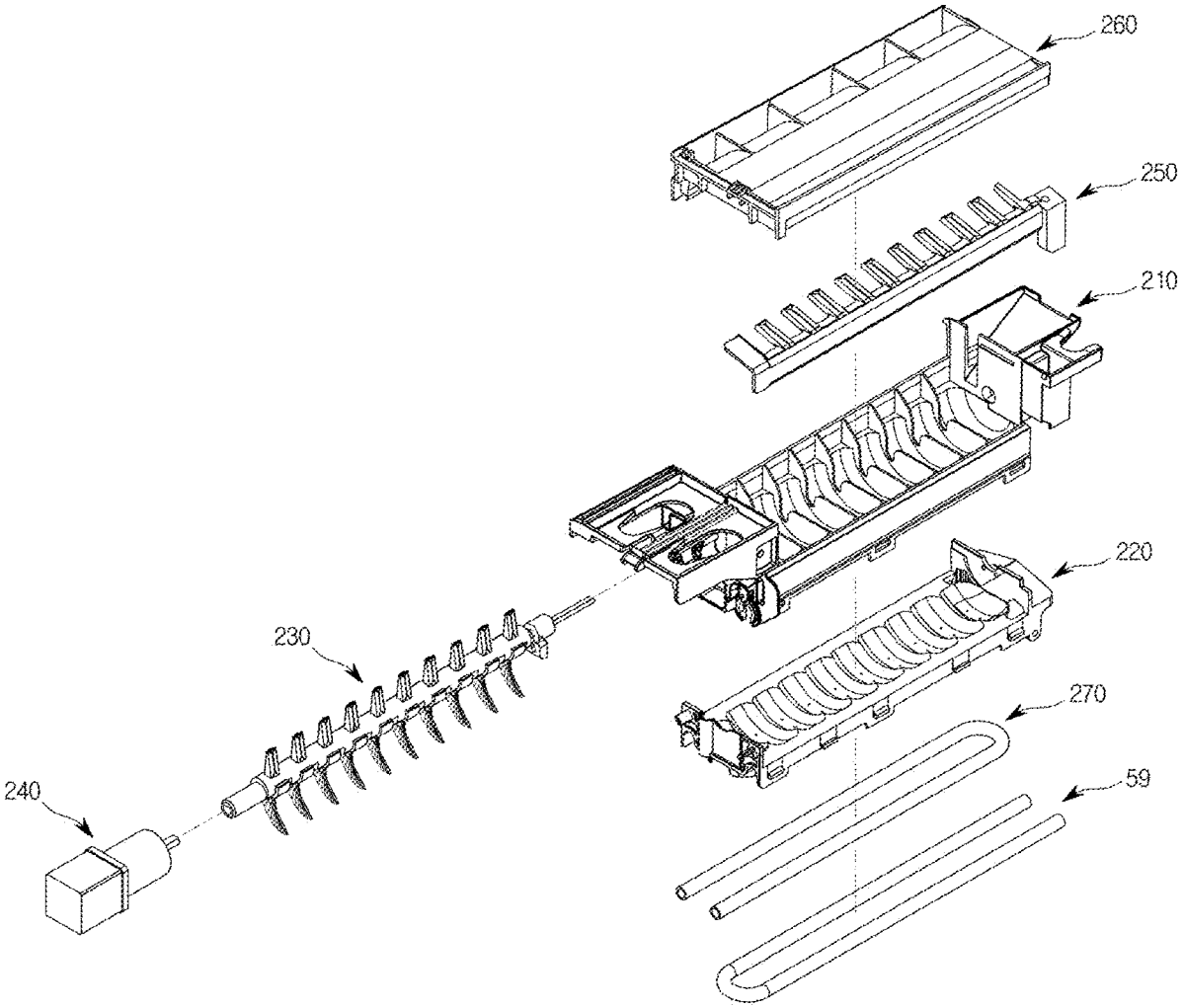
FIG. 6 is an exploded view of an ice maker included in a refrigerator, according to an embodiment.
Figure 7:
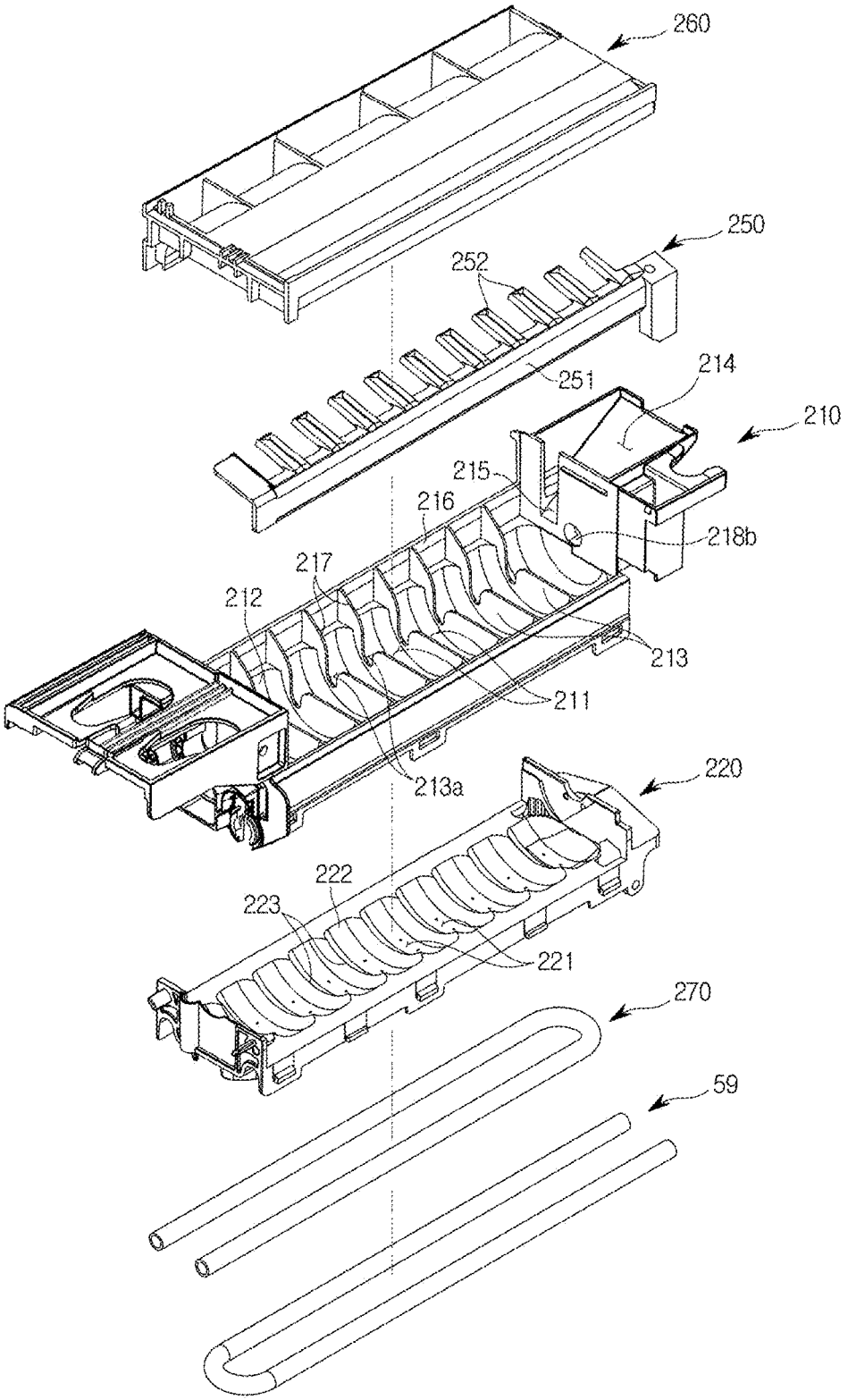
FIGS. 7 and 8 are enlarged views of a ice-maker cover, a slider, and first and second ice making trays included in a refrigerator, according to an embodiment.
Figure 8:
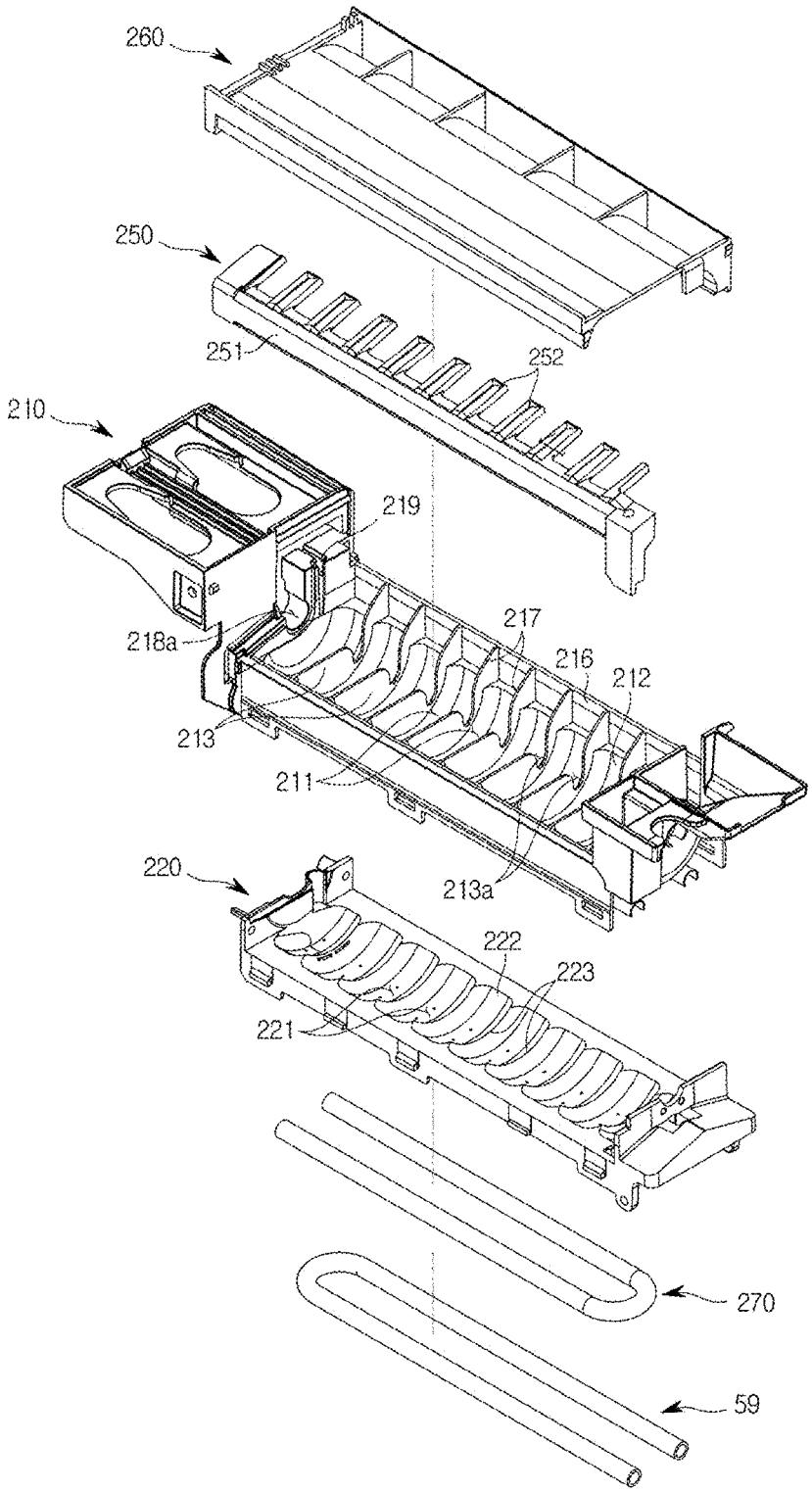
Figure 9:
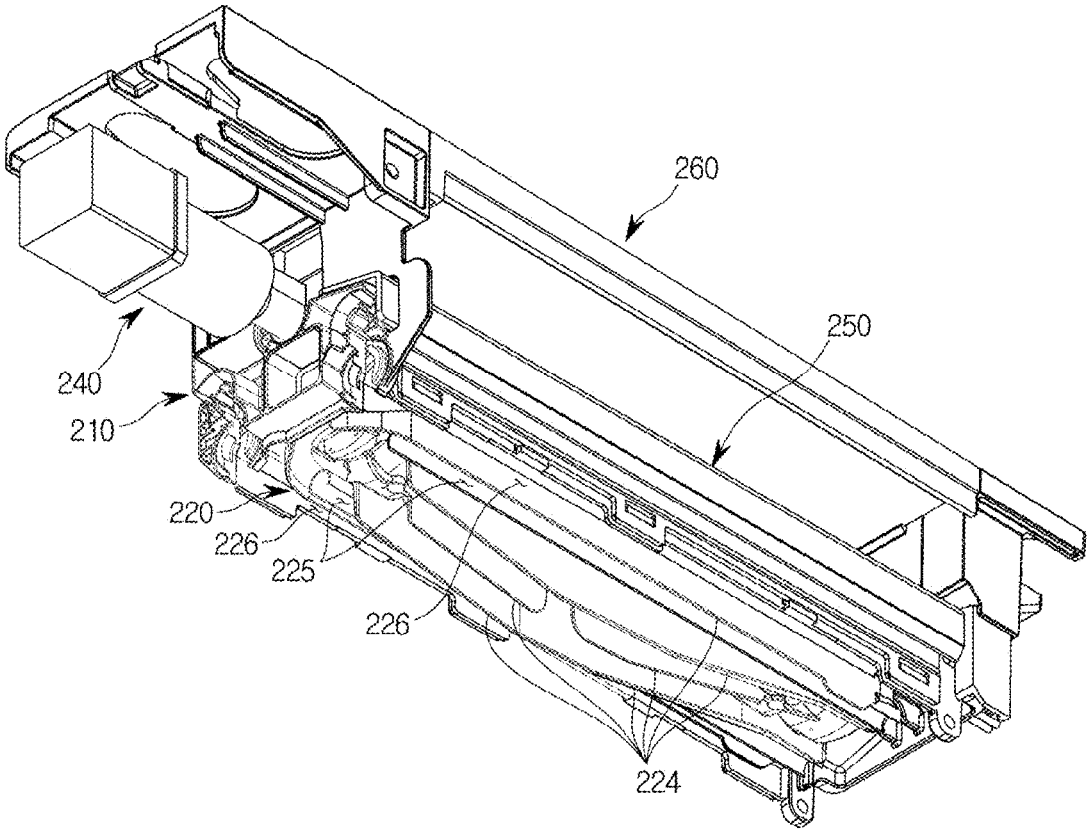
FIG. 9 is a bottom view of an ice maker included in a refrigerator, according to an embodiment.
Figure 10:
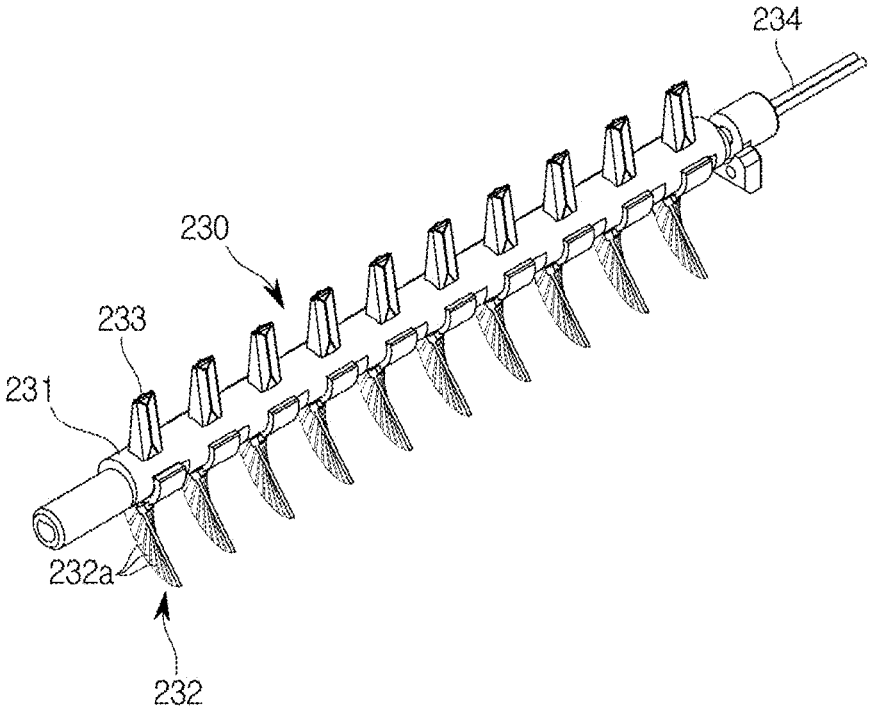
FIG. 10 is an enlarged view of a stirrer included in a refrigerator, according to an embodiment.
Figure 11:
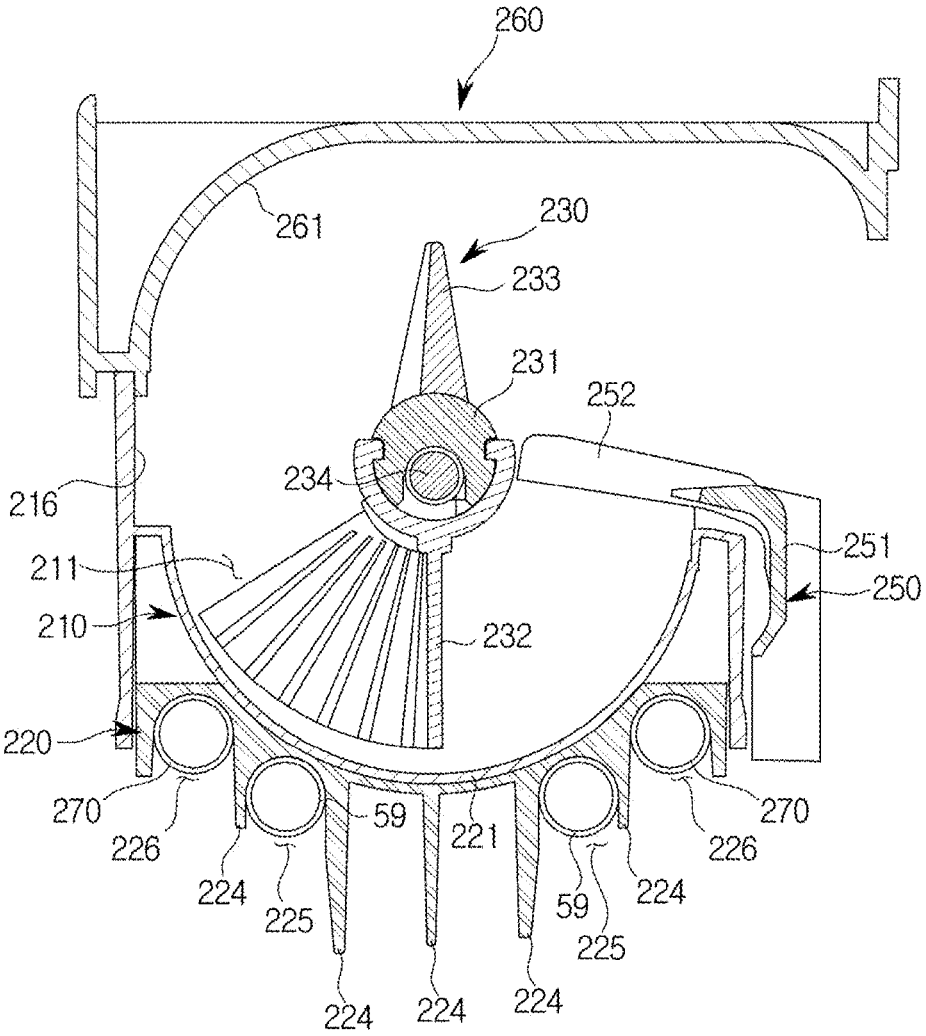
FIG. 11 is a cross-sectional view in A-A' direction of FIG. 5.

FIG. 5 is a top view of an ice maker included in a refrigerator, according to an embodiment. FIG. 6 is an exploded view of an ice maker included in a refrigerator, according to an embodiment. FIGS. 7 and 8 are enlarged views of a ice-maker cover, a slider, and first and second ice-making trays included in a refrigerator, according to an embodiment. FIG. 9 is a bottom view of an ice maker included in a refrigerator, according to an embodiment. FIG. 10 is an enlarged view of a stirrer included in a refrigerator, according to an embodiment. FIG. 11 is a cross-sectional view in A-A' direction of FIG. 5.

The ice maker 110 may include the ice-maker refrigerant tube 59 through which a refrigerant passes, a first ice making tray 210 for storing water for ice making, a second ice making tray 220 contacting the ice-maker refrigerant tube 59, a stirrer 230 for stirring water stored in the first ice making tray 210 or separating from the first ice making tray 210, a stirring motor 240 for swinging or rotating the stirrer 230, a slider 250 for guiding the ice separated by the stirrer 230 from the first ice making tray 210 to the ice container 121 (see FIG. 4), an ice-maker cover 260 for guiding the ice separated by the stirrer 230 from the first ice making tray 210 to the slider 250, and the ice-separation heater 270 for smoothly separating ice from the first ice making tray 210.

A plurality of ice making cells 211 for storing water for ice making may be formed in the first ice making tray 210. The water stored in the plurality of ice making cells 211 may be frozen into ice.

The first ice making tray 210 may include a first base 212 on which the plurality of ice making cells 211 are formed, and a plurality of first partition walls 213 to divide the first base 212 to form the plurality of ice making cells 211. In other words, the first base 212 and the plurality of first partition walls may constitute the plurality of ice making cells 211.

The first ice making tray 210 may include a water supply guide 214 for guiding water supplied from the outside to the plurality of ice making cells 211, and a water supply port 215 through which the water guided by the water supply guide 214 flows into the plurality of ice making cells 211.

The plurality of first partition walls 213 may each have a through hole 213*a*, by which the plurality of ice making cells 211 are linked. The water supplied through the water supply port 215 may be sequentially supplied to the plurality of ice making cells 211 through the through holes 213*a* formed in the plurality of first partition walls 213.

The first ice making tray 210 includes a first scooping guide 216 to guide the ice separated from the plurality of ice making cells 211. The first scooping guide 216 may guide the ice separated by the stirrer 230 from the ice making cells 211 to the slider 250.

The first ice making tray 210 includes cutting ribs 217 to separate the ice from each of the plurality of ice making cells 211. Since the plurality of ice making cells 211 are linked through the through holes 213*a* of the plurality of first partition walls 213, ice pieces made in the plurality of ice making cells 211 may be connected to each other. The cutting ribs 217 may cut the linkage between the ice pieces stuck together while separating the ice from the plurality of ice making cells 211.

The first ice making tray 210 may include stirrer through holes 218*a*, 218*b* to support the stirrer 230. The stirrer 230 may pass the stirrer through holes 218*a*, 218*b* to be coupled with the first ice making tray 210. The stirrer through holes 218*a*, 218*b* may be formed at the front and rear ends of the first ice making tray 210 in its lengthwise direction.

The first ice making tray 210 includes a sensor container 219 for containing an ice-maker temperature sensor 300 (see FIG. 12) for measuring the temperature of water or ice therein. The sensor container 219 may be formed at one end of the first ice making tray 210 in its lengthwise direction. The ice-maker temperature sensor 330 installed in the sensor container 219 may measure the temperature of the water or ice contained in one of the plurality of ice making cells 211.

The second ice making tray 220 may be arranged underneath the first ice making tray 210 to contain the first ice making tray 210. The first ice making tray 210 may be placed on the second ice making tray 220 or coupled with the second ice making tray 220.

On the top of the second ice making tray 220, a plurality of cell containers 221 for containing the plurality of ice making cells 211 of the first ice making tray 210 are formed. The plurality of ice making cells 211 of the first ice making tray 210 may be settled in the plurality of cell containers 221, respectively. The plurality of cell containers 221 may have a corresponding shape to the plurality of ice making cells 211 and may be provided as many as the number of the plurality of ice making cells 212.

The second ice making tray 220 may include a second base 222 on which the plurality of cell containers 221 are formed, and a plurality of second partition walls 223 to divide the second base 222 to form the plurality of cell containers 221. In other words, the second base 222 and the plurality of second partition walls 223 may constitute the plurality of cell containers 221.

Heat exchange ribs 224 are formed under the second ice making tray 220. The heat exchange ribs 224 may facilitate heat exchange between the second ice making tray 220 and the inside air of the cold air duct 125 (see FIG. 4).

A refrigerant tube container 225 for containing the ice-maker refrigerant tube 59 and a heater container 226 for containing the ice-separation heater 270 are formed underneath the second ice making tray 220. The refrigerant tube container 225 and the heater container 226 may have a concave form to contain the ice-maker refrigerant tube 59 and the ice-separation heater 270, respectively, and may be formed between the heat exchange ribs 224.

The ice-maker refrigerant tube 59 may have the form of almost a letter 'U', and the refrigerant tube container 225 to contain the ice-maker refrigerant tube 59 may also have the form of almost a letter 'U'. The ice-maker refrigerant tube 59 may directly contact the refrigerant tube container 225 of the second ice making tray 220. Furthermore, the second ice making tray 220 may be quickly cooled by the direct contact with the ice-maker refrigerant tube 59.

The ice-separation heater 270 may have the form of almost a letter 'U', and the heater container 226 to contain the ice-separation heater 270 may also have the form of almost a letter 'U'. The ice-separation heater 270 may directly contact the heater container 226 of the second ice making tray 220. Furthermore, the second ice making tray 220 may be quickly heated by direct contact with the ice-separation heater 270.

In this way, the second ice making tray 220 may be directly cooled by the ice-maker refrigerant tube 59 and the first ice making tray 210 may be cooled by the second ice making tray 220.

The second ice making tray 220 may be formed of a high heat-conductive material to quickly cool the first ice making tray 210 and cool the inside air of the cold air duct 125 (see FIG. 4). For example, the second ice making tray 220 may be made of a metal, such as aluminum.

When water is rapidly cooled to be frozen, the air dissolved in the water may be supersaturated, making the ice opaque. To prevent this, the first ice making tray 210 may be made of a material with lower heat conductivity than the second ice making tray 220. For example, the second ice making tray 220 may be made of a synthetic resin.

Furthermore, the second ice making tray 220 contacts a portion of the bottom surface of the first ice making tray 210. For example, as shown in FIG. 11, the cell container 221 receives a portion of the ice making cell 211, and thus the portion of the ice making cell 211 comes into contact with the cell container 221. As a result, the ice making cell 211 may be gradually cooled upwards from the bottom portion that contacts the cell container 221.

In this way, when the ice making cell 211 is gradually cooled from the bottom portion, the water stored in the ice making cell 211 may be gradually frozen from the bottom. While the water is frozen from the bottom, the air in the border between ice and water may be supersaturated to form bubbles, and the bubbles may flow upwards in the water. As a result, transparency of the ice may be improved.

The slider 250 may include a slider body 251 and a plurality of guide protrusions 252 protruding from the slider body 251.

The slider body 251 may be coupled to the first ice making tray 210 and fix the slider 250 to the first ice making tray 210.

The plurality of guide protrusions 252 may protrude toward the stirrer 230 from the slider body 251.

The width of each of the plurality of guide protrusions 252 may be larger than the thickness of the first partition wall 213 of the first ice making tray 210, and the gap between the plurality of guide protrusions 252 may be smaller than the width of the ice making cell 211 of the first ice making tray 210.

The plurality of guide protrusions 252 may prevent the ice separated by the stirrer 230 from the first ice making tray 210 from going back to the first ice making tray 210. In other words, the plurality of guide protrusions 252 may guide the ice separated by the stirrer 230 from the first ice making tray 210 to the ice container 121 (see FIG. 4).

For example, as shown in FIG. 11, when the stirrer 230 is rotated clockwise, the ice in the first ice making tray 210 may be rotationally moved clockwise around the stirrer 230. With the rotation of the stirrer 230, the ice may fall out of the first ice making tray 210 and may be rotationally moved to the slider 250. Subsequently, the ice may collide with the plurality of guide protrusions 252 of the slider 250 and fall to the outside, i.e., to the ice container 121 (see FIG. 4) without returning to the first ice making tray 210.

In this way, the slider 250 may guide the ice separated by the stirrer 230 from the first ice making tray 210 to the ice container 121.

The ice-maker cover 260 includes a second scooping guide 261 to guide the ice separated from the first ice making tray 210. The second scooping guide 261 may guide the ice separated by the stirrer 230 from the second ice making tray 220 to the slider 250.

As shown in FIG. 11, the second scooping guide 261 may extend from inside the ice making cell 211 and the first scooping guide 216, and may have a curved plane to guide the ice to the slider 250.

The ice separated from the ice making cell 211 may be guided along the first and second scooping guides 216 and 261 to the slider 250, and then guided to the ice container 121 by the slider 250.

The stirrer 230 includes a shaft 231 rotationally installed in the first ice making tray 210, a stirring member 232 protruding from the shaft 231 in a first direction, an ice-separation member 233 protruding from the shaft 231 in a second direction, and an ice-maker heater 234 for heating air around the stirrer 230.

The shaft 231 may be arranged in an upper portion of the first ice making tray 210 by passing through the stirrer through holes 218*a*, 218*b* of the first ice making tray 210. For example, the shaft 231 may be arranged in an upper portion of the first ice making tray 210 such that a portion of the stirring member 232 and a portion of a scooping member are submerged in the water stored in the ice making cell 211.

The shaft 231 may be coupled to the stirring motor 240 and rotated clockwise or counterclockwise by receive rotational force from the stirring motor 240. Furthermore, the shaft 231 may swing according to the stirring motor 240 within a particular angle.

The stirring member 232 may be formed by protruding from the shaft 231 or by being attached onto the outer surface of the shaft 231.

The stirring member 232 may include a plurality of stirring blades 232*a* protruding outwards from the shaft 231 in the radial direction. The plurality of stirring blades 232*a* may be spirally arranged along the outer surface of the shaft 231, as shown in FIG. 10.

The stirring member 232 may be rotated or swung around the shaft 231 as the shaft 231 rotates, and at least a portion of the stirring member 232 may be submerged in the water stored in the ice making cell 211. Accordingly, while swinging or rotating, the stirring member 232 may stir the water stored in the ice making cell 211.

The width of the stirring member 232 may be smaller than the gap between the guide protrusions 252 of the slider 250 in order for the stirring member 232 passes through the slider 250 while swinging or rotating. Furthermore, the width of the stirring member 232 may be smaller than the width of the ice making cell 211 in order for the stirring member 232 to stir the water stored in the ice making cell 211.

The stirring member 232 may be provided in the plural in the axial direction of the shaft 231. The number of the plurality of stirring members 232 may be the same as the number of the plurality of ice making cells 211 of the first ice making tray 210, and the positions of the plurality of stirring members 232 may correspond to the positions of the plurality of ice making cells 211.

The gap between the stirring members 232 may be larger than the width of the guide protrusion 252 of the slider 250 in order for the stirring member 232 to pass through the slider 250 while swinging or rotating.

While swinging or rotating, the stirring member 232 may hit the ice of the ice making cell 211. The stirring member 232 may be made of a flexible material to prevent the ice of the ice making cell 211 from falling out of the ice making cell 211 when the stirring member 232 hits the ice.

The scooping member 233 may be formed by protruding from the shaft 231 or by being attached onto the outer surface of the shaft 231.

The scooping member 233 may be arranged on the opposite side of the stirring member 232 with respect to the shaft 231 not to interfere with operation of the stirring member 232 and not to be interfered by the stirring member 232.

The scooping member 233 may be rotated around the shaft 231 as the shaft 231 rotates, and at least a portion of the scooping member 233 may extend into the water stored in the ice making cell 211.

Accordingly, while rotating, the scooping member 233 may push away the ice contained in the ice making cell 211. For example, when the stirrer 230 is rotated clockwise as shown in FIG. 11, the scooping member 233 may pass the ice making cell 211. While the scooping member 233 is passing the ice making cell 211, the scooping member 233 may push up the ice contained in the ice making cell 211 clockwise. The ice may be separated from the ice making cell 211 by the scooping member 233, and guided to the slider 250 along the inner wall of the ice making cell 211, the first and second scooping guides 216 and 261. Furthermore, the ice may be caught by the guide protrusions 252 of the slider 250 to be forced to fall to the ice container 121.

The width of the scooping member 233 may be smaller than the gap between the guide protrusions 252 of the slider 250 in order for the scooping member 233 to pass the slider 250 while rotating. Furthermore, the width of the scooping member 233 may be smaller than the width of the ice making cell 211 in order for the scooping member 233 to raise the ice stored in the ice making cell 211.

The scooping member 233 may be provided in the plural in the axial direction of the shaft 231. The number of the plurality of scooping members 233 may be the same as the number of the plurality of ice making cells 211 of the first ice making tray 210, and the positions of the plurality of scooping members 233 may correspond to the positions of the plurality of ice making cells 211.

The gap between the scooping members 233 may be larger than the width of the guide protrusion 252 of the slider 250 in order for the scooping member 233 to pass the slider 250 while rotating.

Furthermore, the scooping member 233 may be made of a hard material to raise the ice of the ice making cell 211 while rotating.

As such, the stirrer 230 may stir the water of the ice making cell 211 while the ice is being made, and separate ice from the ice making cell 211 after the ice is formed. Especially, the stirrer 230 may prevent bubbles formed in the border between water and ice from being collected in the ice by stirring the water of the ice making cell 211. As a result, transparency of the ice may be improved.

The ice-maker heater 234 may be arranged inside the shaft 231 to heat air around the stirrer 230 while ice is being made. Especially, the ice-maker heater 234 may keep the temperature of an upper portion of the water stored in the ice making cell 211 above the freezing point of water.

As described above, the water stored in the ice making cell 211 may be gradually frozen from the bottom portion, thereby improving transparency of the ice. To prevent the upper portion of the water from being frozen, the ice-maker heater 234 may heat the upper portion of the water to keep the temperature of the upper portion of the water above the freezing point of water. As a result, bubbles may not be collected in the ice but may flow up in the water, thereby improving transparency of the ice.

As described above, the ice maker 110 may make transparent ice by freezing water from the bottom portion of the ice making cell 211 and stirring the water of the ice making cell 211 while the ice is being made.

Figure 12:
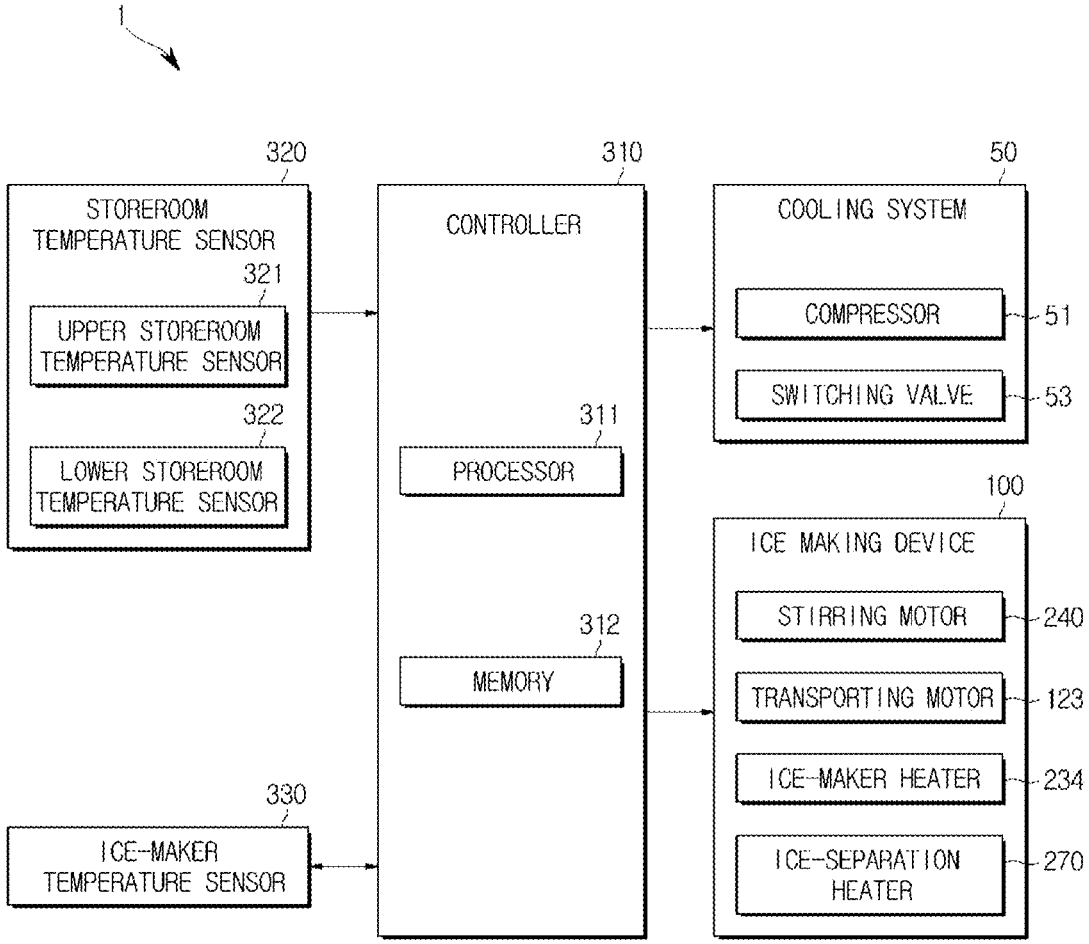
FIG. 12 is a control block diagram of a refrigerator, according to an embodiment.

FIG. 12 is a control block diagram of a refrigerator, according to an embodiment.

Referring to FIG. 12, the refrigerator 1 includes a storeroom temperature sensor 320 for measuring the temperature of the storeroom 20, an ice-maker temperature sensor 330 for measuring the temperature of the ice making device 100, the cooling system 50 for cooling the storeroom 20, the ice making device 100 for making ice, and a controller 310 for controlling the cooling system 50 based on the output of the storeroom temperature sensor 320 and controlling the ice making device 100 based on the output of the ice-maker temperature sensor 330, in addition to the configuration as described above.

The storeroom temperature sensor 320 may include an upper storeroom temperature sensor 321 for measuring the temperature of the upper storeroom 20*a* (see FIG. 3) and a lower storeroom temperature sensor 322 for measuring the temperature of the lower storeroom 20*b*.

The upper storeroom temperature sensor 321 may be arranged in the upper storeroom 20*a* for measuring the temperature of the upper storeroom 20*a* and may output an electric signal corresponding to the temperature of the upper storeroom 20*a* to the controller 310. For example, the upper storeroom temperature sensor 321 may include a thermistor whose electric resistance is changed according to the temperature.

The lower storeroom temperature sensor 322 may be arranged in the lower storeroom 20*b* for measuring the temperature of the lower storeroom 20*b* and may output an electric signal corresponding to the temperature of the lower storeroom 20*b* to the controller 310. For example, the lower storeroom temperature sensor 322 may include a thermistor whose electric resistance is changed according to the temperature.

The ice-maker temperature sensor 330 may be arranged in the ice making device 100. For example, the ice-maker temperature sensor 330 may be installed on the ice making tray 111 that stores water used to make ice.

The ice-maker temperature sensor 330 may measure the temperature of water or ice contained in the ice making tray 111, and output an electric signal corresponding to the temperature of the water or ice to the controller 310. For example, the ice-maker temperature sensor 330 may include a thermistor whose electric resistance is changed according to the temperature.

As described above in connection with FIG. 3, the cooling system 50 may include the compressor 51, the condenser 52, the expander 54, 55, the evaporator 56, the refrigerant tube 58, and the switching valve 53.

The compressor 51 may compress a refrigerant at high pressure in response to a control signal from the controller 310 and discharge the compressed refrigerant to the condenser 52. The switching valve 53 may supply the refrigerant to at least one of the evaporator 56 of the upper storeroom 20*a* and the evaporator 57 of the lower storeroom 20*b* in response to a control signal from the controller 310. In other words, in response to a control signal from the controller 310, the compressor 51 may create a flow of the refrigerant and the switching valve 53 may control a flow path of the refrigerant.

As described above in connection with FIGS. 4 to 11, the ice making device 100 may include the ice making trays 210, 220, the stirrer 230, the stirring motor 240, the ice container 121, the transporter 122, the transporting motor 123, the ice-maker heater 234, and the ice-separation heater 270.

In response to a control signal from the controller 310, the stirring motor 240 may drive the stirrer 230 to stir water. In response to a control signal from the controller 310, the transporting motor 123 may drive the transporter 122 to discharge ice of the ice storage 120.

The ice making device 100 may also include a ice-maker heater 234 for keeping the temperature of the ice maker 110 above the freezing point, and the ice-separation heater 270 for heating the ice maker 110 to separate ice from the ice maker 110.

The controller 310 may include a memory 312 for storing a program and data for controlling operation of the refrigerator 1, and a processor 311 for creating control signals to control operation of the refrigerator 1 according to the program and data stored in the memory 312. The processor 311 and the memory 312 may be implemented in separate chips or in a single chip.

The memory 312 may store a control program and control data for controlling operation of the refrigerator 1 and store various application programs and application data for performing various functions according to the user's input. Furthermore, the memory 312 may temporarily store outputs of the storeroom temperature sensor 320 and the ice-maker temperature sensor 330.

The memory 312 may include a volatile memory, such as a static random access memory (SRAM), a dynamic RAM (DRAM), or the like, which may temporarily store data. The memory 312 may also include a non-volatile memory, such as a Read Only Memory (ROM), an Erasable Programmable ROM (EPROM), an Electrically Erasable Programmable ROM (EEPROM), or the like, which may permanently store data.

The processor 311 may include various logic circuits and operation circuits, and process data under a program provided from the memory 312 and generate a control signal according to the result of the process.

For example, the processor 311 may process the output of the storeroom temperature sensor 320 and create control signals to control the compressor 51 and the switching valve 53 of the cooling system 50. For example, the processor 311 may process the output of the ice-maker temperature sensor 330 and create control signals to control the stirring motor 240, the transporting motor 123, the ice-maker heater 234, and the ice-separation heater 270 of the ice making device 100.

As such, the controller 310 may control the respective components included in the refrigerator 1 based on the temperature of the storeroom 20 and the temperature of the ice making device 100.

It may be seen that operation of the refrigerator 1, as will be described below, may be performed under the control of the controller 310.

Figure 13:
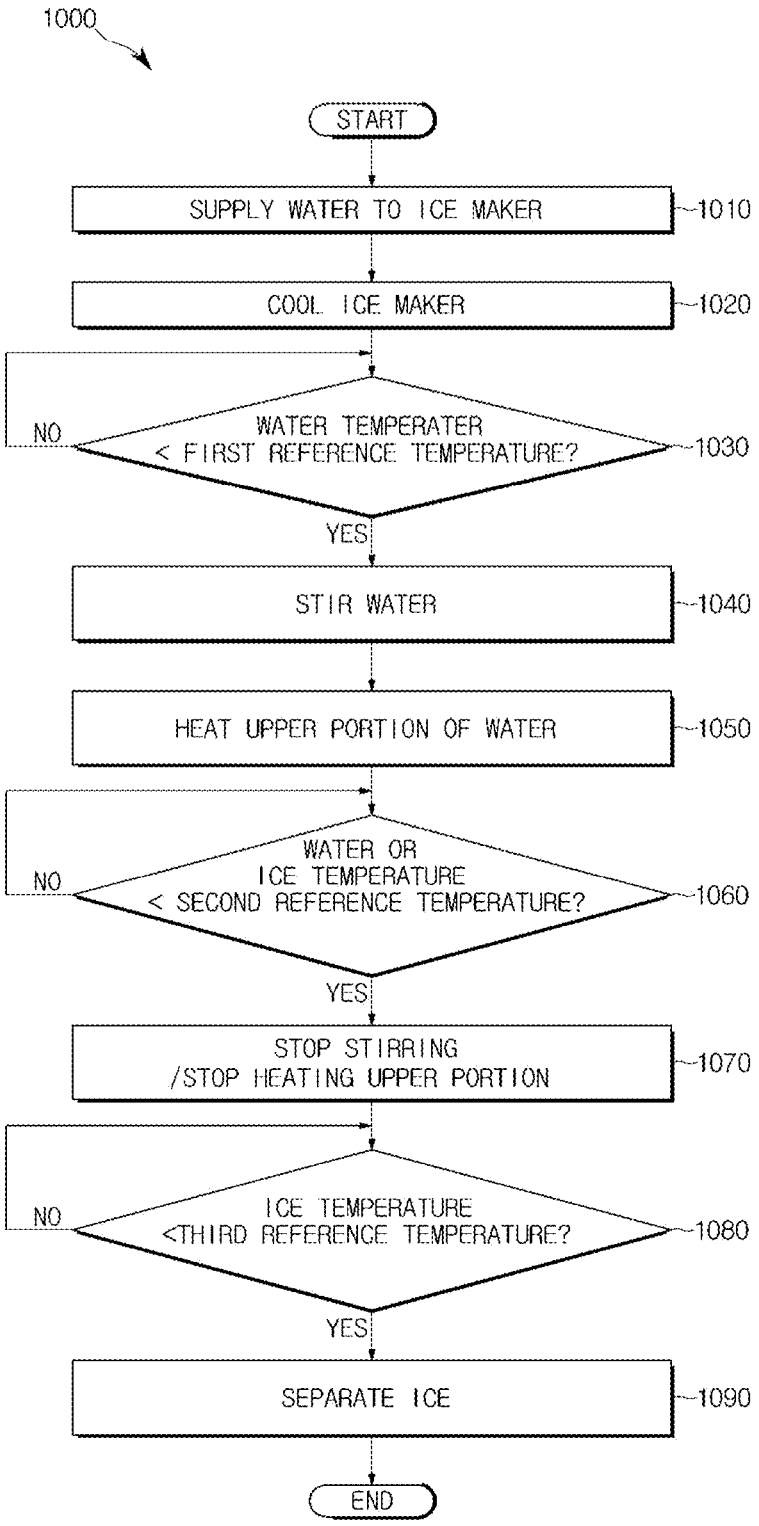
FIG. 13 is a flowchart illustrating ice making operation of a refrigerator, according to an embodiment.
Figure 14:
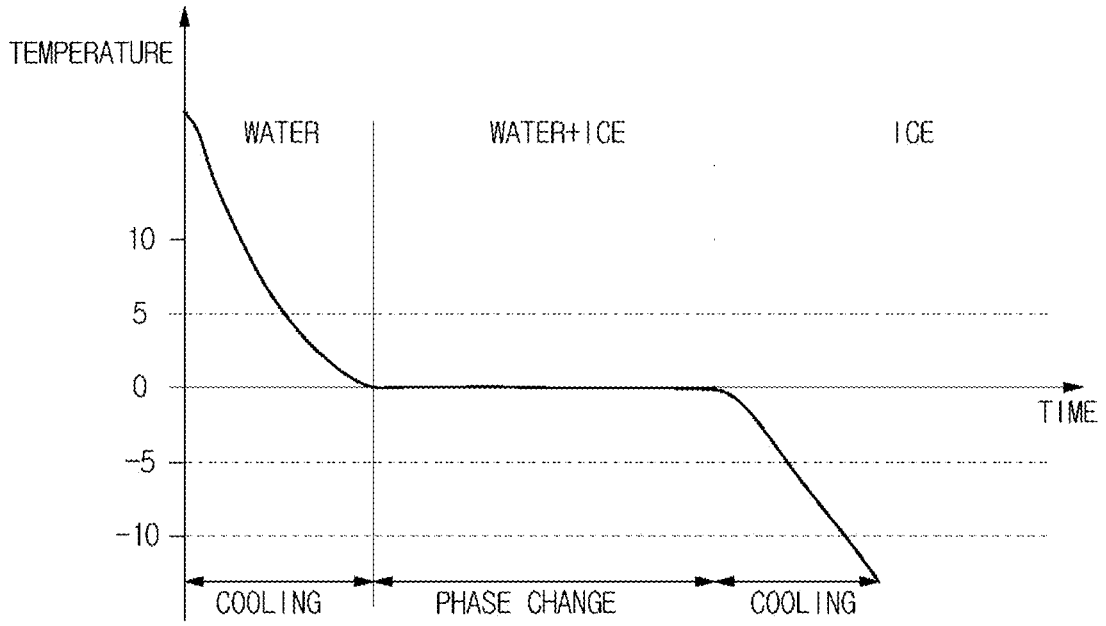
FIG. 14 shows changes in temperature of water or ice according to the ice making operation shown in FIG. 13.
Figure 15:
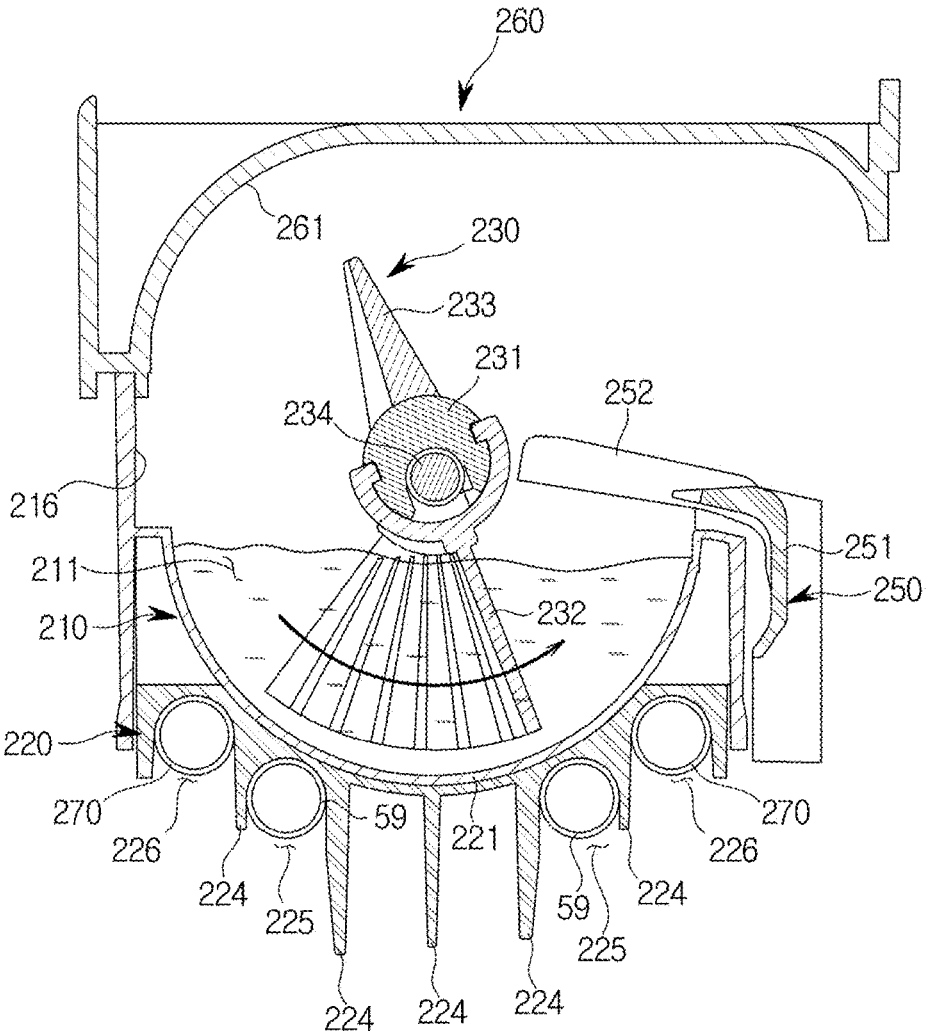
FIGS. 15 and 16 show stirring water according to the ice making operation shown in FIG. 13.
Figure 16:
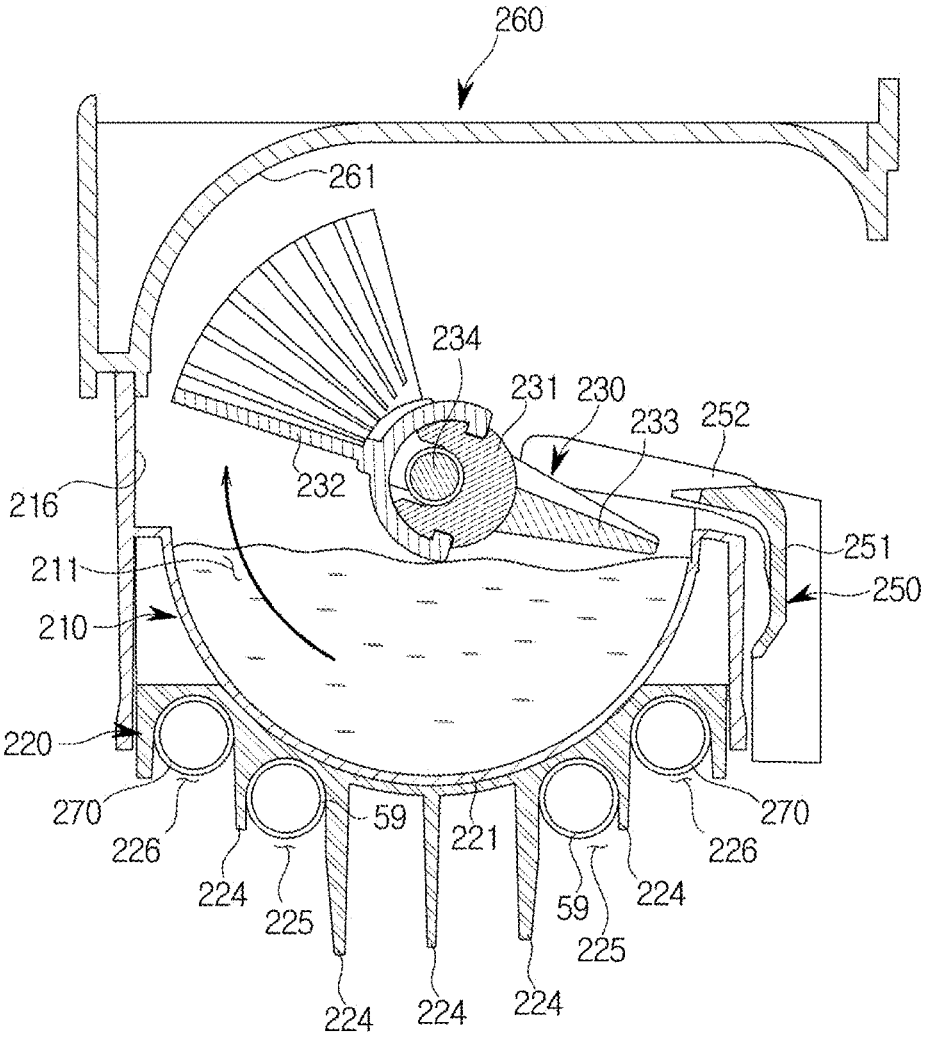
Figure 17:
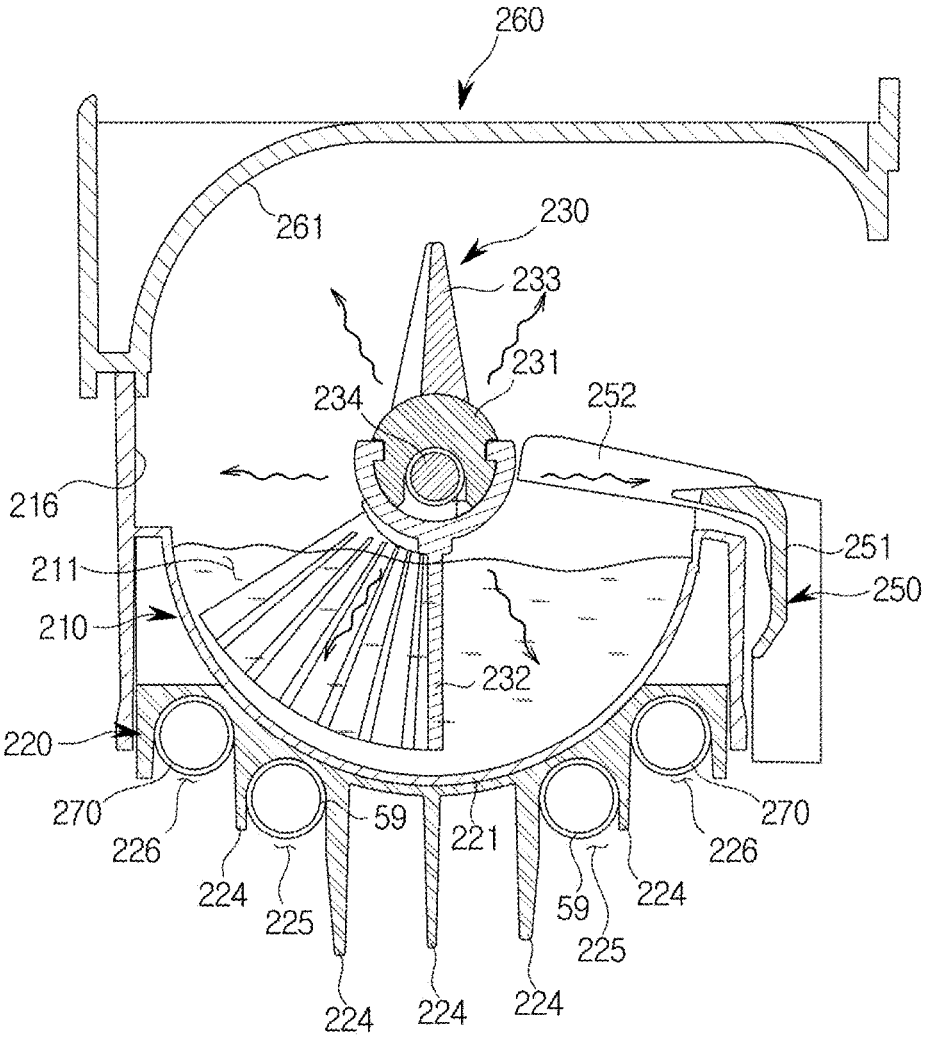
FIG. 17 shows heating inside air of a ice maker according to the ice making operation shown in FIG. 13.

FIG. 13 is a flowchart illustrating ice making operation of a refrigerator, according to an embodiment. FIG. 14 shows changes in temperature of water or ice according to the ice making operation shown in FIG. 13. FIGS. 15 and 16 show stirring water according to the ice making operation shown in FIG. 13. FIG. 17 shows heating inside air of a ice maker according to the ice making operation shown in FIG. 13.

Ice making operation 1000 of the refrigerator 1 will be described in connection with FIGS. 13, 14, 15, 16, and 17.

The refrigerator 1 supplies water to the ice maker 110, in 1010.

The controller 310 of the refrigerator 1 may open the water supply valve (not shown) to supply water to the ice maker 110.

Once water is supplied to the ice maker 110, the water may be guided to the water supply port 215 along the water supply guide 214 shown in FIGS. 4 to 11. The water may also be supplied to the plurality of ice making cells 211 through the water supply port 215. Especially, through holes 213*a* are formed between the plurality of ice making cells 211, and water may be sequentially supplied to the plurality of ice making cells 211 through the through holes 213*a*.

The refrigerator 1 cools the ice maker 110, in 1020.

The controller 310 of the refrigerator 1 may activate the compressor 51 of the cooling system 50 to create a flow of the refrigerant, and control the switching valve 53 to supply the refrigerant to the ice-maker refrigerant tube 59.

For example, the compressor 51 may compress and discharge a gaseous refrigerant, and the refrigerant discharged from the compressor 51 may flow into the switching valve 53 through the condenser 52. The refrigerant may be guided by the switching valve 53 to the ice-maker refrigerant tube 59, and the refrigerant guided to the ice-maker refrigerant tube 59 may flow into the ice-maker refrigerant tube 59 through the expander 55. A portion of the refrigerant may be evaporated in the ice-maker refrigerant tube 59, and with the evaporation of the refrigerant, the ice maker 110 (e.g., the first and second ice making trays 210 and 220) may be cooled. Subsequently the refrigerant may flow into the compressor 51 through the evaporator 57 of the lower storeroom 20*b*.

In this way, the refrigerant circulates by the compressor 51, and while the refrigerant is circulating, the refrigerant may cool the ice maker 110 by absorbing heat energy from the ice maker 110.

While the ice maker 110 is being cooled, the refrigerator 1 determines whether the temperature of water stored in the ice maker 110 is lower than a first reference temperature, in 1030.

As the ice maker 110 is cooled, the water stored in the ice maker 110 may also be cooled. For example, the ice-maker refrigerant tube 59 makes the second ice making tray 220 in contact with the ice-maker refrigerant tube 59 cooled, and the first ice making tray 210 in contact with the second ice making tray 220 may then be cooled. Furthermore, water stored in the ice making cell 211 of the first ice making tray 210 may be cooled.

While the water stored in the ice maker 110 is being cooled, the controller 310 of the refrigerator 1 may measure the temperature of the water stored in the ice maker 110 through the ice-maker temperature sensor 330. Furthermore, the controller 310 may compare the temperature of the water stored in the ice maker 110 with the first reference temperature.

The first reference temperature may be about 1 to 5 degrees Celsius, which is a bit higher than the freezing point of water. While the water is being cooled, the temperature of the water or ice may change as shown in FIG. 14. The temperature of water continues to drop until it reaches the freezing point (i.e., 0 degree Celsius) of water, and when the temperature of the water reaches 0 degree Celsius, it may remain constant. While the temperature of the water remains constant, a phase change in which water turns to ice takes place.

To determine whether the phase change from water to ice has begun, the first reference temperature may be set to a temperature, which is about 1 to 2 degrees Celsius higher than the freezing point of water. In other words, the first reference temperature may be set to about +1 to 2 degrees Celsius.

If the temperature of the water stored in the ice maker 110 is not lower than the first reference temperature in 1030, the refrigerator 1 may repeat measuring the temperature of the water stored in the ice maker 110.

If the temperature of the water stored in the ice maker 110 is lower than the first reference temperature in 1030, the refrigerator 1 may stir the water of the ice maker 110, in 1040.

If the temperature of the water stored in the ice maker 110 is lower than the first reference temperature, it may be determined that the water of the ice maker 110 starts being frozen.

When water is rapidly frozen, the air dissolved in the water may be supersaturated to form bubbles. If the water is frozen without elimination of the bubbles, ice becomes opaque due to the bubbles collected in the ice.

To make transparent ice, the refrigerator 1 may eliminate the bubbles by stirring the water while the water is being frozen.

The controller 310 of the refrigerator 1 may output a control signal to the stirring motor 240 of the ice maker 110 to stir water. In response to the control signal from the controller 310, the stirring motor 240 may provide rotational force for the stirrer 230 to be swung or rotated.

The stirrer 230 may stir water and eliminate bubbles by being swung or rotated while the ice is being formed. The stirrer 230 may include the stirring member 232 and the scooping member 233, and use the stirring member 232 to stir the water stored in the ice making tray 210, 220.

The controller 310 may control the stirring motor 240 to swing the stirrer 230 within a predetermined angle. While being swung within the predetermined angle, the stirrer 230 may stir the water stored in the ice making tray 210, 220.

The controller 310 may control the stirring motor 240 to rotate the stirrer 230 counterclockwise as shown in FIG. 15, and with the rotation of the stirrer 230, the stirring member 232 may be moved to the right in the water stored in the ice making tray 210, 220.

Before the stirring member 232 gets out of the water stored in the ice making tray 210, 220, the controller 310 may stop the counterclockwise rotation of the stirrer 230. The right side of the ice making tray 210, 220 is opened to make ice fall to the ice container 121. Accordingly, when the stirring member 232 is swung out of the water of the ice making tray 210, 220, the water may splash on the ice container 121 due to the stirring member 232.

To prevent the water stored in the ice making tray 210, 220 from splashing on the ice container 121, the controller 310 may control the stirring motor 240 to stop swinging the stirrer 230 before the stirring member 232 gets out of the water of the ice making tray 210, 220.

Subsequently, the controller 310 may control the stirring motor 240 to rotate the stirrer 230 clockwise as shown in FIG. 16, and with the rotation of the stirrer 230, the stirring member 232 may be moved to the left in the water stored in the ice making tray 210, 220.

Right after the stirring member 232 gets out of the water stored in the ice making tray 210, 220, the controller 310 may stop the clockwise rotation of the stirrer 230. The left side of the ice making tray 210, 220 is closed by the first ice making tray 210 and the ice-maker cover 260 to separate ice. Accordingly, even if the stirring member 232 is swung out of the water, the water of the ice making tray 210, 220 does not splash on the ice container 121.

To stir the water stored in the ice making tray 210, 220 enough, the controller 310 may control the stirring motor 240 to stop swinging the stirrer 230 right after the stirring member 232 gets out of the water of the ice making tray 210, 220.

In this way, as the stirrer 230 stirs the water stored in the ice making tray 210, 220, the refrigerator 1 may eliminate bubbles formed while the water is being frozen. Furthermore, the refrigerator 1 may make transparent ice.

Moreover, the refrigerator 1 heats an upper portion of the water stored in the ice maker 110, in 1050.

As described above, when water is rapidly frozen, the ice may become opaque.

The refrigerator 1 may freeze the water in the ice making tray 210, 220 from its bottom to make transparent ice. When the water in the ice making tray 210, 220 starts being frozen from its bottom, bubbles from supersaturated air may move up in the water, and the refrigerator 1 may eliminate the bubbles by stirring operation. Furthermore, when the water in the ice making tray 210, 220 starts being frozen from its bottom, the refrigerator 1 may smoothly stir the water in the ice making tray 210.

To freeze the water in the ice making tray 210, 220 from its bottom, the refrigerator 1 may keep the temperature of air in an upper portion of the ice making tray 210 above the freezing point. To keep the temperature of the air in the upper portion the ice making tray 210, 220 above the freezing point, the controller 310 of the refrigerator 1 may activate the ice-maker heater 234 of the stirrer 230.

The ice-maker heater 234 may be placed inside the shaft 231 of the stirrer 230, and the stirrer 230 is placed in an upper portion of the ice making tray 210, 220. Accordingly, the ice-maker heater 234 may radiate heat to the upper portion of the ice making tray 210, 220, as shown in FIG. 17.

Due to the operation of the ice-maker heater 234, the temperature in the upper portion of the ice making tray 210, 220 may remain above the freezing point, and the water stored in the ice making tray 210, 220 may be frozen from the bottom.

In this way, as the ice-maker heater 234 heats the upper portion of the water stored in the ice making tray 210, 220, the water stored in the ice making tray 210, 220 may be frozen from the bottom. Furthermore, the refrigerator 1 may make transparent ice.

The refrigerator 1 may keep on stirring water stored in the ice making tray 210, 220 and heating the upper portion of the ice making tray 210, 220 while the water stored in the ice making tray 210, 220 is being frozen.

While the water in the ice maker 110 is being frozen, the refrigerator 1 determines whether the temperature of water or ice in the ice maker 110 is lower than a second reference temperature, in 1060.

As shown in FIG. 14, while the water is being phase-changed into ice, the temperature of the water or ice may remain constant at the freezing point of water (0 degree Celsius). When the temperature of the water or ice drops below the freezing point of water (0 degree Celsius), it may be determined that the water has been frozen.

To determine whether water has been frozen, the second reference temperature may be set to a temperature, which is about 1 to 2 degrees Celsius lower than the freezing point of water. In other words, the second reference temperature may be set to about −1 to 2 degrees Celsius.

If the temperature of the water stored in the ice maker 110 is not lower than the second reference temperature in 1060, the refrigerator 1 may repeat measuring the temperature of the water or ice stored in the ice maker 110.

If the temperature of the water stored in the ice maker 110 is lower than the second reference temperature in 1060, the refrigerator 1 may stop stirring the water stored in the ice maker 110 and heating the upper portion of the ice maker 110, in 1070.

As shown in FIG. 14, when the water is phase-changed into ice, the temperature of the ice drops below the freezing point of water (0 degree Celsius). When the temperature of the water or ice drops below the freezing point of water (0 degree Celsius), it may be determined that the water around the ice-maker temperature sensor 330 has been frozen.

Especially, with stirring of water stored in the ice making tray 210, 220 and heating of the upper portion of the ice making tray 210, 220, the water stored in the ice making tray 210, 220 may be frozen from the bottom. In other words, the water of a lower portion of the ice making tray 210, 220 is frozen earlier than the water of an upper portion of the ice making tray 210, 220, and the temperature of the water or ice of the lower portion of the ice making tray 210, 220 is lower than the temperature of the water of the upper portion of the ice making tray 210, 220.

The ice-maker temperature sensor 330 for measuring the temperature of water or ice may be placed in a lower portion of the ice making tray 210, 220 for measuring the temperature of the water or ice of the lower portion of the ice making tray 210, 220. The controller 310 may detect the freezing of water of the lower portion of the ice making tray 210, 220 based on the output of the ice-maker temperature sensor 330.

If the temperature from the output of the ice-maker temperature sensor 330 is lower than the second reference temperature, i.e., if the freezing of water of the lower portion of the ice making tray 210, 220 is detected, the controller 310 may stop stirring the water stored in the ice maker 110 and heating the upper portion of the ice maker 110.

If even the water of the upper portion of the ice making tray 210, 220 is frozen, the stirrer 230 may have difficulty in stirring the water or ice in the ice making tray 210, 220 and is likely to be damaged while stirring the water or ice. Accordingly, when the freezing of water of the lower portion of the ice making tray 210, 220 is detected, the controller 310 may stop stirring the water stored in the ice maker 110.

If the upper portion of the ice maker 110 continues to be heated, the freezing of water of the upper portion of the ice making tray 210, 220 may be delayed. Accordingly, when the freezing of water of the lower portion of the ice making tray 210, 220 is detected, the controller 310 may stop heating the upper portion of the water stored in the ice maker 110.

Subsequently, the refrigerator 1 determines whether the temperature of water or ice in the ice maker 110 is lower than a third reference temperature, in 1080.

As shown in FIG. 14, once the water is frozen into ice, the temperature of the ice may continue to drop. When the temperature of the ice is low enough (e.g., about −10 to −20 degrees Celsius), the ice may not easily melt from a change in surrounding temperature.

To determine whether the water has been sufficiently frozen, the third reference temperature may be set to about −10 to −20 degrees Celsius.

If the temperature of the ice in the ice maker 110 is not lower than the third reference temperature in 1080, the refrigerator 1 may repeat measuring the temperature of the ice in the ice maker 110.

If the temperature of the ice in the ice maker 110 is lower than the third reference temperature in 1080, the refrigerator 1 may separate the ice from the ice maker 110, in 1090.

When the temperature of the ice is low enough (e.g., about −10 to −20 degrees Celsius), it may be determined that ice making is done.

After ice making is done, the controller 310 of the refrigerator 1 may store the ice in the ice storage 120 and separate the ice from the ice maker 110 to be ready to make new ice.

To separate the ice from the ice making tray 210, 220, the controller 310 may activate the ice-separation heater 270. The ice-separation heater 270 may heat the ice making tray 210, 220, and when the ice making tray 210, 220 is heated, a portion of the ice that contacts the ice making tray 210, 220 melts. As a result, a water film is formed between the ice and the ice making tray 210, 220, making the ice movable on the ice making tray 210, 220.

Subsequently, the controller 310 may output a control signal to the stirring motor 240 for the scooping member 233 to push the ice out of the ice making tray 210, 220.

In response to the control signal from the controller 310, the stirring motor 240 may rotate the stirrer 230 for the scooping member 233 to push the ice out of the ice making tray 210, 220. For example, as shown in FIG. 15, the stirring motor 240 may rotate the stirrer 230 clockwise. The scooping member 233 of the stirrer 230 may lift the ice of the ice making tray 210, 220 to the left, and the ice may be guided to the slider 250 along the first scooping guide 216 of the first ice making tray 210 and the second scooping guide 261 of the ice-maker cover 260. The ice may fall to the ice container 121 of the ice storage 120 by the slider 250.

As described above, while forming the ice, the refrigerator 1 may cool the water such that the water may be frozen from the bottom portion, and stir the water. As a result, the refrigerator 1 may eliminate bubbles formed while the water is being frozen, thereby forming transparent ice.

Although it was described that the refrigerator 1 stirs water and heats the upper portion of the water depending on the temperature of the water or ice, embodiments are not limited thereto.

For example, the refrigerator 1 may stir the water and heat the upper portion of the water depending on time.

The refrigerator 1 may stir water and heat the upper portion of the water until after the lapse of a certain period of time after the water is supplied to the ice maker 110. Specifically, the controller 310 may activate the stirring motor 240 and the ice-maker heater 234 until after the lapse of a certain period of time after water is supplied to the ice maker 110, and after the lapse of the certain period of time, the controller 310 may stop activating the stirring motor 240 and the ice-maker heater 234. The certain period of time may be time taken until the bottom portion of the water is frozen, and set by a pre-experiment.

Alternatively, the refrigerator 1 may stir water and heat the upper portion of the water after the lapse of a first period of time after the water is supplied to the ice maker 110. The first period of time may be time from which water starts to be frozen, and set by a pre-experiment. Furthermore, after the lapse of a second period of time after the stirring and heating starts, the refrigerator 1 may stop stirring water and heating the upper portion of the water. The second period of time may be time taken from when the water starts to be frozen to when the bottom portion of the water is frozen, and set by a pre-experiment.

Figure 18:
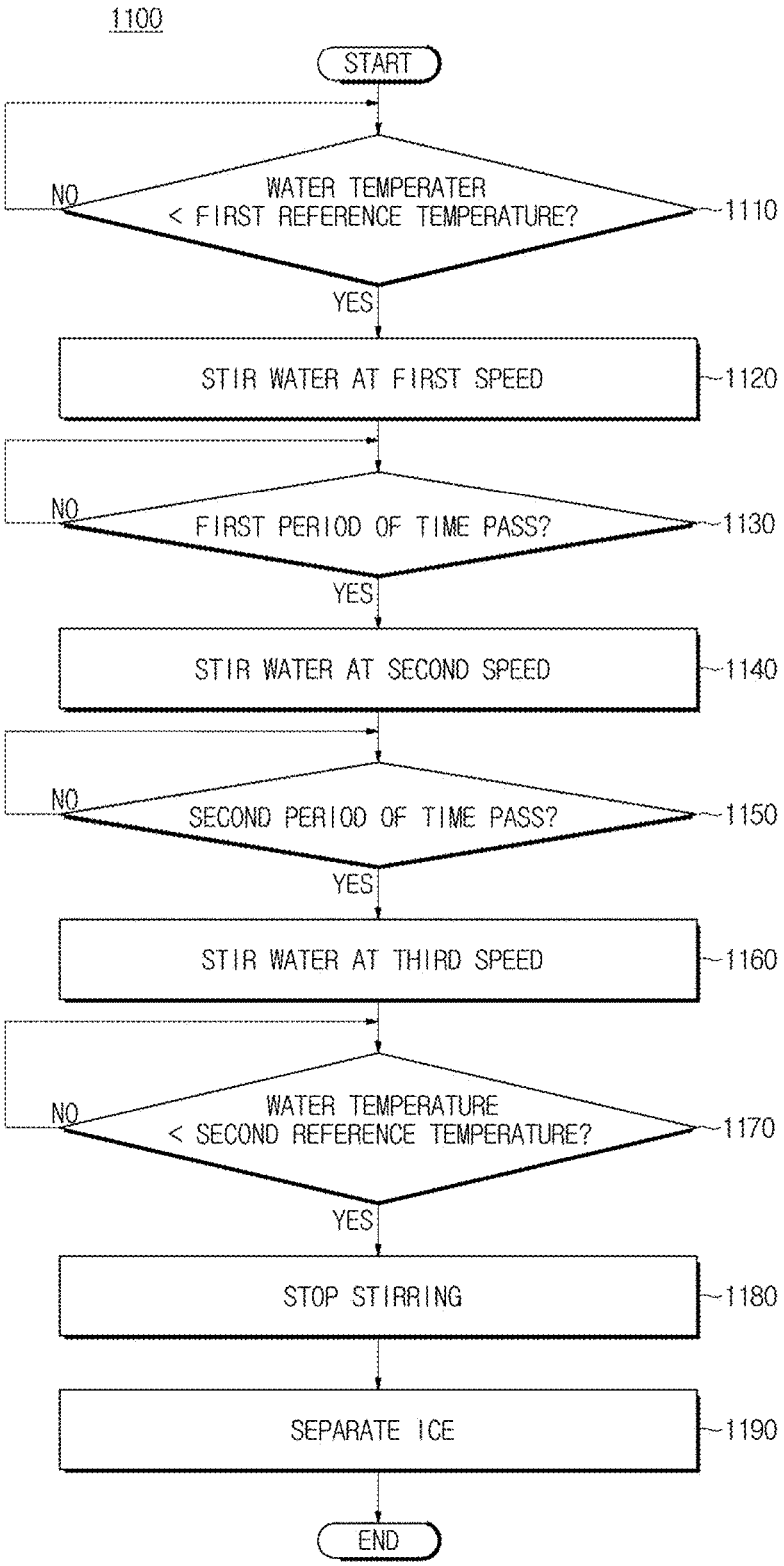
FIG. 18 is a flowchart illustrating ice making operation of a refrigerator, according to another embodiment.

FIG. 18 is a flowchart illustrating ice making operation of a refrigerator, according to another embodiment.

Ice making operation 1100 of the refrigerator 1 will be described in connection with FIG. 18.

The refrigerator 1 may supply water to the ice maker 110 and cool the ice maker 110. This operation may be the same as the operations 1010 and 1020 shown in FIG. 13.

While the ice maker 110 is being cooled, the refrigerator 1 determines whether the temperature of water stored in the ice maker 110 is lower than a first reference temperature, in 1110.

The first reference temperature may be set to about +1 to 2 degrees Celsius, and the operation 1110 may be the same as the operation 1030 shown in FIG. 13.

If the temperature of the water stored in the ice maker 110 is lower than the first reference temperature in 1110, the refrigerator 1 may use the stirrer 230 to stir the water of the ice maker 110 at first speed, in 1120.

If the temperature of the water stored in the ice maker 110 is lower than the first reference temperature, it may be determined that the water of the ice maker 110 starts being frozen, and the controller 310 of the refrigerator 1 may have the water stored in the ice maker 110 stirred to eliminate bubbles formed in the water stored in the ice maker 110.

The controller 310 may control the stirring motor 240 to swing the stirrer 230 at the predetermined first speed. For example, the controller 310 may control the stirring motor 240 to swing the stirrer 230 at about 60 rpm.

While the stirrer 230 is swung at the first speed, the stirring member 232 of the stirrer 230 may stir the water stored in the ice making tray 210, 220 and eliminate bubbles formed in the water stored in the ice making tray 210, 220.

While the stirrer 230 is swinging at the first speed, the refrigerator 1 determines whether a predetermined first period of time elapses, in 1130.

The first period of time may be set based on time taken for the water stored in the ice making tray 210, 220 to be frozen. For example, the first period of time may be a third of time taken for the water stored in the ice making tray 210, 220 to be frozen.

After the lapse of the first period of time after the stirrer 230 is swung at the first speed, in 1130, the refrigerator 1 may use the stirrer 230 to stir the water of the ice maker 110 at a second speed, in 1140.

The controller 310 of the refrigerator 1 may control the stirring motor 240 to swing the stirrer 230 at the first speed for the first period of time, and after the lapse of the first period of time, the controller 310 may control the stirring motor 240 to swing the stirrer 230 at a predetermined second speed. The second speed may be lower than the first speed. For example, the controller 310 may control the stirring motor 240 to swing the stirrer 230 at about 30 rpm.

While the stirrer 230 is swung at the second speed, the stirring member 232 of the stirrer 230 may stir the water stored in the ice making tray 210, 220 and eliminate bubbles formed in the water stored in the ice making tray 210, 220.

While the stirrer 230 is swung at the second speed, the refrigerator 1 determines whether a predetermined second period of time elapses, in 1150.

The second period of time may be set based on time taken for the water stored in the ice making tray 210, 220 to be frozen, and may or may not be the same as the first period of time. For example, the second period of time may be a third of time taken for the water stored in the ice making tray 210, 220 to be frozen.

After the lapse of the second period of time after the stirrer 230 is swung at the second speed, in 1150, the refrigerator 1 may use the stirrer 230 to stir the water of the ice maker 110 at a third speed, in 1160.

The controller 310 of the refrigerator 1 may control the stirring motor 240 to swing the stirrer 230 at the second speed for the second period of time, and after the lapse of the second period of time, the controller 310 may control the stirring motor 240 to swing the stirrer 230 at a predetermined third speed. The third speed may be lower than the second speed. For example, the controller 310 may control the stirring motor 240 to swing the stirrer 230 at about 10 rpm.

While the stirrer 230 is swung at the third speed, the stirring member 232 of the stirrer 230 may stir the water stored in the ice making tray 210, 220 and eliminate bubbles formed in the water stored in the ice making tray 210, 220.

While the stirrer 230 is swinging, the refrigerator 1 determines whether the temperature of water or ice in the ice maker 110 is lower than a second reference temperature, in 1170.

The second reference temperature may be set to about −1 to −2 degrees Celsius, and the operation 1170 may be the same as the operation 1060 shown in FIG. 13.

If the temperature of the water stored in the ice maker 110 is lower than the second reference temperature in 1170, the refrigerator 1 may stop stirring the water stored in the ice maker 110, in 1180.

If the temperature measured by the ice-maker temperature sensor 330 arranged in a lower portion of the ice making tray 210, 220 is (about −1 to −2 degrees Celsius) lower than the second reference temperature, it may be determined that the water of the lower portion of the ice making tray 210, 220 has been frozen and the controller 310 may stop stirring the water stored in the ice maker 110.

Subsequently, the refrigerator 1 separates the ice from the ice maker 110, in 1190.

If the temperature of water or ice in the ice maker 110 is lower than the third reference temperature, the controller 310 of the refrigerator 1 may store the ice in the ice storage 120 and separate the ice from the ice maker 110 to be ready to make new ice. For example, to separate the ice from the ice making tray 210, 220, the controller 310 may activate the ice-separation heater 270 and output a control signal to the stirring motor 240 for the scooping member 233 to push the ice out of the ice making tray 210, 220.

As described above, as the freezing proceeds, the refrigerator 1 may gradually reduce the swing speed of the stirrer 230 (or stirring speed of the stirring member). As the freezing proceeds, the water stored in the ice making tray is gradually frozen and the ice and the stirring member 232 may start colliding with each other. Due to the collision between the ice and the stirring member 232, the ice may fall out of the ice making tray 210, 220 or the stirring member 232 may be damaged. To prevent the loss of ice or the damage of the stirring member 232, the controller 310 may control the stirring motor 240 to reduce the swing speed of the stirrer 230 (or the stirring speed of the stirring member) as the freezing proceeds.

FIGS. 19A, 19B, 20A, 20B, 21A, 21B, 22A, 22B, 23A, and 23B show replacements for the stirrer shown in FIG. 10.

FIG. 10 shows the stirrer 230 included in the ice making device 100. However, the form of the stirrer 230 is not limited to what is shown in FIG. 10, and the stirrer 230 may have various forms.

Figure 19A:
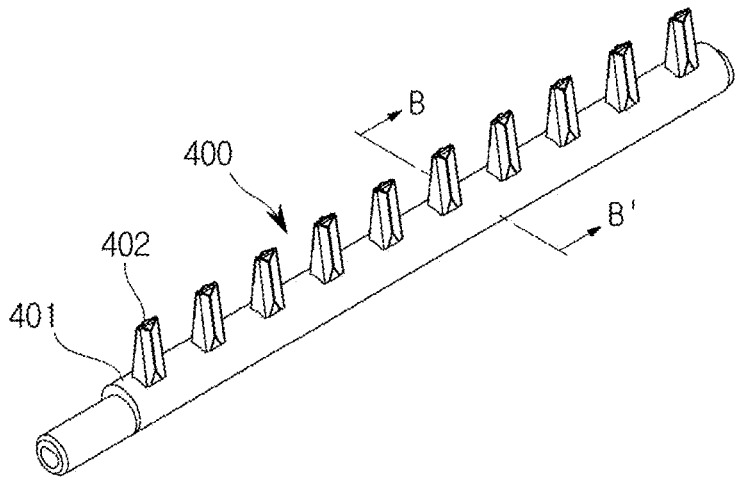
FIGS. 19A, 19B, 20A, 20B, 21A, 21B, 22A, 22B, 23A, and 23B show replacements for the stirrer shown in FIG. 10.
Figure 19B:
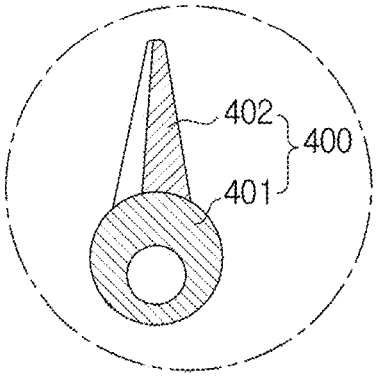

For example, the ice making device 100 may include a stirrer 400 as shown in FIGS. 19A and 19B.

The stirrer 400 includes a shaft 401 rotationally installed in the ice making tray 210, 220, and stirring/scooping member 402 formed to protrude from the shaft 401.

The shaft 401 may be identical to the shaft 231 shown in FIG. 10. However, unlike the stirrer 230 shown in FIG. 10 including the stirring member 232 and the scooping member 233 separately, the stirrer 400 may include a united stirring/scooping member 402.

The stirrer 400 may be swung or rotated by the stirring motor 240. While ice is being formed, the stirrer 400 may be swung by the stirring motor 240 within a predetermined angle, and while the stirrer 400 is swinging, the stirring/scooping member 402 may stir the water stored in the ice making tray 210, 220.

Furthermore, after ice making is done, the stirrer 400 may be rotated by the stirring motor 240, and while the stirrer 400 is rotating, the stirring/scooping member 402 may separate the ice from the ice making tray 210, 220.

In this way, the stirring/scooping member 232*a* of the stirrer 400 may perform both stirring the water of the ice making tray 210, 220 and separating the ice from the ice making tray 210, 220.

Figure 20A:
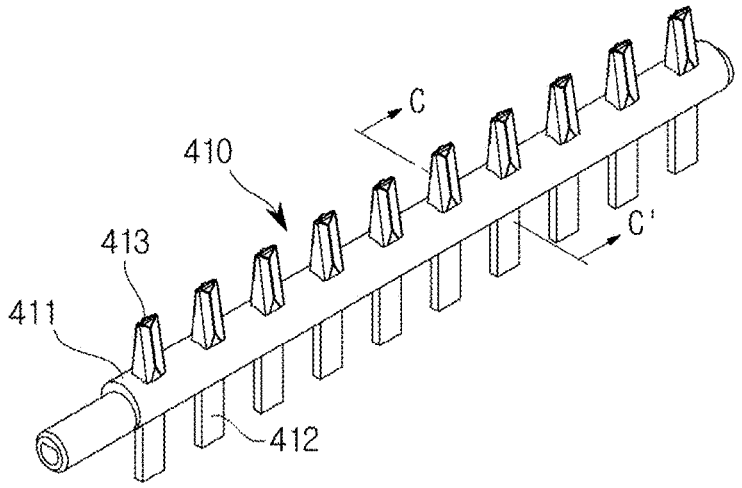
Figure 20B:
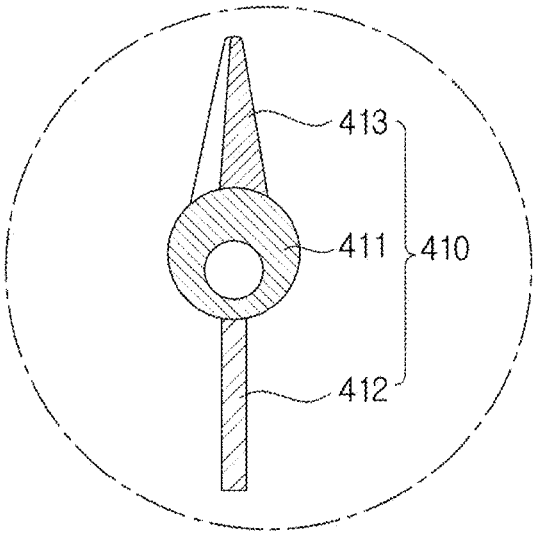

In another example, the ice making device 100 may include a stirrer 410 as shown in FIGS. 20A and 20B.

The stirrer 410 includes a shaft 411, a stirring member 412 formed to protrude from the shaft 411 in a first direction, and a scooping member 413 formed to protrude from the shaft 411 in a second direction.

The shaft 411 and the scooping member 413 may be identical to the shaft 231 and the scooping member 233 shown in FIG. 10.

Unlike the stirring member 232 shown in FIG. 10 including the plurality of stirring blades 232*a* arranged in a spiral form, the stirring member 412 is shaped like a plate. The plate-like stirring member 412 may protrude outward from the shaft 411 in the radial direction and may extend along the axial direction of the shaft 411. In other words, the horizontal direction of the plate-like stirring member 412 may correspond to the axial direction of the shaft 411. It is not, however, be limited thereto, but the horizontal direction of the plate-like stirring member 412 may not correspond to the axial direction of the shaft 411.

The stirring member 412 and the scooping member 413 may protrude in the opposite directions from the shaft 411 to avoid interference with each other. It is not, however, limited thereto, but the stirring member 412 and the scooping member 413 may protrude in different directions other than the opposite directions.

The stirring member 412 may be made of a flexible material to stir the water stored in the ice making tray 210, 220 while ice is being formed. Furthermore, the scooping member 413 may be made of a hard material to separate ice from the ice making tray 210, 220 after ice making is done.

Figure 21A:
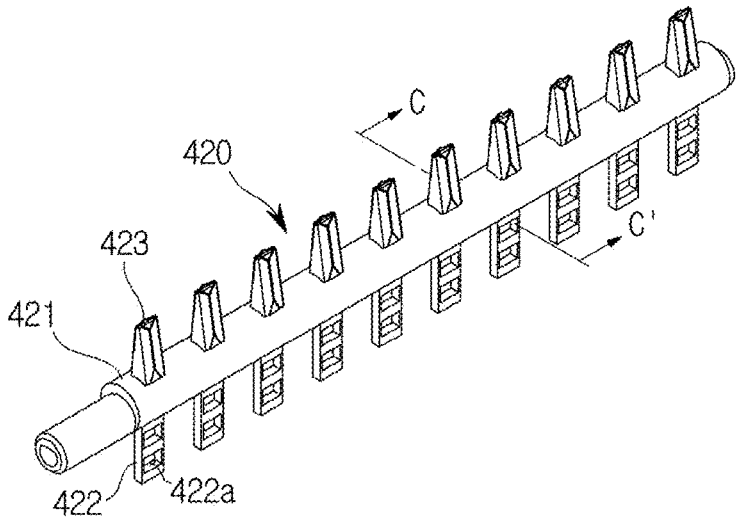
Figure 21B:
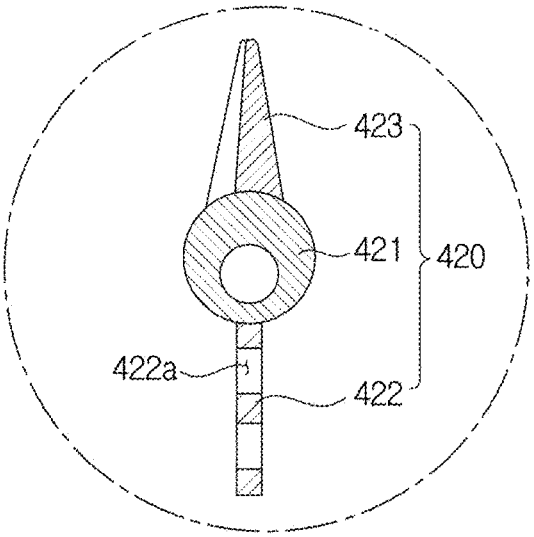

In another example, the ice making device 100 may include a stirrer 420 as shown in FIGS. 21A and 21B.

The stirrer 420 includes a shaft 421, a stirring member 422 formed to protrude from the shaft 421 in a first direction, and a scooping member 423 formed to protrude from the shaft 421 in a second direction.

The shaft 421 and the scooping member 423 may be identical to the shaft 411 and the scooping member 413 shown in FIGS. 20A and 20B.

Unlike the stirring member 412 shown in FIGS. 20A and 20B, the stirring member 422 shaped like a plate may have through holes 422*a* formed therein. While the stirring member 422 is stirring water of the ice making tray 210, 220, the water or ice may pass the through holes 422*a* of the stirring member 422. Especially, as the ice passes the through holes 422*a* of the stirring member 422, collision between the ice and the stirring member 422 may be avoided. Accordingly, the stirring member 422 may be made of a hard material like the scooping member 423.

The horizontal direction of the plate-like stirring member 422 may correspond to the axial direction of the shaft 421, without being limited thereto. The stirring member 422 and the scooping member 423 may protrude in the opposite directions from the shaft 421 to avoid interference with each other, without being limited thereto.

Figure 22A:
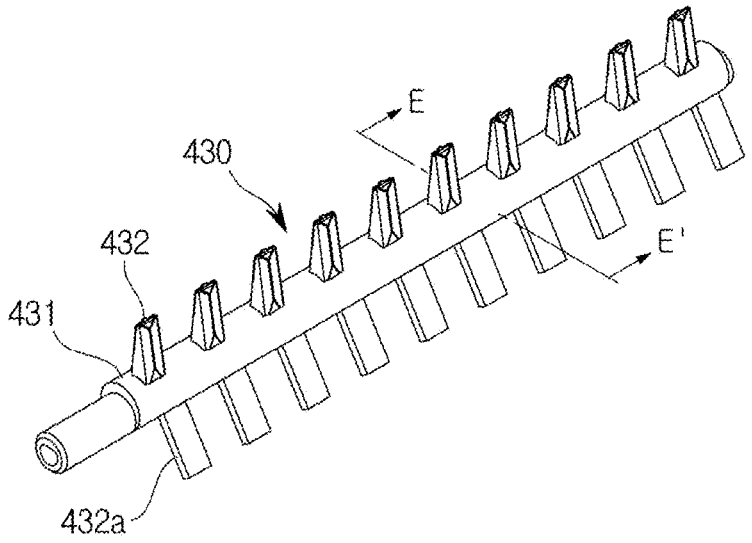
Figure 22B:
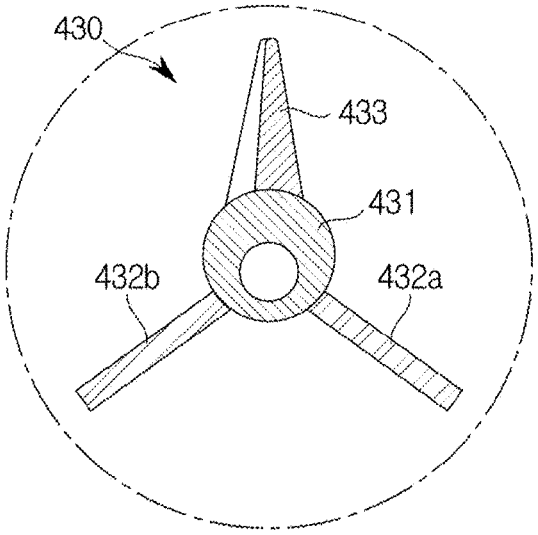

In another example, the ice making device 100 may include a stirrer 430 as shown in FIGS. 22A and 22B.

The stirrer 430 includes a shaft 431, a first stirring member 432*a* formed to protrude from the shaft 431 in a first direction, a second stirring member 432*b* formed to protrude from the shaft 431 in a second direction, and a scooping member 433 formed to protrude from the shaft 431 in a third direction.

The shaft 431 and the scooping member 433 may be identical to the shaft 411 and the scooping member 433 shown in FIGS. 20A and 20B.

Unlike the stirrer 410 shown in FIGS. 20A and 20B including a single stirring member 412, the stirrer 430 may include the first and second stirring members 432*a* and 432*b*. As the stirrer 430 includes the first and second stirring members 432*a* and 432*b*, the first and second stirring members 432*a* and 432*b* may each stir water in the ice making tray 210, 220 according to swinging of the stirrer 430. In other words, the stirrer 430 may have a stirring effect almost doubled as compared with the stirrer 410 shown in FIG. 20.

Although the stirrer 430 has two stirring members 432*a* and 432*b*, it is not limited thereto, but the stirrer 430 may have three or more stirring members in some other embodiments.

The first and second stirring members 432*a* and 432*b* may each have a plate form, and the first and second stirring members 432*a* and 432*b* may have the same shape.

The horizontal direction of the first stirring member 432*a* and the horizontal direction of the second stirring member 432*b* may correspond to each other, without being limited thereto.

The first stirring member 432*a*, the second stirring member 432*b*, and the scooping member 433 may protrude from the shaft 431 with gaps to avoid interference with one another. For example, the protruding directions of the first stirring member 432*a*, the second stirring member 432*b*, and the scooping member 433 may be at intervals of 120 degrees. It is not, however, be limited thereto, but the first stirring member 432*a*, the second stirring member 432*b*, and the scooping member 433 may be arranged to protrude in any different directions.

Figure 23A:
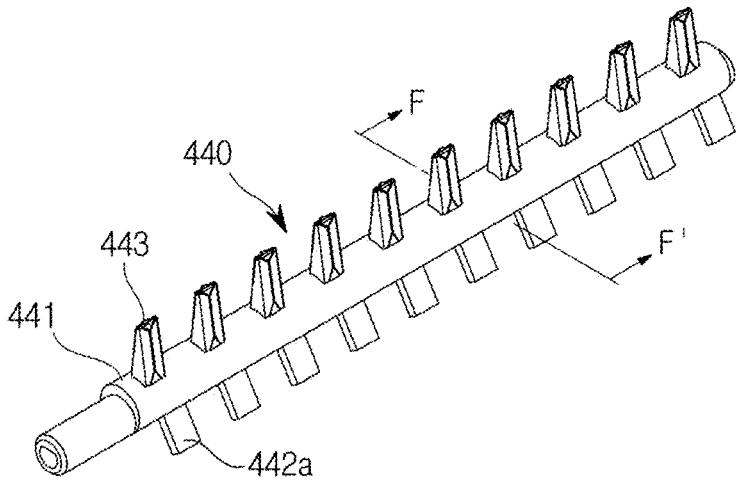
Figure 23B:
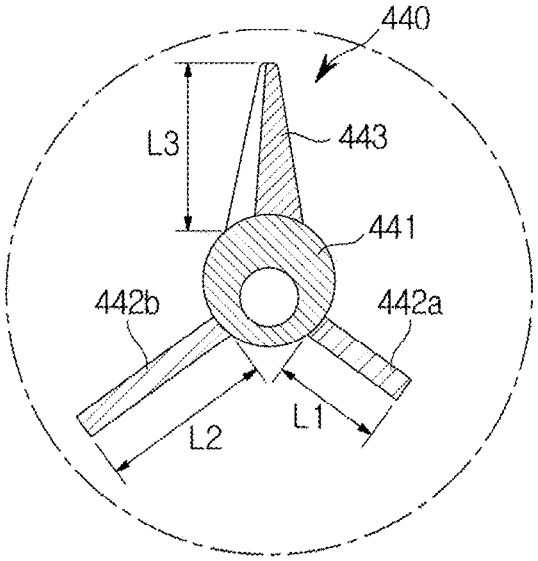

In another example, the ice making device 100 may include a stirrer 440 as shown in FIGS. 23A and 23B.

The stirrer 440 includes a shaft 441, a first stirring member 442*a* formed to protrude from the shaft 441 in a first direction, a second stirring member 442*b* formed to protrude from the shaft 441 in a second direction, and a scooping member 443 formed to protrude from the shaft 441 in a third direction.

The shaft 441 and the scooping member 443 may be identical to the shaft 431 and the scooping member 433 shown in FIGS. 22A and 22B.

Unlike the stirrer 430 shown in FIGS. 22A and 22B including the first and second stirring members 432*a* and 432*b* in the same shape, the stirrer 440 may include the first and second stirring members 442*a* and 442*b* in different shapes. For example, the first stirring member 442*a* may protrude from the shaft 441 as long as first length L1 and the second stirring member 442*b* may protrude from the shaft 441 as long as second length L2, which is larger than the first length L1. Furthermore, the scooping member 443 may protrude from the shaft 441 as long as third length L3, which is larger than the second length L2.

The first and second stirring members 442*a* and 442*b* may each have a plate form, and the horizontal direction of the first stirring member 442*a* and the horizontal direction of the second stirring member 442*b* may correspond to each other, without being limited thereto.

The protruding directions of the first stirring member 442*a*, the second stirring member 442*b*, and the scooping member 443 may be at intervals of 120 degrees, without being limited thereto.

As such, as the first stirring member 442*a*, the second stirring member 442*b*, and the scooping member 443 have different lengths, the first stirring member 442*a*, the second stirring member 442*b*, and the scooping member 443 may stir the water stored in the ice making tray 210, 220 to different depths.

As described above, the ice making device 100 may include various forms of stirrers to stir the water stored in the ice maker 110.

Figure 24:
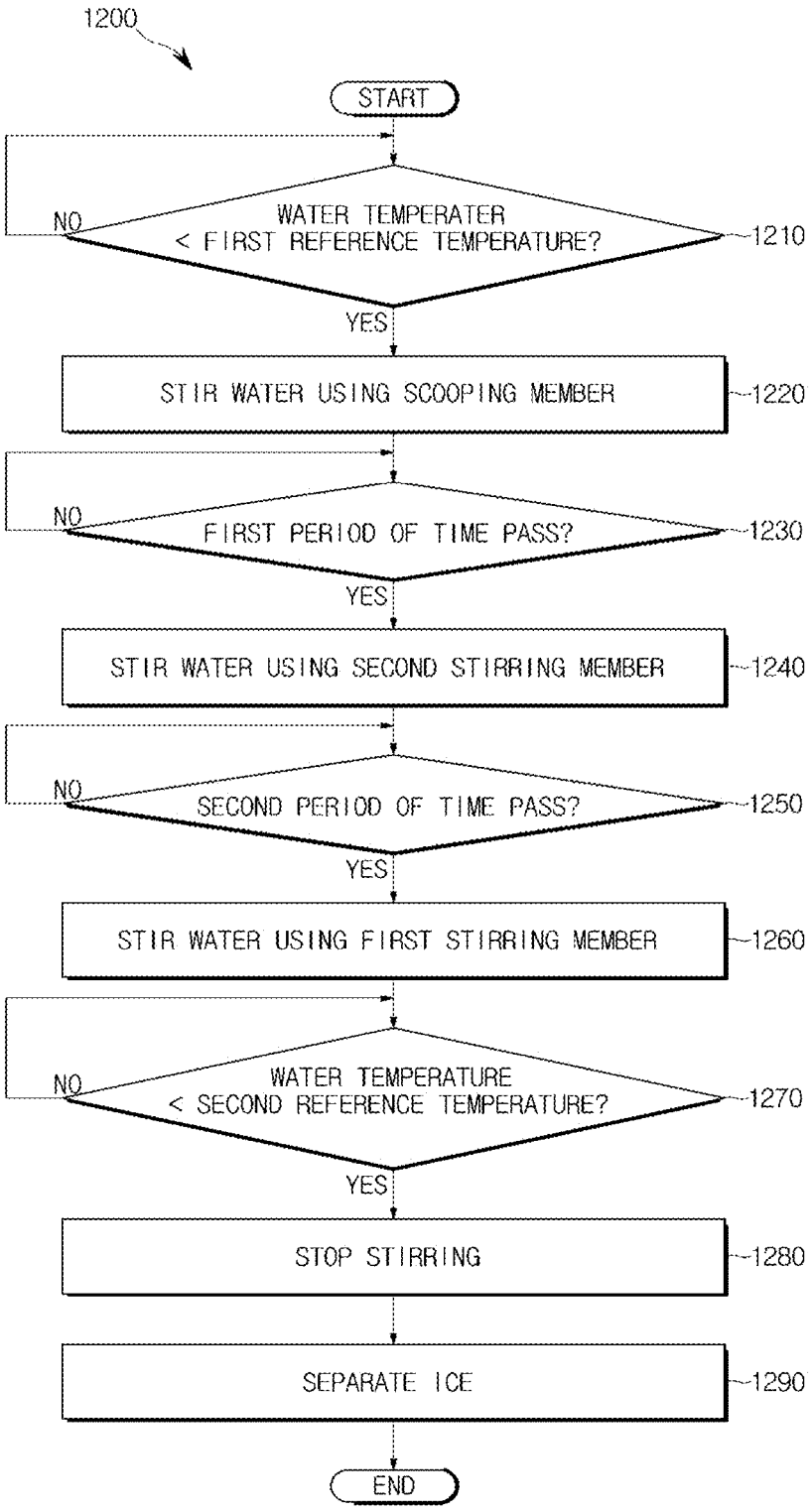
FIG. 24 is a flowchart illustrating an ice making operation of a refrigerator using the stirrer shown in FIG. 23.
Figure 25:
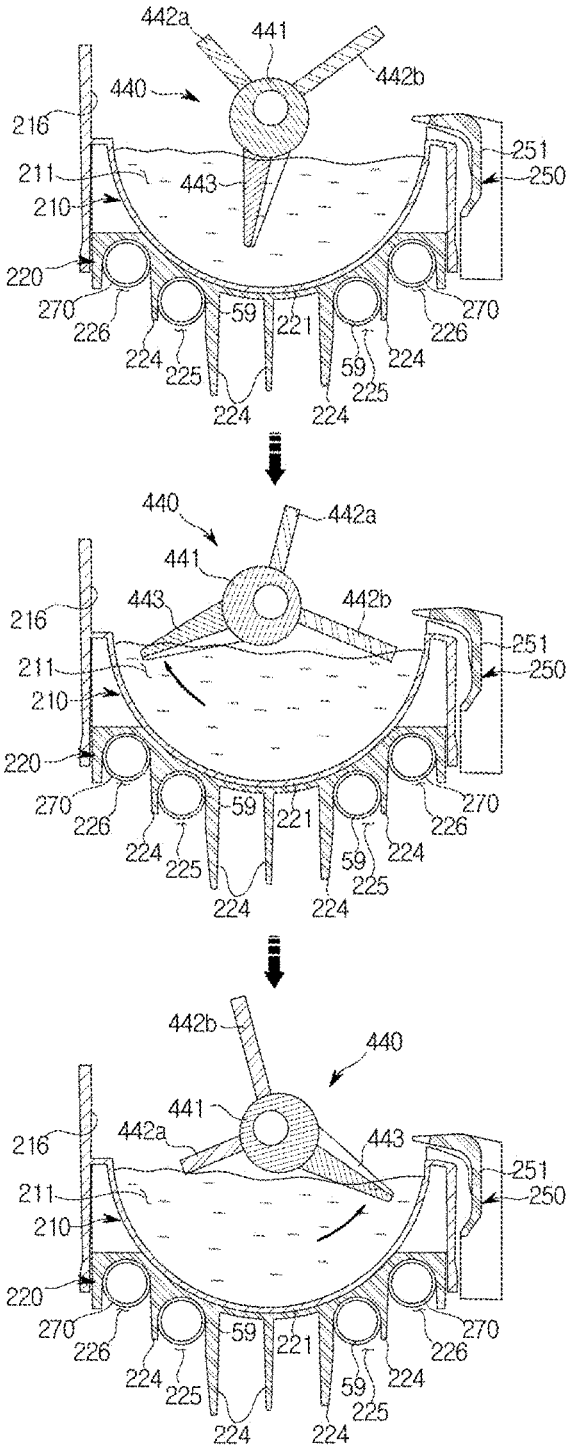
FIGS. 25, 26 and 27 show stirring water according to the ice making operation shown in FIG. 24.
Figure 26:
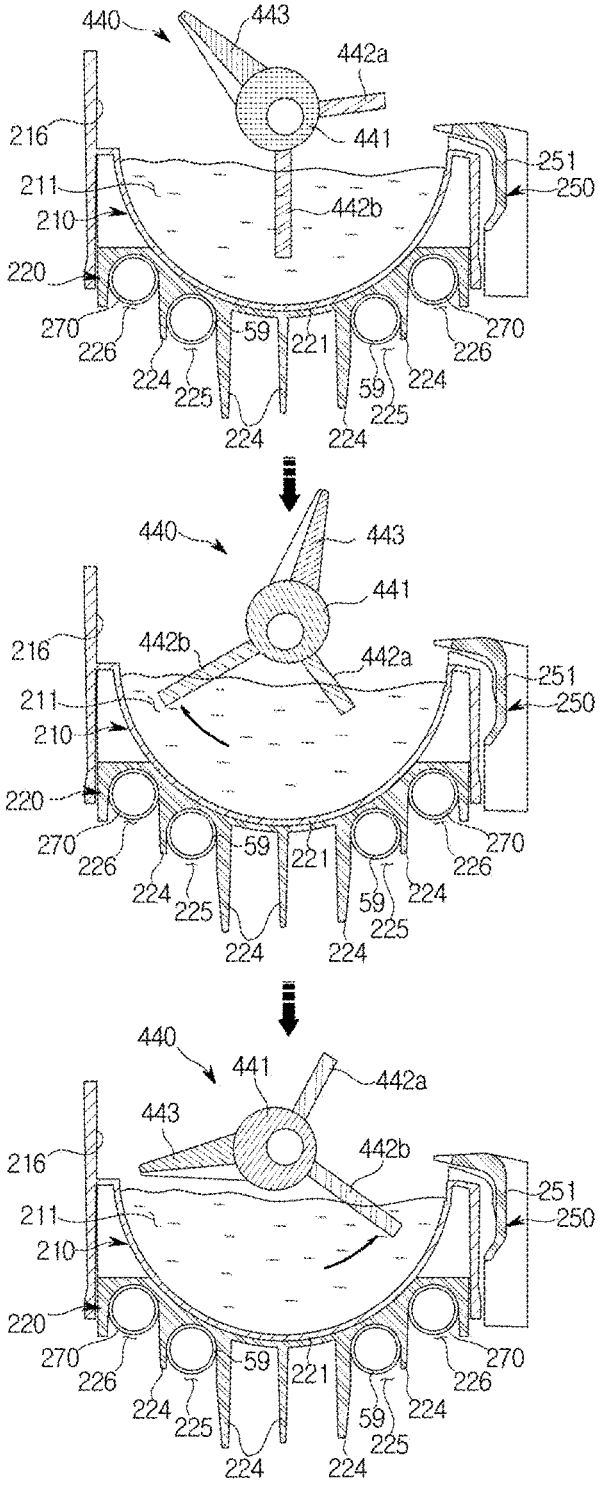
Figure 27:
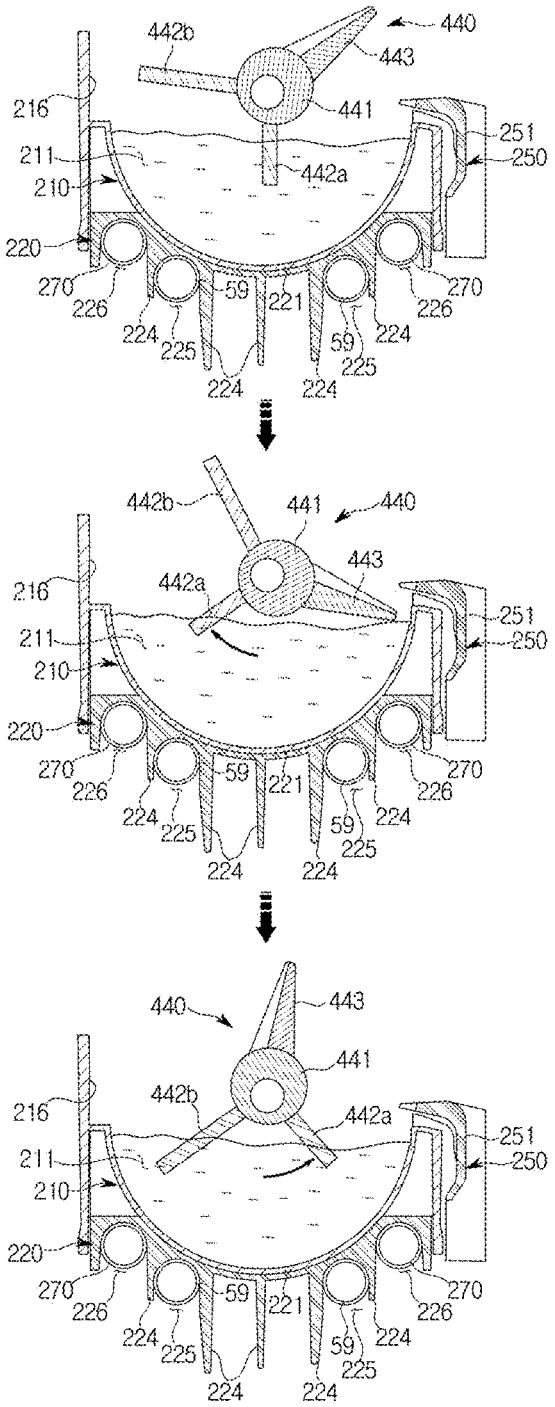

FIG. 24 is a flowchart illustrating an ice making operation of a refrigerator using the stirrer shown in FIG. 23. FIGS. 25, 26 and 27 show stirring water according to the ice making operation shown in FIG. 24.

Ice making operation 1200 of the refrigerator 1 using the stirrer 440 including the first stirring member 442*a*, the second stirring member 442*b*, and the scooping member 443 will now be described in connection with FIGS. 24, 25, 26, and 27.

The refrigerator 1 may supply water to the ice maker 110 and cool the ice maker 110. This operation may be the same as the operations 1010 and 1020 shown in FIG. 13.

While the ice maker 110 is being cooled, the refrigerator 1 determines whether the temperature of water stored in the ice maker 110 is lower than a first reference temperature, in 1210.

The first reference temperature may be set to about +1 to 2 degrees Celsius, and the operation 1210 may be the same as the operation 1030 shown in FIG. 13.

If the temperature of the water stored in the ice maker 110 is lower than the first reference temperature in 1210, the refrigerator 1 may stir the water of the ice maker 110 using the scooping member 443 of the stirrer 440, in 1220.

If the temperature of the water stored in the ice maker 110 is lower than the first reference temperature, it may be determined that the water of the ice maker 110 starts being frozen, and the controller 310 of the refrigerator 1 may have the water stored in the ice maker 110 stirred to eliminate bubbles formed in the water stored in the ice maker 110.

The controller 310 may control the stirring motor 240 for the scooping member 443 to stir water of the ice making tray 210, 220.

As described above, the water in the ice making tray 210, 220 may be frozen from the bottom portion. In other words, the water stored in the ice making tray 210, 220 starts to be frozen from a point far from the stirrer 440.

In the early stage of freezing the water, even if the scooping member 443 with the first length L1 stirs the water, it may not collide with the ice. Accordingly, to stir the water of the ice making tray 210, 220 enough, the controller 310 may control the stirring motor 240 for the scooping member 443 to stir the water.

For example, as shown in FIG. 25, the controller 310 may control the stirring motor 240 to direct the scooping member 443 downward and to swing the stirrer 440 within a predetermined third angle A3. The controller 310 may control the stirring motor 240 to swing the stirrer 440 within 140 degrees.

While the stirrer 440 is swinging within the third angle A3, the scooping member 443 may stir the water by moving back and forth within the third angle A3.

While the scooping member 443 is stirring the water, the refrigerator 1 determines whether a predetermined first period of time elapses, in 1230.

The first period of time may be set based on time taken for the water stored in the ice making tray 210, 220 to be frozen. For example, the first period of time may be a third of time taken for the water stored in the ice making tray 210, 220 to be frozen.

If the first period of time elapses after the scooping member 443 stirs the water in 1130, the refrigerator 1 may stir the water of the ice maker 110 using the second stirring member 442*b* of the stirrer 440, in 1240.

The controller 310 of the refrigerator 1 may control the stirring motor 240 for the scooping member 443 to stir the water for the first period of time, and after the lapse of the first period of time, the controller 310 may control the stirring motor 240 for the second stirring member 442*b* of the stirrer 440 to stir the water.

Since the water stored in the ice making tray 210, 220 is frozen from the bottom portion, the height of ice may increase as the freezing of water proceeds. Accordingly, to avoid collision between the scooping member 443 and the ice, the controller 310 may control the stirring motor 240 for the second stirring member 442*b* with the second length L2, which is shorter than the scooping member 443, to stir the water.

For example, as shown in FIG. 26, the controller 310 may control the stirring motor 240 to direct the second stirring member 442*b* downward and to swing the stirrer 440 within a predetermined second angle A2. The second angle A2 may be smaller than the third angle A3 of FIG. 25. The controller 310 may control the stirring motor 240 to swing the stirrer 440 within 120 degrees.

While the stirrer 440 is swinging within the second angle A2, the second stirring member 442*b* may stir the water by moving back and forth within the second angle A2. Since the second stirring member 442*b* is shorter than the scooping member 443, the second stirring member 442*b* may stir the water enough within the second angle A2.

While the second stirring member 442*b* is stirring the water, the refrigerator 1 determines whether a predetermined second period of time elapses, in 1250.

The second period of time may be set based on time taken for the water stored in the ice making tray 210, 220 to be frozen, and may or may not be the same as the first period of time. For example, the second period of time may be a third of time taken for the water stored in the ice making tray 210, 220 to be frozen.

If the second period of time elapses after the second stirring member 442*b* stirs the water in 1250, the refrigerator 1 may stir the water of the ice maker 110 using the first stirring member 442*a* of the stirrer 440, in 1260.

The controller 310 of the refrigerator 1 may control the stirring motor 240 for the second stirring member 442*b* to stir the water for the second period of time, and after the lapse of the second period of time, the controller 310 may control the stirring motor 240 for the first stirring member 442*b* of the stirrer 440 to stir the water.

As the freezing of water proceeds, the height of ice may increase. Accordingly, to avoid collision between the second stirring member 442*b* and the ice, the controller 310 may control the stirring motor 240 for the first stirring member 442*a* with the first length L1, which is shorter than the second stirring member 442*b*, to stir the water.

For example, as shown in FIG. 27, the controller 310 may control the stirring motor 240 to direct the first stirring member 442*a* downward and to swing the stirrer 440 within a predetermined first angle A1. The first angle A1 may be smaller than the second angle A2 of FIG. 26. The controller 310 may control the stirring motor 240 to swing the stirrer 440 within 100 degrees.

While the stirrer 440 is swinging within the first angle A1, the first stirring member 442*a* may stir the water by moving back and forth within the first angle A1. Since the first stirring member 442*a* is shorter than the second stirring member 442*b*, the first stirring member 442*a* may stir the water enough within the first angle A1.

While the stirrer 440 is swinging, the refrigerator 1 determines whether the temperature of water or ice in the ice maker 110 is lower than a second reference temperature, in 1270.

The second reference temperature may be set to about −1 to −2 degrees Celsius, and the operation 1170 may be the same as the operation 1060 shown in FIG. 13.

If the temperature of the water stored in the ice maker 110 is lower than the second reference temperature in 1270, the refrigerator 1 may stop stirring the water stored in the ice maker 110, in 1280.

Operation 1280 may be the same as operation 1180 of FIG. 18.

Subsequently, the refrigerator 1 separates the ice from the ice maker 110, in 1290.

Operation 1290 may be the same as operation 1190 of FIG. 18.

As described above, as the freezing proceeds, the refrigerator 1 may stir the water using protruding members in order of decreasing length (e.g., the scooping member followed by the second stirring member and the first stirring member). As the freezing proceeds, the height of ice from the bottom of the ice making tray 210, 220 increases, and the ice and the protruding member are likely to collide with each other. To prevent collision between the protruding member and the ice, the controller 310 may control the stirring motor 240 to use the protruding members in order of decreasing length to stir the water as the freezing proceeds.

FIGS. 28, 29, 30, 31, 32 and 33 show replacements for the ice-making tray shown in FIG. 11.

The ice making tray 210, 220 included in the ice making device 100 is shown in FIG. 11. The ice making tray 210, 220 shown in FIG. 11 includes the first ice making tray 210 with ice making cells 211 formed therein and the second ice making tray 220 contacting the ice-maker refrigerant tube 59, and heat conductivity of the first ice making tray 210 is lower than the heat conductivity of the second ice making tray 220.

However, the form of the ice making tray 210, 220 is not limited to what is shown in FIG. 11, and the ice making tray 210, 220 may have various forms.

Figure 28:
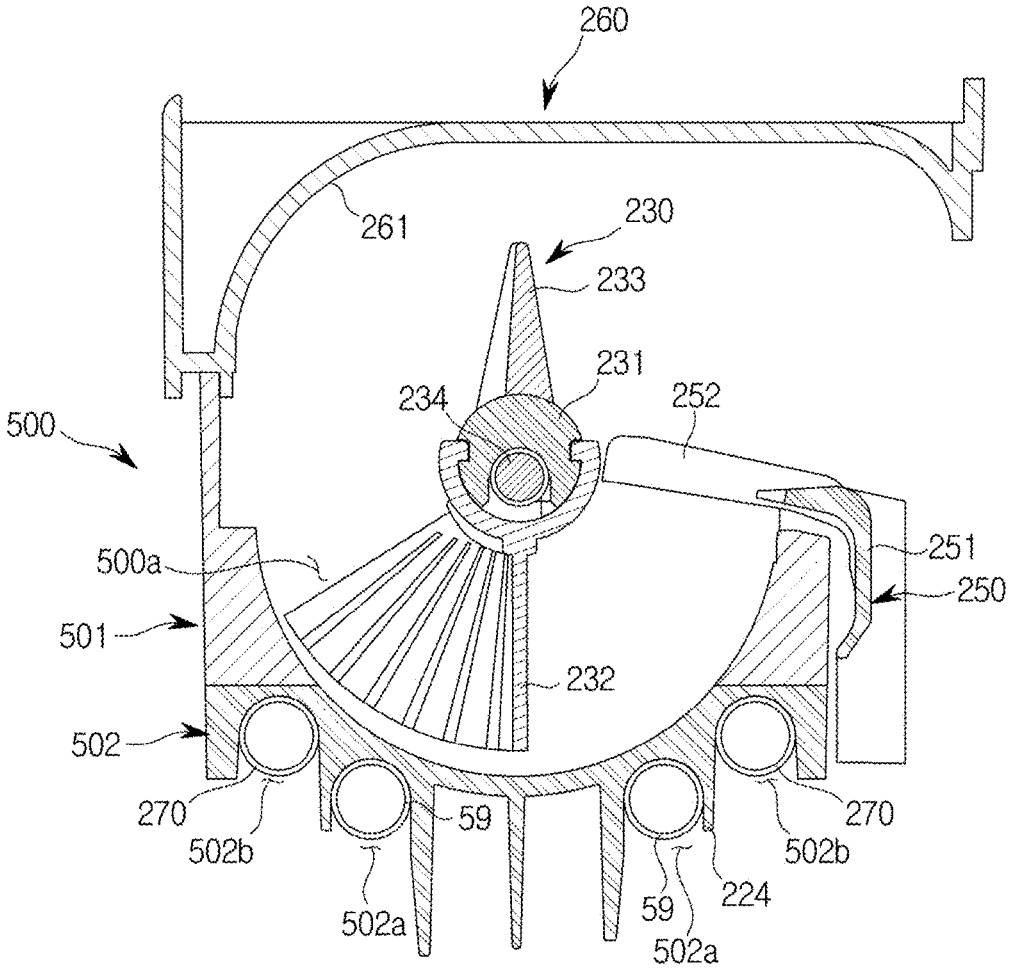
FIGS. 28, 29, 30, 31, 32 and 33 show replacements for the ice making tray shown in FIG. 11.

For example, the ice making device 100 may include an ice making tray 500 as shown in FIG. 28.

The ice making tray 500 may form an ice making cell 500*a* for storing water to be used in making ice. The water stored in the ice making cell 500*a* may be frozen into ice.

The ice making tray 500 may include a first ice making tray 501 forming a side wall of the ice making cell 500*a* and a second ice making tray 502 forming the bottom of the ice making cell 500*a*. In other words, the first and second ice making trays 501 and 502 constitute the ice making cell 500*a*.

The second ice making tray 502 is coupled to the bottom of the first ice making tray 501, and a refrigerant tube container 502*a* for containing the ice-maker refrigerant tube 59 and a heater container 502*b* for containing the ice-separation heater 270 are formed underneath the second ice making tray 502. The second ice making tray 502 may come into direct contact with the ice-maker refrigerant tube 59 and may be made of a high heat-conductive metal such as aluminum.

The first ice making tray 501 is coupled to the top of the second ice making tray 502. The first ice making tray 501 may be made of a material with lower heat conductivity than the second ice making tray 502, such as a synthetic resin.

As such, the second ice making tray 502 forming the lower portion of the ice making cell 500*a* may be made of a high heat-conductive material, and the first ice making tray 501 forming the upper portion of the ice making cell 500*a* may be made of a low heat-conductive material. Accordingly, the lower portion of the water contained in the ice making cell 500*a* is frozen fast while the upper portion of the water is frozen relatively slowly, and the lower portion of the water contained in the ice making cell 500*a* may be frozen earlier than the upper portion of the water. In other words, the water contained in the ice making cell 500*a* may be frozen from the bottom portion.

Figure 29:
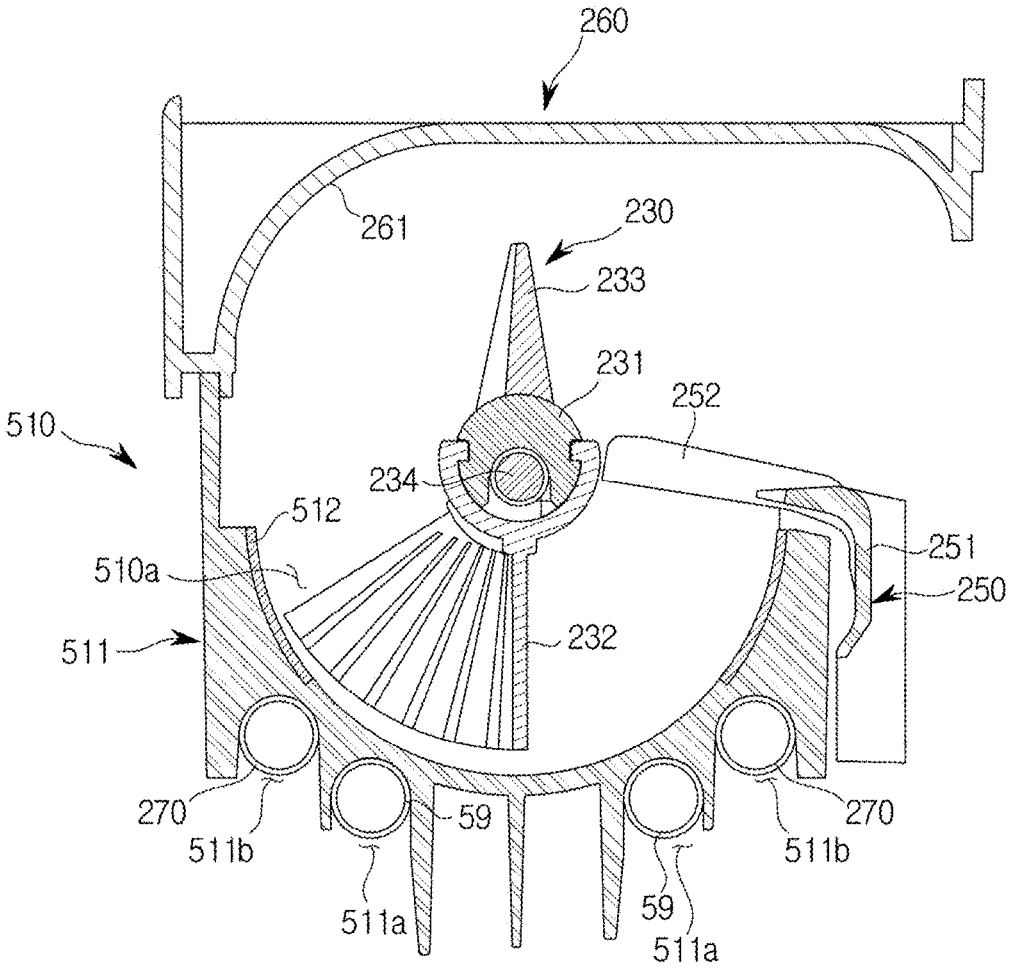

In another example, the ice making device 100 may include an ice making tray 510 as shown in FIG. 29.

The ice making tray 510 may form an ice making cell 510*a* for storing water to be used in making ice.

The ice making tray 510 may include a first ice making tray 511 forming an ice making cell 510*a*, and a heat-insulation film 512 attached onto the top of the first ice making tray 511.

A refrigerant tube container 511*a* for containing the ice-maker refrigerant tube 59 and a heater container 511*b* for containing the ice-separation heater 270 are formed under the first ice making tray 511. The first ice making tray 511 may come into direct contact with the ice-maker refrigerant tube 59 and may be made of a metal such as aluminum that has high heat conductivity.

The heat-insulation film 512 may be attached onto the inner side of the top of the first ice making tray 511. In other words, the upper portion of the water stored in the ice making tray 510 contacts the heat-insulation film 512 and does not contact the first ice making tray 511. Furthermore, the heat-insulation film 512 may be made of a low heat-conductive material, such as a synthetic resin, to disturb heat transfer from the water to the first ice making tray 511. In other words, the heat-insulation film 512 may disturb freezing of the water by the first ice making tray 511.

As such, the first ice making tray 511 forming the ice making cell 510*a* may be made of a high heat-conductive material, and the heat-insulation film 512 attached onto the top of the ice making cell 510*a* may be made of a low heat-conductive material. Accordingly, the lower portion of the water contained in the ice making cell 510*a* is frozen fast while the upper portion of the water is frozen relatively slowly, and the lower portion of the water contained in the ice making cell 510*a* may be frozen earlier than the upper portion of the water.

Figure 30:
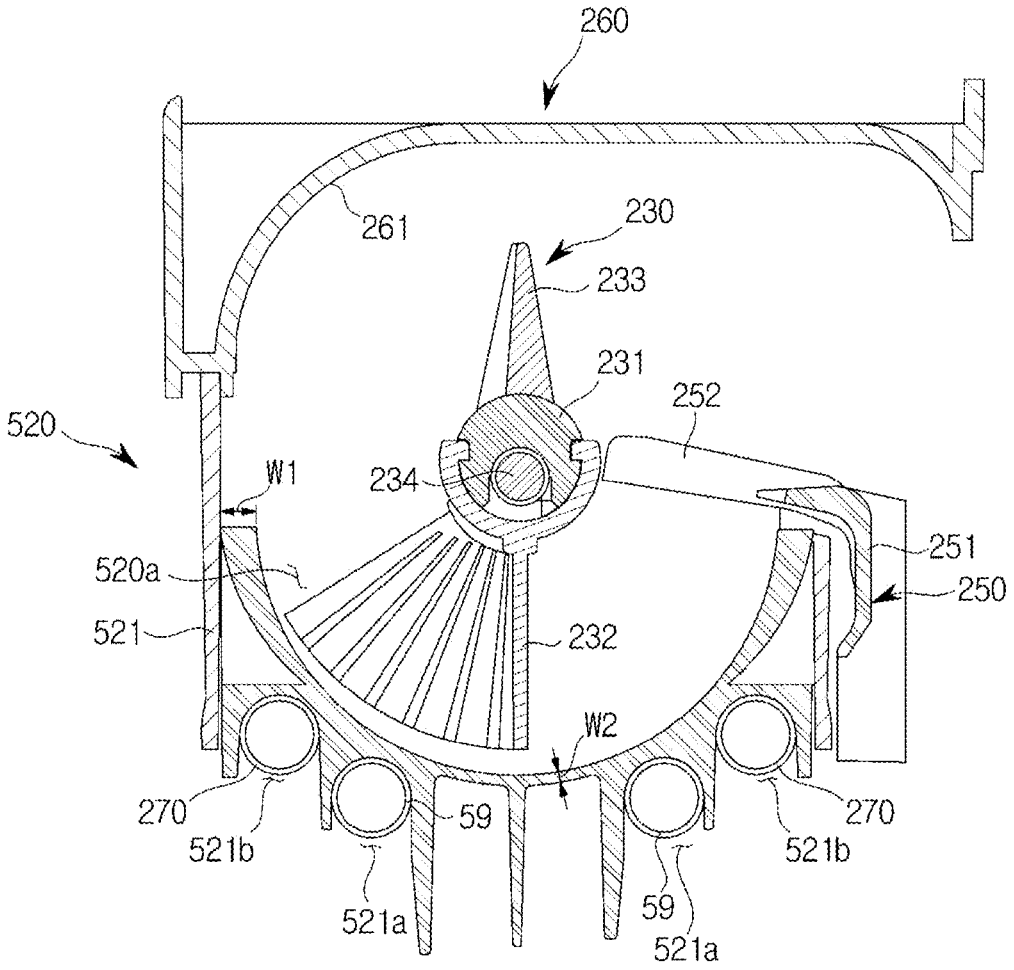

In another example, the ice making device 100 may include an ice making tray 520 as shown in FIG. 30.

The ice making tray 520 may be integrally formed, and may form an ice making cell 520*a* for storing water to be used in making ice.

The thickness W1, W2 of the ice making tray 520 gets thinner from top to bottom. For example, the top of the ice making tray 520 has thickness W1 larger than the thickness W2 of the bottom of the ice making tray 520.

Furthermore, a refrigerant tube container 521*a* for containing the ice-maker refrigerant tube 59 and a heater container 521*b* for containing the ice-separation heater 270 are formed under the ice making tray 521. The ice making tray 511 may come into direct contact with the ice-maker refrigerant tube 59 and may be cooled by the ice-maker refrigerant tube 59.

With this structure, the ice making tray 521 contacts the ice-maker refrigerant tube 59 at its bottom portion, and the thickness W2 of the bottom portion is less than the thickness W1 of the top portion. Accordingly, the lower portion of the water contained in the ice making cell 520*a* is frozen fast while the upper portion of the water is frozen relatively slowly, and the lower portion of the water contained in the ice making cell 520*a* may be frozen earlier than the upper portion of the water.

Figure 31:
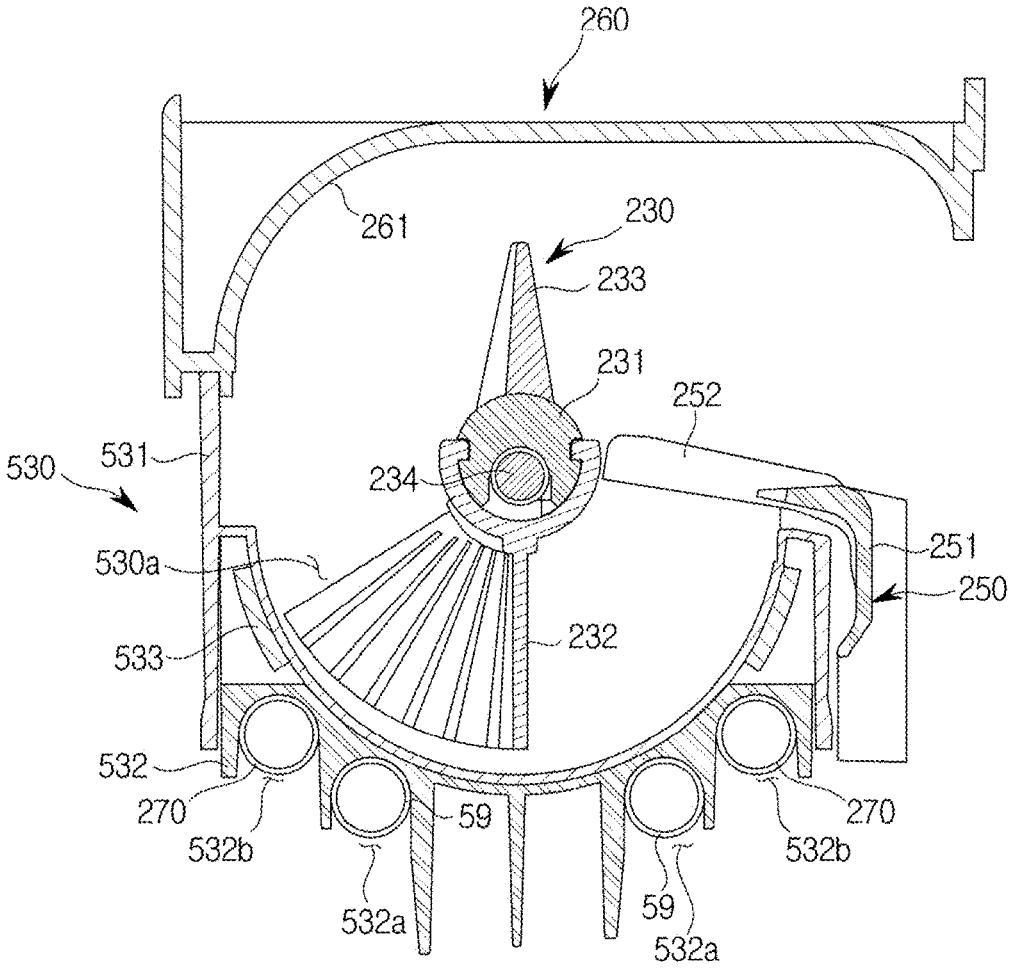

In another example, the ice making device 100 may include an ice making tray 530 as shown in FIG. 31.

The ice making tray 530 may form an ice making cell 530*a* for storing water to be used in making ice.

The ice making tray 530 includes a first ice making tray 531 forming the ice making cell 530*a*, a second ice making tray 532 contacting the ice-maker refrigerant tube 59, and a film heater 533 for heating an upper portion of the first ice making tray 531.

The second ice making tray 532 contacts the bottom of the first ice making tray 531, and a refrigerant tube container 532*a* for containing the ice-maker refrigerant tube 59 and a heater container 532*b* for containing the ice-separation heater 270 are formed underneath the second ice making tray 532. The second ice making tray 532 may come into direct contact with the ice-maker refrigerant tube 59 and may be made of a high heat-conductive metal such as aluminum.

The first ice making tray 531 contacts the second ice making tray 532 at its bottom, and the ice making cell 530*a* for storing water is formed inside the first ice making tray 531. The first ice making tray 531 may be made of a material with lower heat conductivity than the second ice making tray 532, such as a synthetic resin.

The film heater 533 may be attached onto the outer side of the top of the first ice making tray 531 and may heat an upper portion of the first ice making tray 531. The upper portion of the first ice making tray 531 may be frozen more slowly than a lower portion of the first ice making tray 531 because it is heated by the film heater 533.

In this way, a lower portion of the first ice making tray 531 may be cooled by the second ice making tray 532, and an upper portion of the first ice making tray 531 may be heated by the film heater 533. Accordingly, the lower portion of the water contained in the ice making cell 530*a* is frozen fast while the upper portion of the water is frozen relatively slowly, and the lower portion of the water contained in the ice making cell 530*a* may be frozen earlier than the upper portion of the water.

Figure 32:
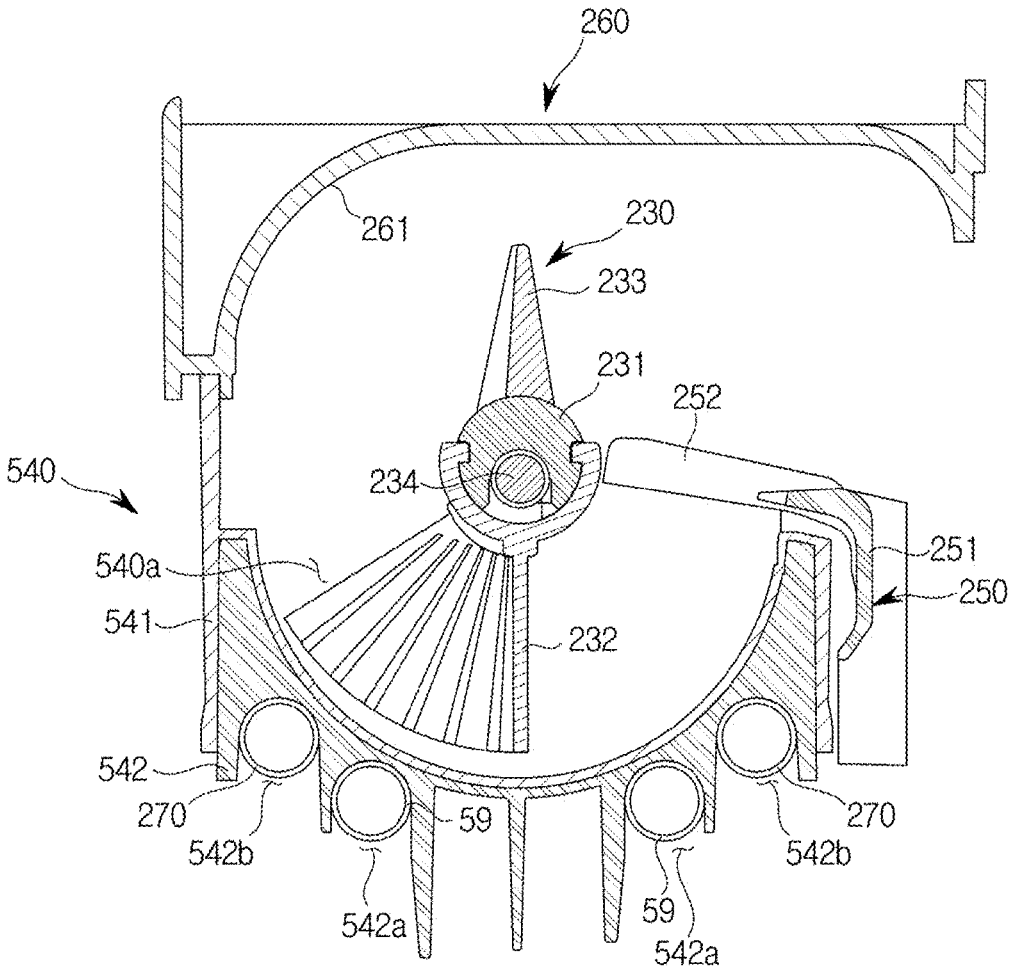

In another example, the ice making device 100 may include an ice making tray 540 as shown in FIG. 32.

The ice making tray 540 may form an ice making cell 540*a* for storing water to be used in making ice.

The ice making tray 540 may include a first ice making tray 541 forming the ice making cell 540*a* and a second ice making tray 542 contacting the ice-maker refrigerant tube 59.

The second ice making tray 542 comes into contact with the entire lower portion of the first ice making tray 541 from the bottom to the side walls of the first ice making tray 541. Furthermore, a refrigerant tube container 542*a* for containing the ice-maker refrigerant tube 59 and a heater container 542*b* for containing the ice-separation heater 270 are formed under the second ice making tray 542. The second ice making tray 542 may come into direct contact with the ice-maker refrigerant tube 59 and may be made of a high heat-conductive metal such as aluminum.

The first ice making tray 541 contacts the second ice making tray 542 at its bottom, and the ice making cell 540*a* for storing water is formed inside the first ice making tray 541. The first ice making tray 541 may be made of a material with lower heat conductivity than the second ice making tray 542, such as a synthetic resin.

While ice is being formed, the refrigerant passes the ice-maker refrigerant tube 59 and the ice-maker refrigerant tube 59 may cool the second ice making tray 542.

Furthermore, while ice is being formed, the ice-separation heater 270 may be activated. The ice-separation heater 270 is intended to separate ice from the ice making tray 540 after the ice is made, but it may also be used to heat an upper portion of the ice making tray 540 while ice is being formed. For example, the ice-separation heater 270 may give off a smaller amount of heat while ice is being formed than for ice separation, and make an upper portion of the ice making tray 540 cooled more slowly than the lower portion of the ice making tray 540 while ice is being formed.

As the ice-separation heater 270 heats an upper portion of the ice making tray 540 while ice is being made, the upper portion of the ice making tray 540 may be cooled more slowly than the lower portion. Accordingly, the lower portion of the water contained in the ice making cell 540*a* is frozen fast while the upper portion of the water is frozen relatively slowly, and the lower portion of the water contained in the ice making cell 540*a* may be frozen earlier than the upper portion of the water.

Figure 33:
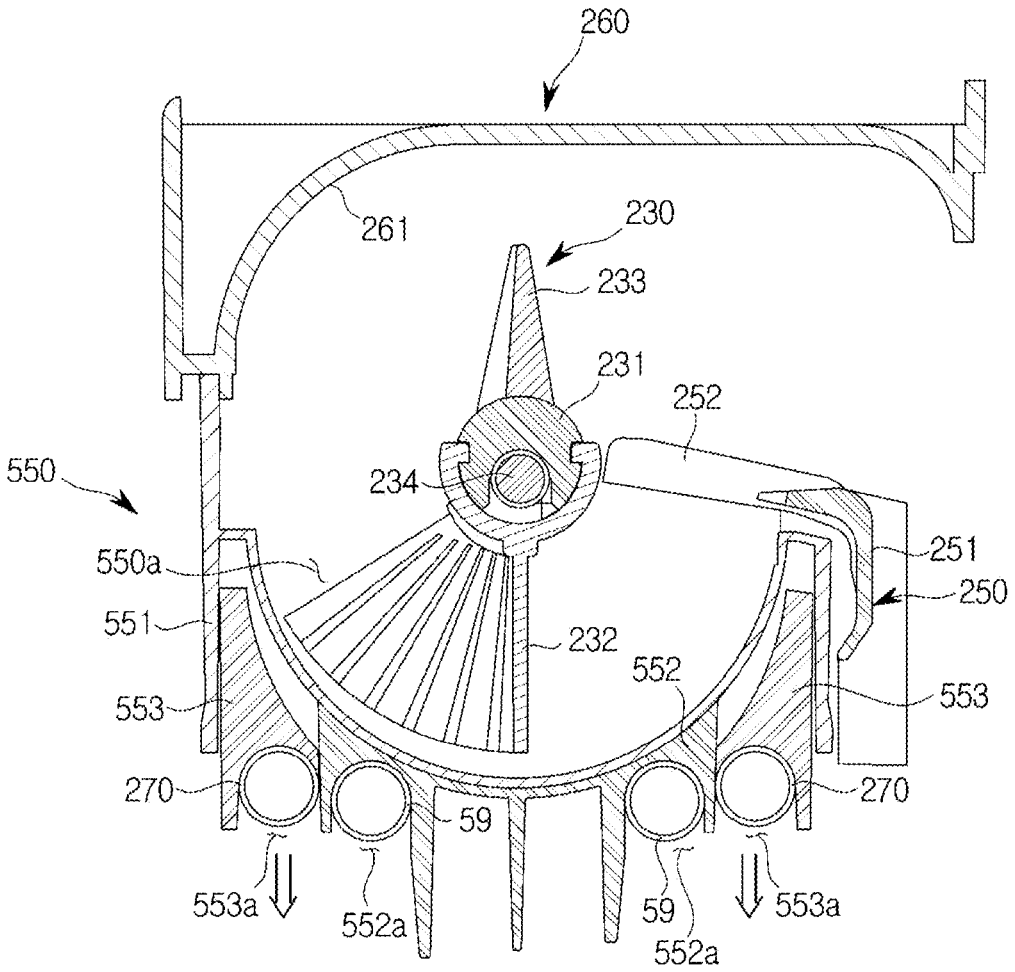

In another example, the ice making device 100 may include an ice making tray 550 as shown in FIG. 33.

The ice making tray 550 may form an ice making cell 550*a* for storing water to be used in making ice.

The ice making tray 550 includes a first ice making tray 551 forming the ice making cell 550*a*, a second ice making tray 552 contacting the ice-maker refrigerant tube 59, and a third ice making tray 553 contacting the ice-separation heater 270.

The second ice making tray 552 contacts the bottom portion of the first ice making tray 551. A refrigerant tube container 552*a* for containing the ice-maker refrigerant tube 59 is formed underneath the second ice making tray 552, and the second ice making tray 542 may come into contact with the ice-maker refrigerant tube 59 and may be made of a high heat-conductive metal such as aluminum.

The third ice making tray 553 contacts a side wall of the first ice making tray 551 that forms the ice making cell 550*a*. A heater container 553*a* for containing the ice-separation heater 270 is formed underneath the third ice making tray 553, and the third ice making tray 553 may come into contact with the ice-separation heater 270 and may be made of a high heat-conductive metal such as aluminum.

The first ice making tray 551 contacts the second ice making tray 552 at its bottom, and contacts the third ice making tray 553 at the outer surface of its side. The first ice making tray 551 may be made of a material with lower heat conductivity than the second and third ice making trays 552, 553, such as a synthetic resin.

While ice is being formed, the third ice making tray 553 may be separated from the first ice making tray 551. For example, the third ice making tray 553 may be moved downward while ice is being formed. As a result, while ice is being formed, a lower portion of the first ice making tray 551 may be cooled by the second ice making tray 552, and an upper portion of the first ice making tray 551 may be cooled by heat transfer from the lower portion.

During the ice separation, the third ice making tray 553 may come into contact with the first ice making tray 551. For example, the third ice making tray 553 may be moved upward during the ice separation. As a result, during the ice separation, the first ice making tray 551 may be heated by the third ice making tray 553.

In this way, while ice is being formed, as the third ice making tray 553 is separated from the first ice making tray 551, an upper portion of the ice making tray 550 may be cooled more slowly than the lower portion. Accordingly, the lower portion of the water contained in the ice making cell 550*a* is frozen fast while the upper portion of the water is frozen relatively slowly, and the lower portion of the water contained in the ice making cell 550*a* may be frozen earlier than the upper portion of the water.

As described above, the ice making device 100 may include various forms of ice making trays in order to freeze the water stored in the ice maker 110 from bottom to top.

Figure 34:
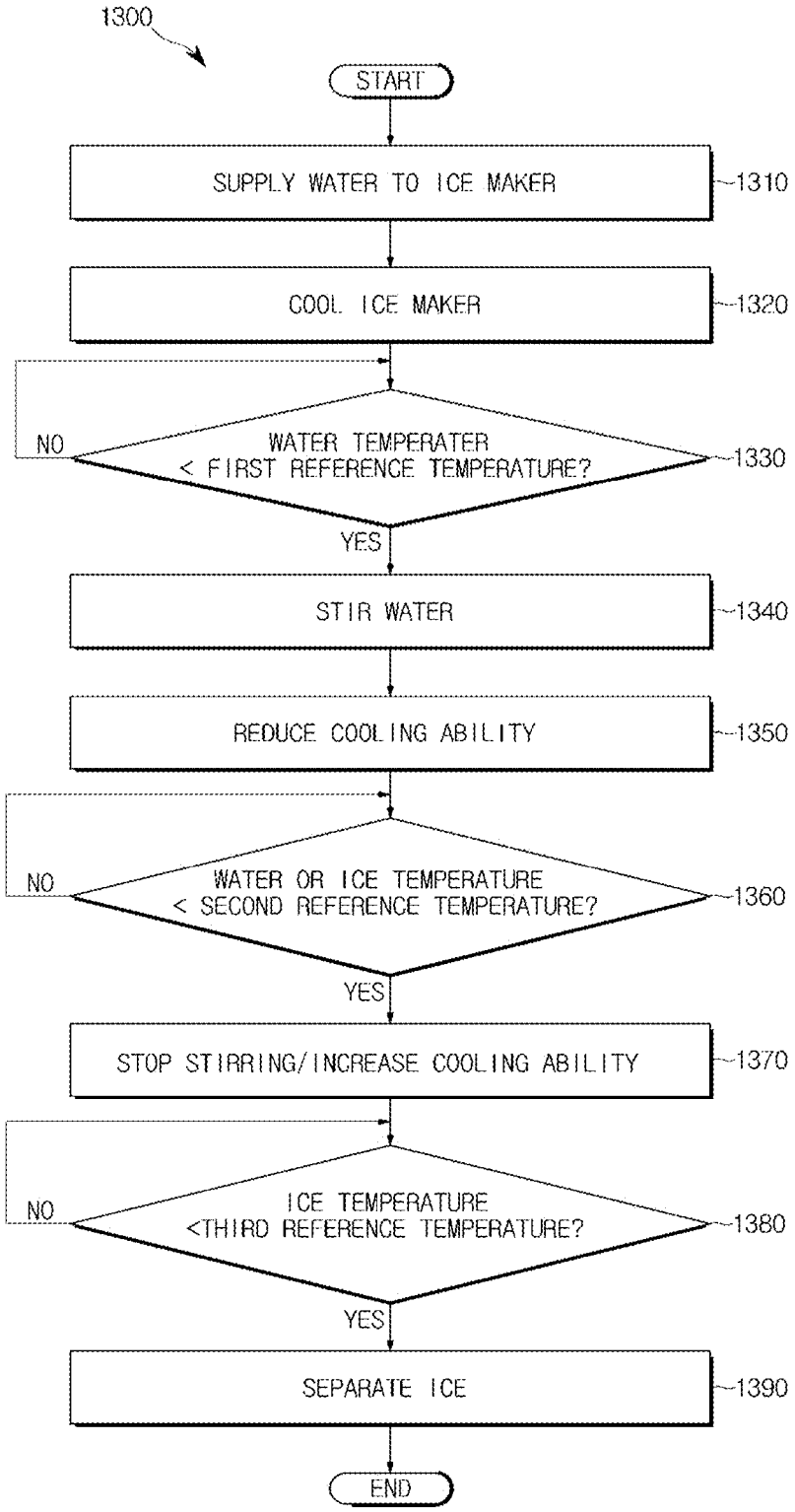
FIG. 34 is a flowchart illustrating ice making operation of a refrigerator, according to another embodiment.
Figure 35:
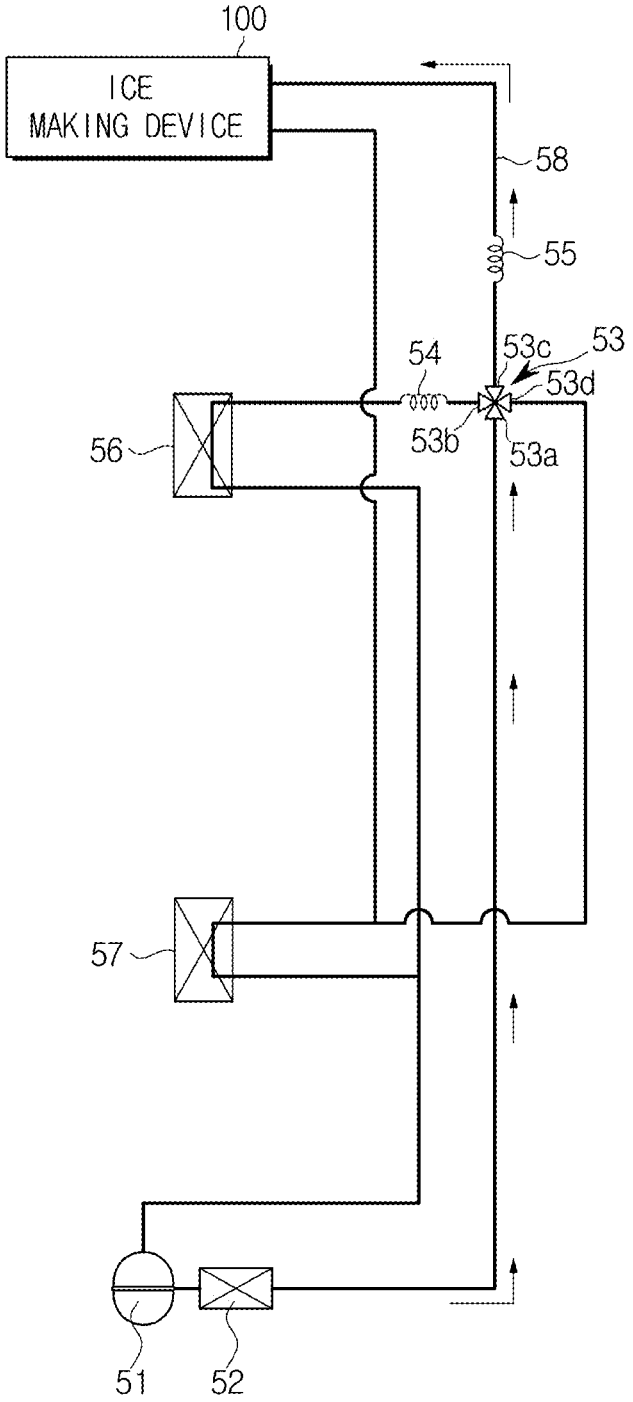
FIGS. 35 and 36 show how a refrigerator controls its ice making ability, according to an embodiment.
Figure 36:
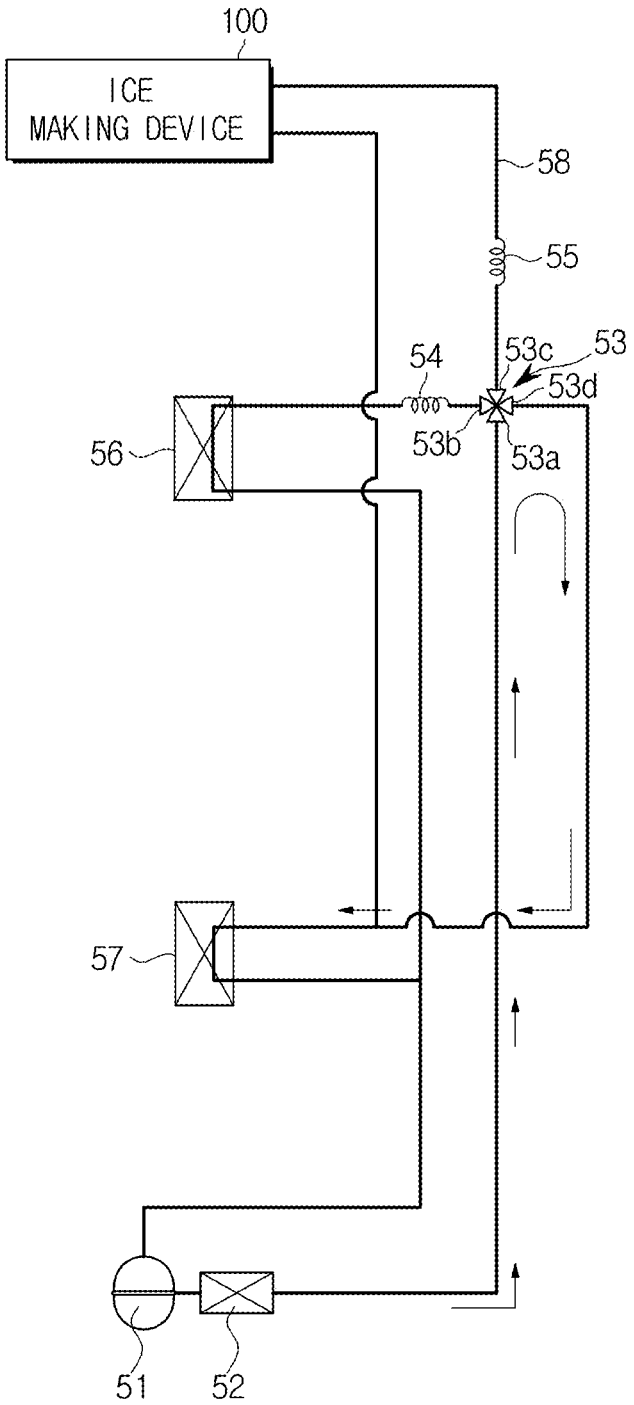
Figure 37:
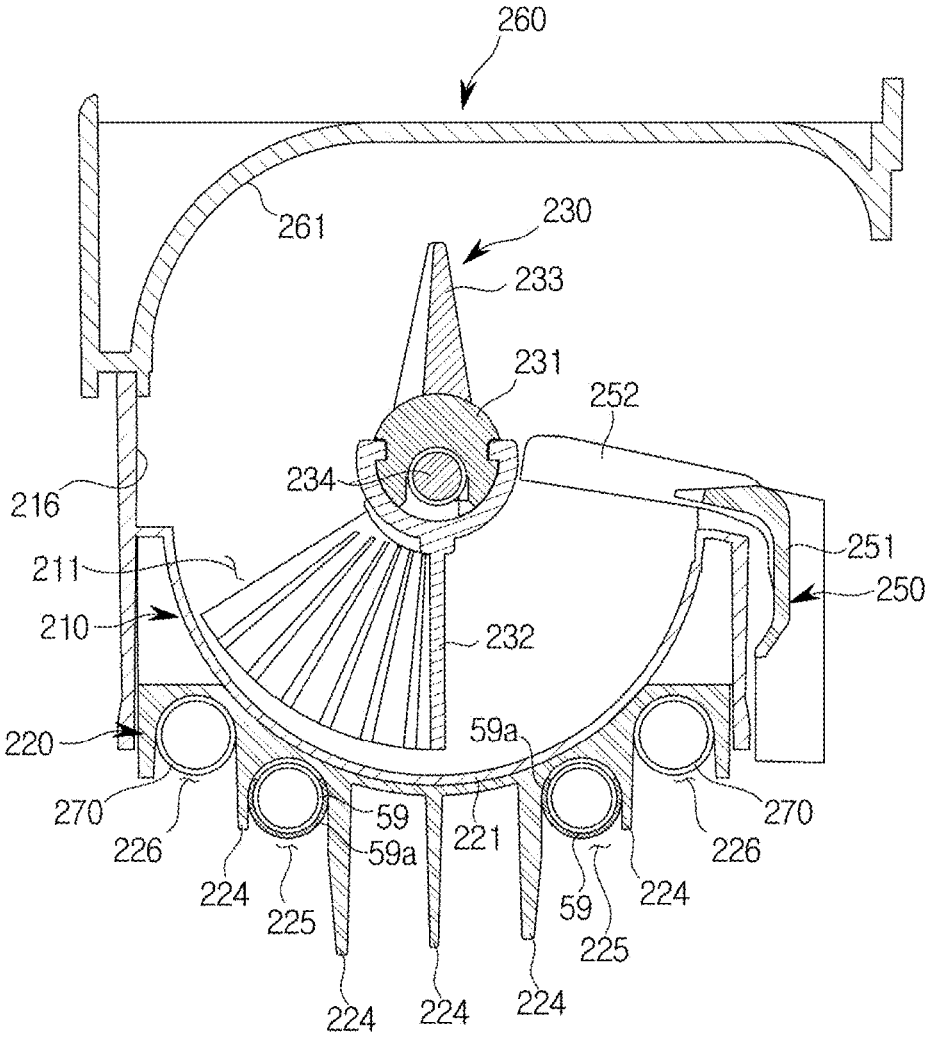
FIGS. 37 and 38 show how a refrigerator controls its ice making ability, according to another embodiment.
Figure 38:
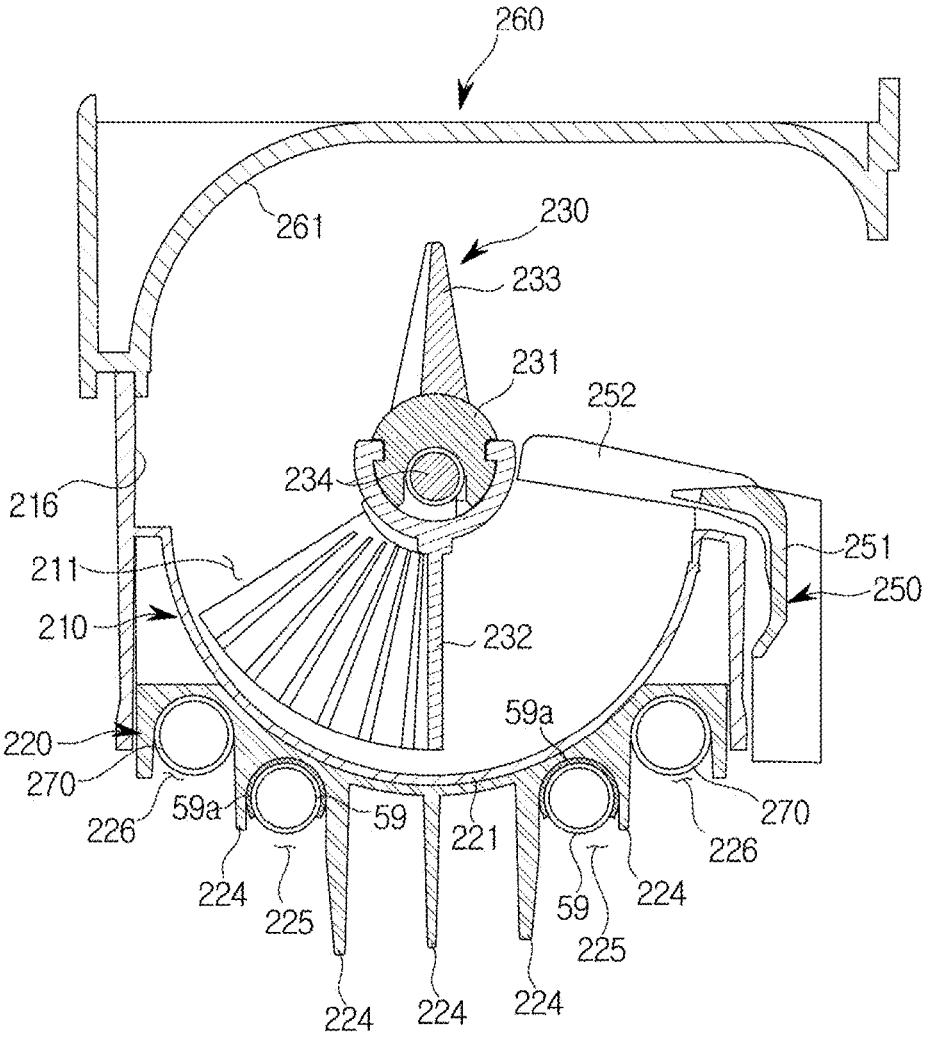

FIG. 34 is a flowchart illustrating ice making operation of a refrigerator, according to another embodiment. FIGS. 35 and 36 show how a refrigerator controls its ice-making ability, according to an embodiment. FIGS. 37 and 38 show how a refrigerator controls its ice-making ability, according to another embodiment.

As shown in FIG. 14, making ice includes steps of cooling water, phase-changing from water to ice, and freezing water into ice. Among the steps, the phase-changing from water to ice is related to making transparent ice. While water is phase-changed into ice, bubbles may be formed by supersaturated air in the border between water and ice, making the ice opaque.

Accordingly, the refrigerator 1 may slowly proceed the step of phase-changing from water to ice to make transparent ice, and rapidly proceed the step of cooling water and freezing water into ice to make ice quickly.

Ice making operation 1300 of the refrigerator 1 will be described in connection with FIGS. 34, 35, 36, 37, and 38.

The refrigerator 1 supplies water to the ice maker 110, in 1310.

The refrigerator 1 cools the ice maker 110, in 1320.

While the ice maker 110 is being cooled, the refrigerator 1 determines whether the temperature of water stored in the ice maker 110 is lower than a first reference temperature, in 1330.

If the temperature of the water stored in the ice maker 110 is lower than the first reference temperature in 1330, the refrigerator 1 may stir the water of the ice maker 110, in 1340.

Operations 1310, 1320, and 1340 may be the same as the operations 1010, 1020, 1030, and 1040 shown in FIG. 13.

The refrigerator 1 reduces cooling ability of the ice maker 110, in 1350.

During the phase change from water into ice, the refrigerator 1 may gradually cool the ice maker 110. During the phase change, the refrigerator 1 may reduce an amount of the refrigerant to be supplied to the ice-maker refrigerant tube 59 or reduce an extent of heat exchange between the ice-maker refrigerant tube 59 and the ice making tray 210, 220.

For example, the refrigerator 1 may include a refrigerant circulation path as shown in FIGS. 35 and 36. The refrigerator 1 may include the compressor 51, the condenser 52, the switching valve 53, the expander 54, 55, and the evaporator 56, 57. The compressor 51, the condenser 52, the switching valve 53, the expander 54, 55, and the evaporator 56, 57 may be connected by the refrigerant tube 58, and the ice-maker refrigerant tube 59 may be arranged in the ice making device 100 to cool the ice maker 110.

The switching valve 53 may employ a 4-way valve, including an inflow port 53*a* through which the refrigerant flows in from the condenser 52, a first outflow port 53*b* through which the refrigerant flows out to the first evaporator 56, a second outflow port 53*c* through which the refrigerant flows out to the ice making device 100 and the second evaporator 57, and a third outflow port 53*d* through which the refrigerant flows out to the second evaporator 57.

In the step of cooling water, the controller 310 of the refrigerator 1 may control the switching valve 53 such that the refrigerant flows out through the second outflow port 53*c*. Specifically, the controller 310 may control the switching valve 53 to open the second outflow port 53*c* and close the third outflow port 53*d*.

As a result, the refrigerant may be supplied to the ice making device 100 and the second evaporator 57 in sequence, as shown in FIG. 35.

In the step of phase-changing, the controller 310 may control the switching valve 53 such that the second outflow port 53*c* and the third outflow port 53*d* alternately allow the refrigerant to flow out. In other words, the controller 310 may control the switching valve 53 to alternately open or close the second outflow port 53*c* and the third outflow port 53*d*. When the second outflow port 53*c* is closed and the third outflow port 53*d* is opened, the refrigerant may be supplied only to the second evaporator 57, as shown in FIG. 36.

As a result, an amount of the refrigerant supplied to the second evaporator increases while an amount of the refrigerant supplied to the ice making device 100 decreases. That is, cooling ability of the ice maker 110 may be reduced.

In another example, as shown in FIGS. 37 and 38, the ice-maker refrigerant tube 59 may include a heat-insulation cover 59*a*.

The heat-insulation cover 59*a* may cover a portion of the ice-maker refrigerant tube 59 in the circumferential direction. Some of the ice-maker refrigerant tube 59 is exposed to the outside in the circumferential direction and some other is covered by the heat-insulation cover 59*a*.

In the step of cooling water, the controller 310 may make the ice-maker refrigerant tube 59 come into contact with the ice making tray 210, 220. Specifically, as shown in FIG. 37, the controller 310 may move the heat-insulation cover 59*a* to a lower portion of the ice-maker refrigerant tube 59.

As a result, direct heat exchange may be made between the ice making tray 210, 220 and the ice-maker refrigerant tube 59.

In the step of phase changing, the controller 310 may make the heat-insulation cover 59*a* come between the ice-maker refrigerant tube 59 and the ice making tray 210, 220. Specifically, as shown in FIG. 38, the controller 310 may move the heat-insulation cover 59*a* to an upper portion of the ice-maker refrigerant tube 59.

As a result, heat exchange between the ice making tray 210, 220 and the ice-maker refrigerant tube 59 may be disturbed by the heat-insulation cover 59*a*. That is, cooling ability of the ice maker 110 may be reduced.

With the reduced cooling ability, the refrigerator 1 determines whether the temperature of water or ice in the ice maker 110 is lower than a second reference temperature, in 1360.

If the temperature of the water stored in the ice maker 110 is lower than the second reference temperature in 1360, the refrigerator 1 may stop stirring the water stored in the ice maker 110, in 1370.

Operations 1360 and 1370 may be the same as the operations 1060 and 1070 of FIG. 13.

The refrigerator 1 increases cooling ability of the ice maker 110, in 1380.

When the phase change from water into ice is completed, the refrigerator 1 may rapidly cool the ice maker 110 for forming ice quickly.

For example, as shown in FIG. 35, the controller 310 of the refrigerator 1 may control the switching valve 53 such that the refrigerant flows out through the second outflow port 53*c*. As a result, the refrigerant is supplied to the ice making device 100 and the second evaporator 57 in sequence, which increases the cooling ability of the ice maker 110.

In another example, as shown in FIG. 37, the controller 310 may make the ice-maker refrigerant tube 59 come into contact with the ice making tray 210, 220. As a result, direct heat exchange may be made between the ice making tray 210, 220 and the ice-maker refrigerant tube 59, which increases cooling ability of the ice maker 110.

Subsequently, the refrigerator 1 determines whether the temperature of water or ice in the ice maker 110 is lower than a third reference temperature, in 1380.

If the temperature of the ice in the ice maker 110 is lower than the third reference temperature in 1080, the refrigerator 1 may separate the ice from the ice maker 110, in 1390.

Operations 1380 and 1390 may be the same as the operations 1080 and 1090 of FIG. 13.

Figure 39:
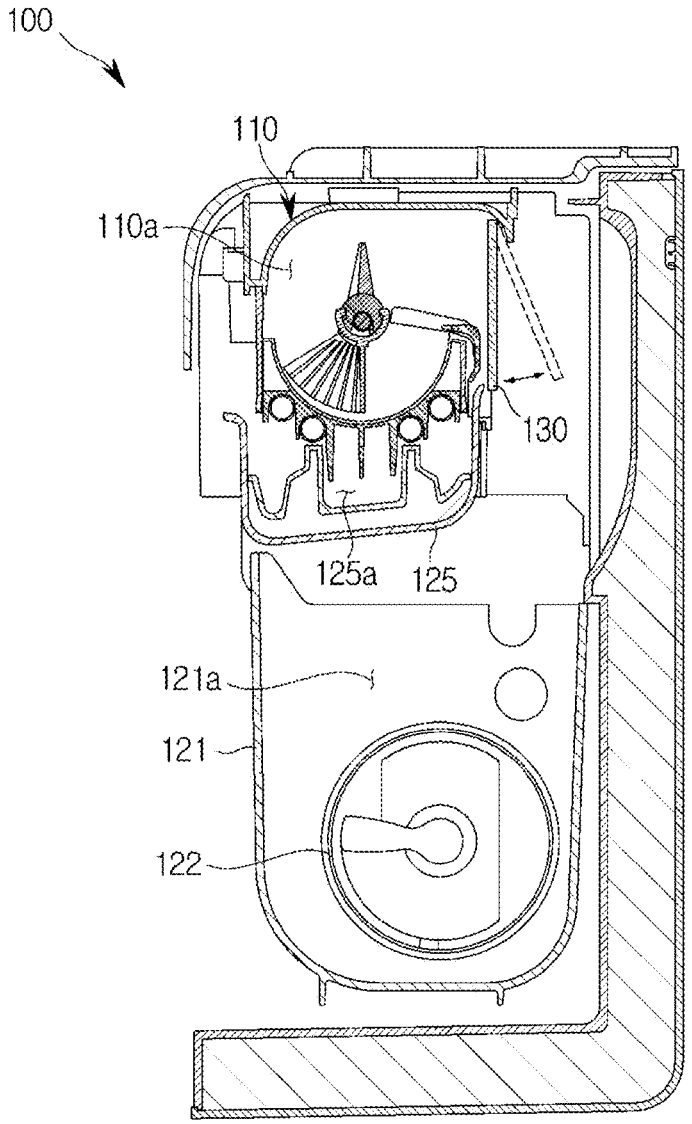
FIGS. 39 and 40 show how a refrigerator keeps the temperature of a ice maker above the freezing point, according to an embodiment.
Figure 40:
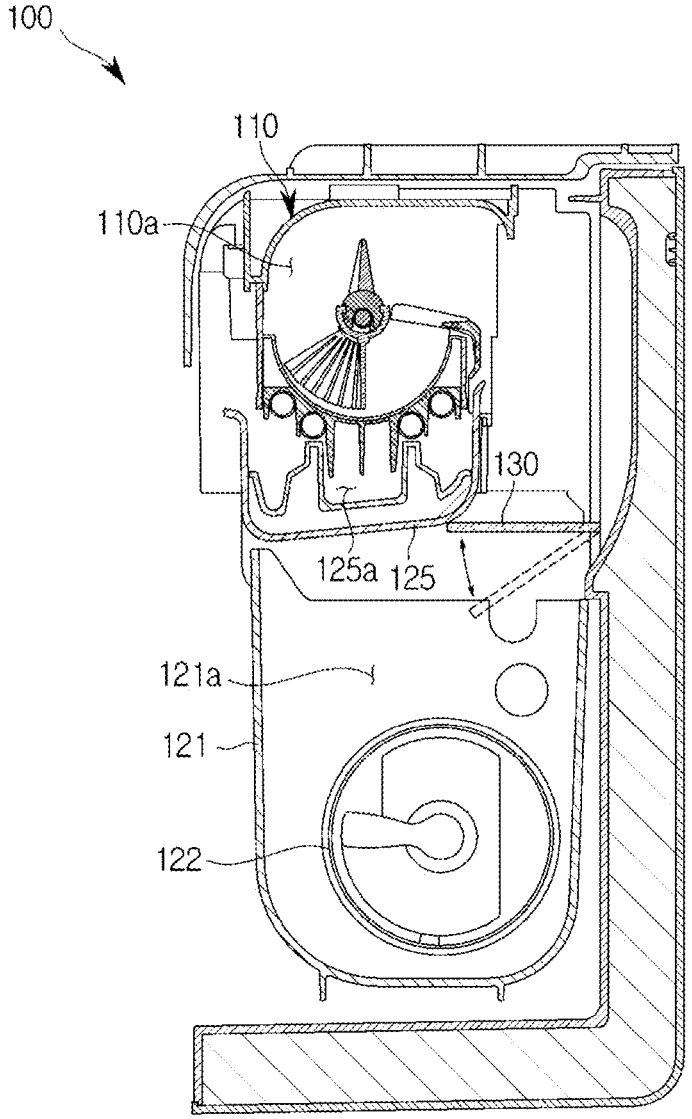

FIGS. 39 and 40 show how a refrigerator keeps the temperature of a ice maker above the freezing point, according to an embodiment.

The refrigerator 1 may keep air in an upper portion of the ice maker 110 above the freezing point in order to freeze the water stored in the ice maker 110 from its bottom portion. To keep the temperature of the air in the upper portion of the ice maker 110 above the freezing point, the refrigerator 1 may insulate the upper space of the ice maker 110 from the ice storage space of the ice storage 120.

For example, the refrigerator 1 may include the ice making device 100 as shown in FIGS. 39 and 40.

The ice making device 100 may include the ice maker 110 for making ice, the ice container 121 for storing ice, the transporter 122 for discharging ice in response to a command from the user, and the cold air duct 125 for guiding the air cooled by the ice maker 110 to the ice container 121. Furthermore, the inside of the ice making device 100 may be divided into ice making space 110*a* formed in an upper portion of the ice maker 110, ice storage space 121*a* for the ice container 121 to store ice, and the cold air path 125*a* in which the air cooled by the ice maker 110 flows.

The air cooled by the ice maker 110 may be guided into the ice storage space 121*a* through the cold air path 125*a*, and the ice storage space 121*a* may remain below the freezing point.

A heat insulation damper 130 may be provided between the ice making space 110*a* and the ice storage space 121*a*. The heat insulation damper 130 may insulate the ice making space 110*a* from the ice storage space 121*a*. With the insulation of the ice making space 110*a* from the ice storage space 121*a*, even when the temperature of the ice storage space 121*a* remains below the freezing point, the temperature of the ice making space 110*a* in an upper portion of the ice maker 110 may remain above the freezing temperature.

The heat insulation damper 130 may be placed in various positions that may insulate the ice making space 110*a* from the ice storage space 121*a*. For example, as shown in FIG. 39, the heat insulation damper 130 may be vertically positioned on the open side of the ice maker 110. Alternatively, as shown in FIG. 40, the heat insulation damper 130 may be horizontally positioned above the ice container 121.

While ice is being formed, the controller 310 of the refrigerator 1 may close the heat insulation damper 130 to maintain the temperature of the ice making space 110*a* to be above the freezing point. After the ice making is done, the controller 310 may open the heat insulation damper 130 to separate the ice.

As described above, the refrigerator 1 may keep the temperature of the upper portion of the ice maker 110 above the freezing point to freeze the water stored in the ice maker 110 from its bottom, and insulate the ice making space 110*a* from the ice storage space 121*a* to maintain the temperature of the upper portion of the ice maker 110 to be above the freezing point.

Figure 41:
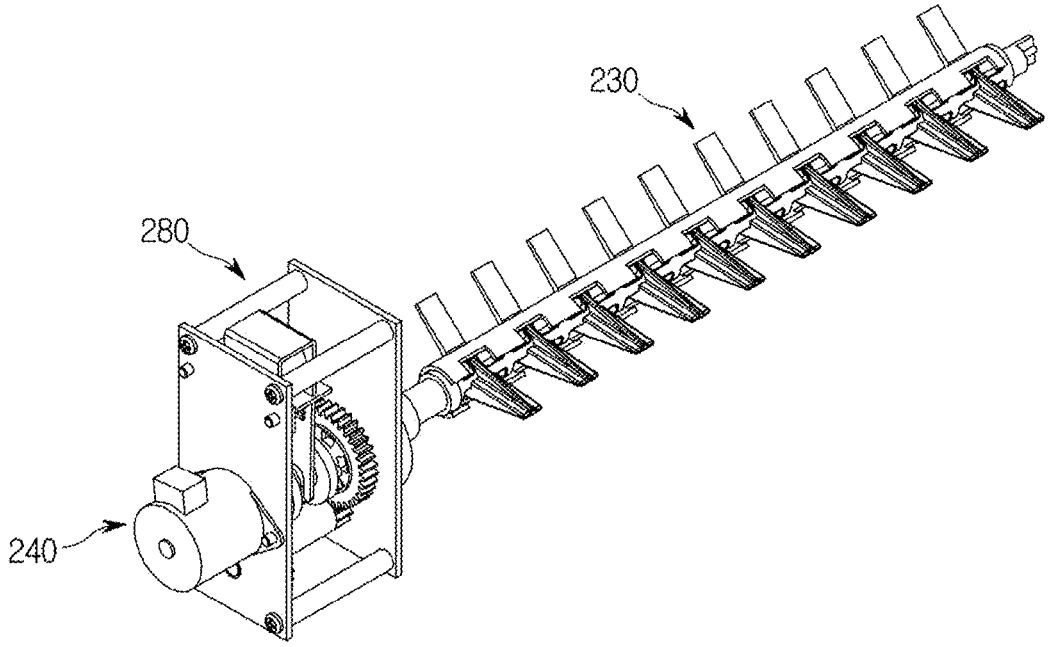
FIG. 41 shows a stirring motor, a rotational force transferrer, and a stirrer included in a refrigerator, according to an embodiment.
Figure 42:
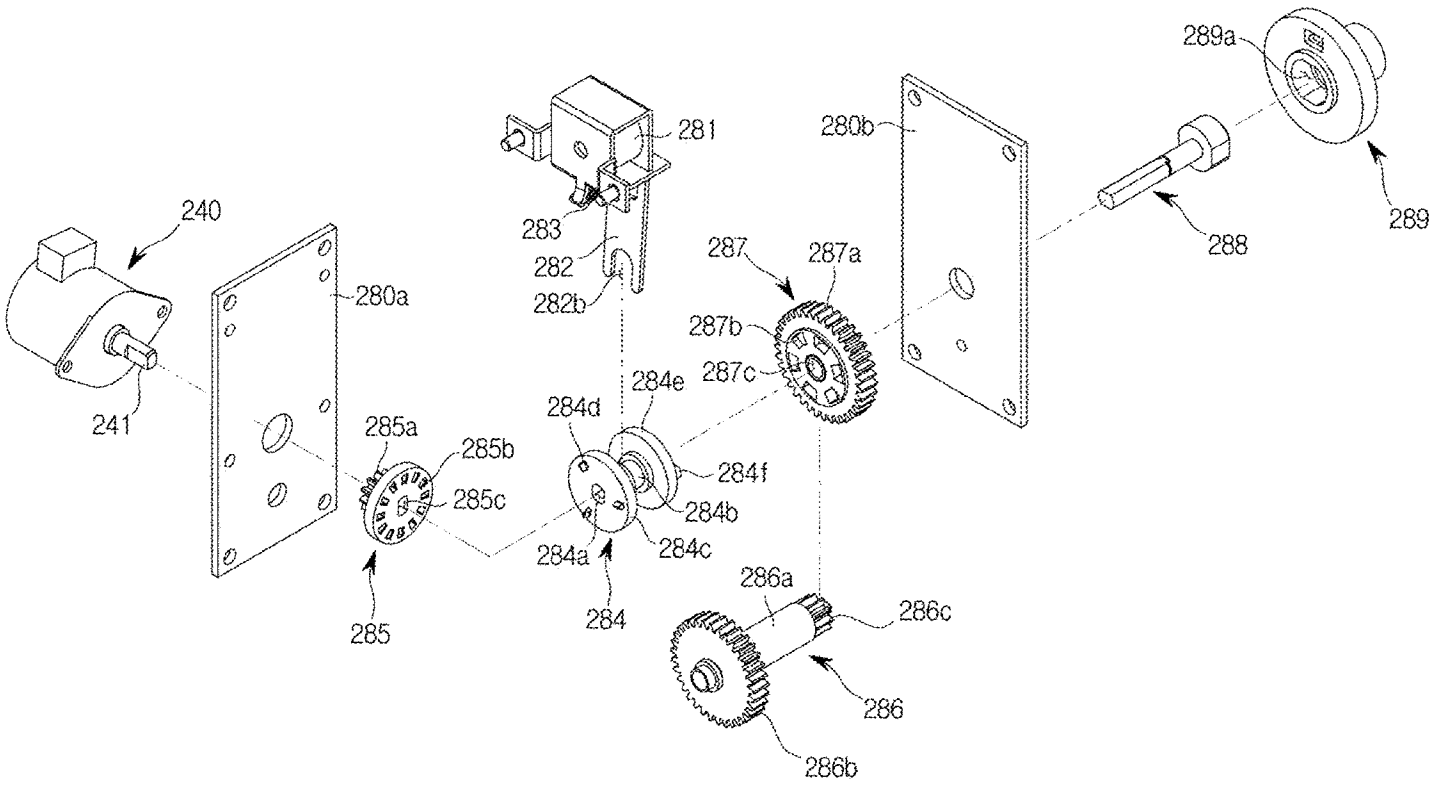
FIG. 42 is an exploded view of the rotational force transferrer shown in FIG. 41.
Figure 43:
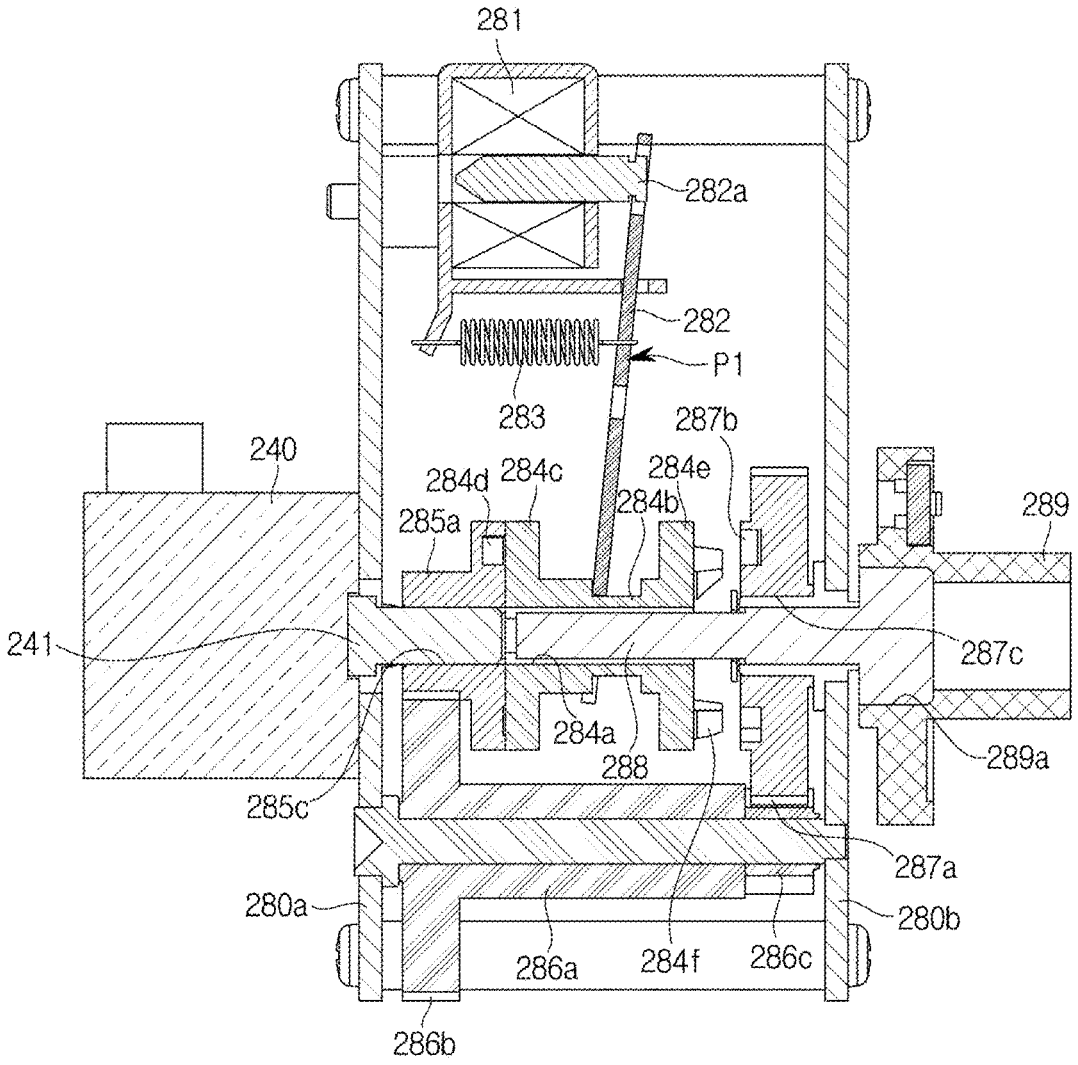
FIGS. 43 and 44 show operation of the rotational force transferrer shown in FIG. 41.
Figure 44:
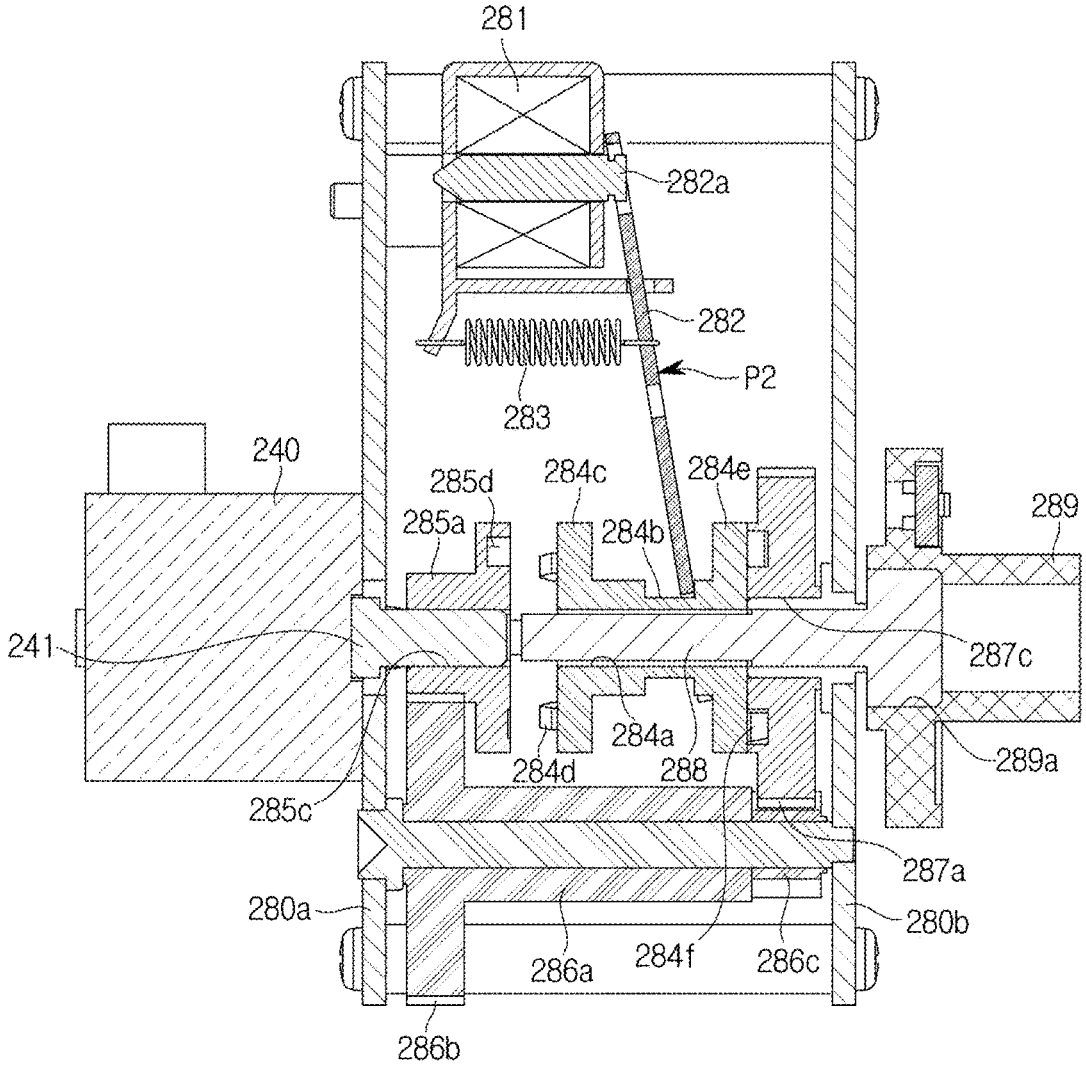

FIG. 41 shows a stirring motor, a rotational force transferrer, and a stirrer included in a refrigerator, according to an embodiment. FIG. 42 is an exploded view of the rotational force transferrer shown in FIG. 41. FIGS. 43 and 44 show operation of the rotational force transferrer shown in FIG. 41.

The refrigerator 1 may stir water stored in the ice maker 110 to make transparent ice, and separate ice from the ice maker 110 after the ice is formed. For stirring water and separating ice, the refrigerator 1 may include the stirrer 230 and the stirring motor 240.

The stirrer 230 may include a stirring member 232 for stirring water while ice is being formed and the scooping member 233 for separating ice since the ice has been formed.

While ice is being formed, the stirring motor 240 may rotate the stirrer 230 at around 60 rpm to stir water and output small torque to stir the water. On the contrary, after the ice making is done, the stirring motor 240 may rotate the stirrer 230 at around 6 rpm to separate ice and output large torque to separate the ice from the ice maker 110. In other words, while ice is being formed, the stirring motor 240 may operate with low torque/high speed, and after the ice making is done, the stirring motor 240 may operate with high torque/low speed.

To satisfy both the low torque/high speed operation while ice is being formed and the high torque/low speed operation after the ice making is done, the refrigerator 1 may further include a rotational force transferrer 280 to control torque and rotational speed, in addition to the stirrer 230 and the stirring motor 240, as shown in FIG. 41.

The rotational force transferrer 280 may transfer rotational force of the stirring motor 240 to the stirrer 230 in its original form while ice is being formed. For example, the stirring motor 240 may be rotated at about 60 rpm, and the stirrer 230 may also be rotated at about 60 rpm.

The rotational force transferrer 280 may reduce the rotational force of the stirring motor 240 and transfer the reduced rotational force to the stirrer 230 for ice separation. While the rotational speed is reduced by the rotational force transferrer 280, the torque may be increased. For example, the stirring motor 240 may be rotated at about 60 rpm, and the stirrer transferrer 280 may reduce the rotational speed to about 6 rpm. While the rotational speed is reduced to 1/10, the torque output by the rotational force transferrer 280 may increase about ten times. In other words, the torque transferred to the stirrer 230 may be about 10 times larger than the torque output by the stirring motor 240.

The rotational force transferrer 280 may receive rotational force from a driving shaft 241 of the stirring motor 240, and provide the rotational force to the stirrer 230 through a coupling shaft 288 and a coupling unit 289.

The rotational force transferrer 280 may include clutch devices 281, 282, 283, 284 for reducing the rotational speed or delivering it in its original form, reduction gears 285, 286, 287 for transferring the rotational force at reduced speed, and support members 280*a*, 280*b* for supporting the clutch devices 281, 282, 283, 284 and reduction gears 285, 286, 287.

Specifically, the rotational force transferrer 280 includes an input gear unit 285 receiving rotational force from the stirring motor 240, a transfer gear unit 286 receiving the reduced rotational force from the input gear unit 285, an output gear unit 287 receiving the rotational force at reduced speed from the transfer gear unit 286 and outputting the rotational force, a coupling unit 289 coupled with the stirrer 230, and a coupling shaft 288 connecting the clutch unit 284 and the coupling unit 289.

Furthermore, the rotational force transferrer 280 includes a clutch unit 284 receiving rotational force from one of the input gear unit 285 and the output gear unit 287, a clutch lever 282 moving the clutch unit 284, an elastic member 283 applying tension to the clutch lever 282, and a solenoid coil 281 for driving the clutch lever 282.

The rotational axes of the clutch unit 284, the input gear unit 285, and the output gear unit 287 may be in line with the rotational axes of the stirring motor 240 and the stirrer 230.

The input gear unit 285 includes a driving shaft hole 285*c* coupled with the driving shaft 241 of the stirring motor 240, an input gear 285*a* transferring the rotational force at reduced speed to the transfer gear unit 286, and a first coupling recess 285*b* to be coupled with the clutch unit 284. The input gear unit 285 may be coupled with the driving shaft 241 of the stirring motor 240 through the driving shaft hole 285*c* and may receive rotational force from the stirring motor 240.

The transfer gear unit 286 includes a first transfer gear 286*b* engaged with the input gear 285*a* of the input gear unit 285, a second transfer gear 286*c* transferring the rotational force at reduced speed to the output gear unit 287, and a transfer shaft 286*a* connecting the first transfer gear 286*b* and the second transfer gear 286*c*.

The output gear unit 287 includes an output gear 287*a* engaged with the second transfer gear 286*c* of the gear unit 286, a shaft through hole 287*c* through which the coupling shaft 288 passes, and a second coupling recess 287*b* to be coupled with the clutch unit 284. The coupling shaft 288 passes the shaft through hole 287*c*, and the output gear unit 287 is rotationally installed on the coupling shaft 288.

The coupling unit 289 includes a coupling hole 289*a* coupled with the coupling shaft 288. The coupling unit 289 may be coupled with the coupling shaft 288 through the coupling hole 289*a* and may receive rotational force from the coupling shaft 288. Furthermore, the coupling unit 289 may transfer the rotational force to the stirrer 230.

The clutch unit 284 includes a first coupling plate 284*c* on which a first coupling protrusion 284*d* is formed to be inserted into the first coupling recess 285*b*, a second coupling plate 284*e* on which a second coupling protrusion 284*f* is formed to be inserted into the second coupling recess 287*b*, a clutch shaft 284*b* connecting the first coupling plate 284*c* and the second coupling plate 284*e* and connected to the clutch lever 282, and a shaft coupling recess 284*a* to be coupled with the coupling shaft 288.

When a current is applied to the solenoid coil 281, the solenoid coil 281 may produce a magnetic field and move the clutch lever 282.

The clutch lever 282 includes an amateur 282*a* to be inserted to the center of the solenoid coil 281 and a clutch coupling recess 282*b* coupled to the clutch shaft 284*b* of the clutch unit 284.

The controller 310 of the refrigerator 1 may stop applying a current to the solenoid coil 281 while ice is being formed.

When no current is applied to the solenoid coil 281, as shown in FIG. 43, the clutch lever 282 may remain in first position P1 due to tension of the elastic member 283.

In the first position P1, the clutch lever 282 may force the clutch unit 284 to be coupled with the input gear unit 285. Specifically, the clutch lever 282 may force the clutch unit 284 to be moved toward the input gear unit 285, making the first coupling protrusion 284*d* of the clutch unit 284 inserted to the first coupling recess 285*b* of the input gear unit 285.

When the stirring motor 240 is rotating, the rotational force may be transferred to the input gear unit 285 through the driving shaft 241. The rotational force of the input gear unit 285 may be transferred to the clutch unit 284 by the coupling of the first coupling protrusion 284*d* and the first coupling recess 285*b*. The rotational force of the clutch unit 284 may be transferred to the coupling unit 289 through the coupling shaft 288.

As such, the rotational force generated by the stirring motor 240 while ice is being formed may be transferred to the coupling unit 289 through the input gear unit 285 and the clutch unit 284, and the coupling unit 289 may be rotated at the same speed as the stirring motor 240.

The stirrer 230 receiving the rotational force from the coupling unit 289 may rotate at the same speed as the stirring motor 240, and output almost the same torque as the torque output by the stirring motor 240.

The controller 310 may apply a current to the solenoid coil 281 for ice separation.

When a current is applied to the solenoid coil 281, as shown in FIG. 44, the amateur 282*a* is moved toward the solenoid coil 281 by the magnetic field and the clutch lever 282 may be changed into second position P2.

In the second position P1, the clutch lever 282 may couple the clutch unit 284 with the output gear unit 287. Specifically, the clutch lever 282 may force the clutch unit 284 to be moved toward the output gear unit 287, making the second coupling protrusion 284*f* of the clutch unit 284 inserted to the second coupling recess 287*b* of the output gear unit 287.

When the stirring motor 240 is rotating, the rotational force may be transferred to the input gear unit 285 through the driving shaft 241. The rotational force of the input gear unit 285 may be transferred to the transfer gear unit 286 through the input gear 285*a* and the first transfer gear 286*b*. In this regard, since the number of sawteeth of the input gear 285*a* is less than that of the first transfer gear 286*b*, rotational speed of the rotational force transferred to the transfer gear unit 286 from the input gear unit 285 may be reduced.

The rotational force of the transfer gear unit 286 may be transferred to the output gear unit 287 through the second transfer gear 286*c* and the output gear 287*a*. In this regard, since the number of sawteeth of the second transfer gear 286*c* is less than that of the output gear 287*a*, rotational speed of the rotational force transferred to the output gear unit 287 from the transfer gear unit 286 may be reduced.

Furthermore, the rotational force of the output gear unit 287 may be transferred to the clutch unit 284 by the coupling of the second coupling recess 287*b* and the second coupling protrusion 284*f*. The rotational force of the clutch unit 284 may be transferred to the coupling unit 289 through the coupling shaft 288.

As such, the rotational force generated by the stirring motor 240 may be transferred to the coupling unit 289 via the input gear unit 285, the transfer gear unit 286, the output gear unit 287, and the clutch unit 284 while ice is being separated. The rotational force of the stirring motor 240 is reduced when transferred to the coupling unit 289, so the rotational speed of the coupling unit 289 is slower than the rotational speed of the stirring motor 240. On the contrary, the torque output from the coupling unit 289 may be larger than the torque output from the stirring motor 240.

The stirrer 230 receiving the rotational force from the coupling unit 289 may rotate at slower speed than the rotational speed of the stirring motor 240, and output larger torque than the torque output by the stirring motor 240.

As described above, the rotational force transferrer 280 may transfer rotational force of the stirring motor 240 to the stirrer 230 in its original form while ice is being formed. Furthermore, during ice separation, the rotational force transferrer 280 may reduce the rotational force of the stirring motor 240 and provide the reduced rotational force to the stirrer 230, and the stirrer 230 may output larger torque than the output torque f the stirring motor 240.

Moreover, rotational axes of the stirring motor 240 and the stirrer 230 may be in line with each other with the rotational force transferrer 280, without being limited thereto.

Figure 45:
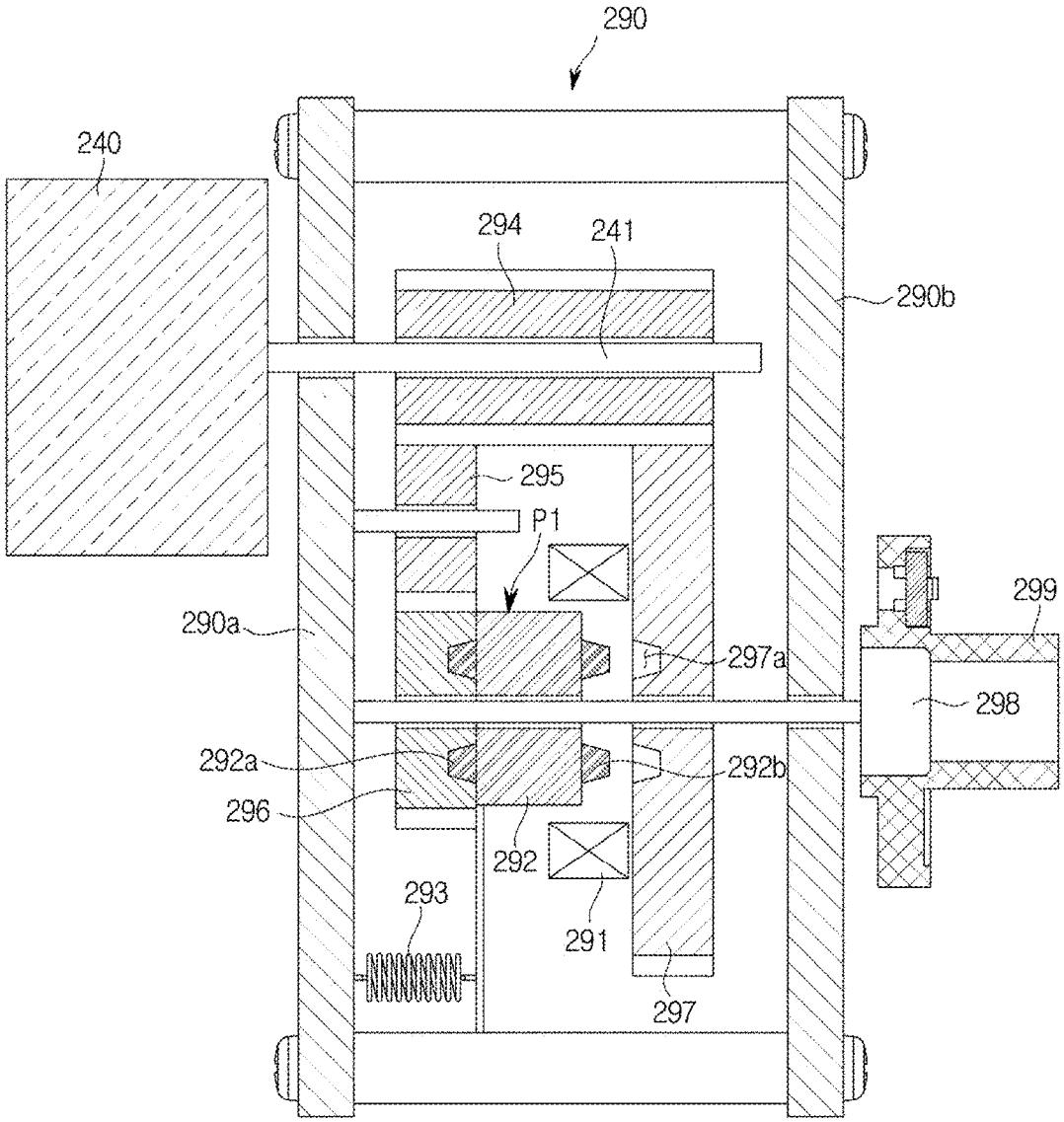
FIGS. 45 and 46 show a rotational force transferrer included in a refrigerator, according to another embodiment.
Figure 46:
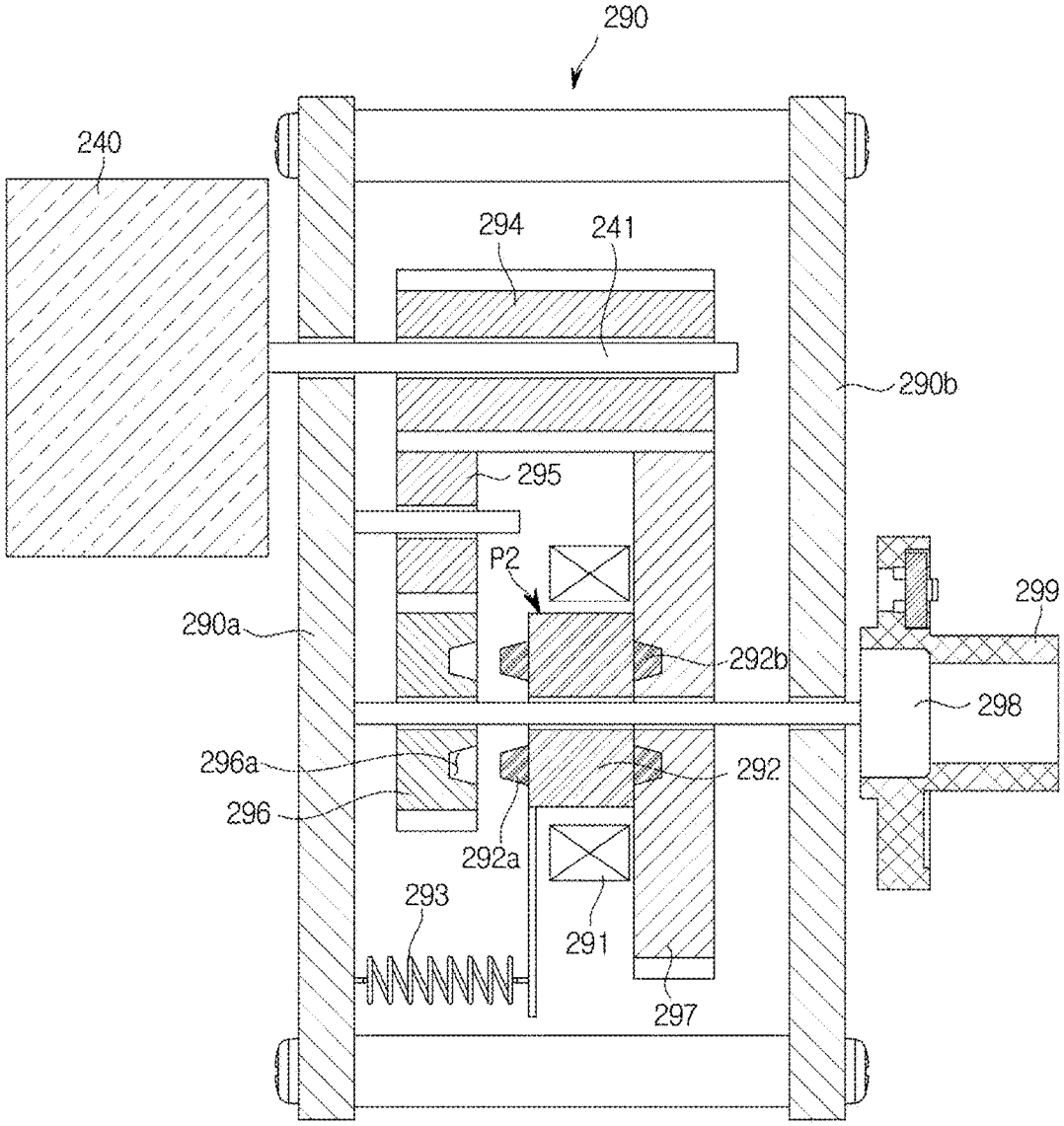

FIGS. 45 and 46 show a rotational force transferrer included in a refrigerator, according to another embodiment.

The rotational force transferrer 290 may receive rotational force from a driving shaft 241 of the stirring motor 240, and provide the rotational force to the stirrer 230 through a coupling shaft 298 and a coupling unit 299.

The rotational force transferrer 290 may include clutch devices 291, 292, 293 for blocking or transferring rotational force, reduction gears 294, 295, 296, 297 for transferring the rotational force at reduced speed, and support members 290*a*, 290*b* for supporting the clutch devices 291, 292, 293 and the reduction gears 294, 295, 296, 297.

Specifically, the rotational force transferrer 290 includes an input gear unit 294 receiving rotational force from the stirring motor 240, a transfer gear unit 295 receiving the rotational force from the input gear unit 294, a first output gear unit 296 receiving and outputting the rotational force from the transfer gear unit 295, a second output gear unit 297 receiving and outputting the rotational force from the input gear unit 294, a coupling unit 299 coupled with the stirrer 230, and a coupling shaft 298 connecting the clutch unit 292 and the coupling unit 299.

Furthermore, the rotational force transferrer 280 includes a clutch unit 292 receiving rotational force from one of the first and second output gear units 296 and 297, a solenoid coil 291 moving the clutch unit 292, and an elastic member 293 applying tension to the clutch unit 292.

The rotational axes of the clutch unit 292, the first and second output gear units 296 and 297 may be in line with the rotational axis of the stirrer 230, and the rotational axis of the input gear unit 294 may be in line with the rotational axis of the stirring motor 240.

The clutch unit 292 includes a first coupling protrusion 292*a* to be inserted to a first coupling recess 296*a* of the first output gear unit 296 and a second coupling protrusion 292*b* to be inserted to a second coupling recess 297*a* of the second output gear unit 297.

Furthermore, the clutch unit 292 is coupled with the coupling shaft 298, and the rotational force of the clutch unit 292 is transferred to the coupling shaft 298.

On the contrary, the coupling shaft 298 penetrates the first and second output gear units 296, 297 without being coupled with the first and second output gear units 296, 297. In other words, the rotational force of the first and second output gear units 296, 297 is not transferred to the coupling shaft 298.

When a current is applied to the solenoid coil 291, the solenoid coil 281 may produce a magnetic field and move the clutch unit 292.

The controller 310 of the refrigerator 1 may stop applying a current to the solenoid coil 291 while ice is being formed.

When no current is applied to the solenoid coil 291, as shown in FIG. 45, the clutch unit 292 may remain in the first position P1 due to tension of the elastic member 293.

In the first position P1, the clutch unit 292 may be coupled with the first output gear unit 296. Specifically, the clutch unit 292 may be moved toward the first output gear unit 296 due to tension of the elastic member 293, and the first coupling protrusion 292*a* of the clutch unit 292 may be inserted to the first coupling recess 296*a* of the first output gear unit 296.

When the stirring motor 240 is rotating, the rotational force may be transferred to the input gear unit 294 through the driving shaft 241. The rotational force of the input gear unit 294 may be transferred to the transfer gear unit 295, and the rotational force of the transfer gear unit 295 may be transferred to the first output gear unit 296. According to a gear ratio between the transfer gear unit 295 and the first output gear unit 296, the rotational speed transferred from the transfer gear unit 295 to the first output gear unit 296 may be reduced to a first ratio (about a ratio of 1:12).

The rotational force of the first output gear unit 296 may be transferred to the clutch unit 292 by the coupling of the first coupling protrusion 292*a* and the first coupling recess 296*a*. The rotational force of the clutch unit 292 may be transferred to the coupling unit 299 through the coupling shaft 298.

As such, the rotational force generated by the stirring motor 240 may be transferred to the coupling unit 289 via the input gear unit 294, the transfer gear unit 295, the first output gear unit 296, and the clutch unit 292 while ice is being formed. Furthermore, the rotation of the stirring motor 240 slows down to the first ratio (about a ratio of 1:12) and may then be transferred to the coupling unit 289.

The controller 310 may apply a current to the solenoid coil 291 for ice separation.

When a current is applied to the solenoid coil 291, as shown in FIG. 46, the clutch unit 292 is moved toward the solenoid coil 291 by the magnetic field and may be changed into the second position P2.

In the second position P2, the clutch unit 292 may be coupled with the second output gear unit 297. Specifically, the clutch unit 292 may be moved toward the second output gear unit 297 due to attraction of the solenoid coil 291, and the second coupling protrusion 292*b* of the clutch unit 292 may be inserted to the second coupling recess 297*a* of the second output gear unit 297.

When the stirring motor 240 is rotating, the rotational force may be transferred to the input gear unit 294 through the driving shaft 241. The rotational force of the input gear unit 294 may be transferred to the second output gear unit 297. According to a gear ratio between the input gear unit 294 and the second output gear unit 297, the rotational speed of the rotation transferred from the input gear unit 294 to the second output gear unit 297 may be reduced to a second ratio (about a ratio of 1:120).

The rotational force of the second output gear unit 297 may be transferred to the clutch unit 292 by the coupling of the second coupling protrusion 292*b* and the second coupling recess 297*a*. The rotational force of the clutch unit 292 may be transferred to the coupling unit 299 through the coupling shaft 298.

As such, the rotational force generated by the stirring motor 240 may be transferred to the coupling unit 289 via the input gear unit 294, the second output gear unit 297, and the clutch unit 292 while ice is being separated. Furthermore, the rotation of the stirring motor 240 slows down to the second ratio (about a ratio of 1:120) and may then be transferred to the coupling unit 289.

As described above, the rotational force transferrer 290 may transfer the rotation of the stirring motor 240 to the stirrer 230 at a speed reduced to the first ratio (about a ratio of 1:12) while ice is being formed. Furthermore, the rotational force transferrer 290 may transfer the rotation of the stirring motor 240 to the stirrer 230 at a speed reduced to the second ratio (about a ratio of 1:120) while ice is being separated. Accordingly, the rotational speed of the stirrer 230 while ice is being formed may be faster than the rotational speed of the stirrer 230 during ice separation, and the output torque of the stirrer 230 during the ice separation may be larger than the output torque of the stirrer 230 while ice is being formed.

Moreover, rotational axes of the stirring motor 240 and the stirrer 230 may be in parallel with each other with the rotational force transferrer 290. In other words, the rotational axis of the stirring motor 240 is not in line with the rotational axis of the stirrer 230. Accordingly, with the rotational force transferrer 290, the stirring motor 240 and the stirrer 230 may be freely arranged.

According to embodiments, a refrigerator having an ice making device capable of forming transparent ice may be provided.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

Exemplary embodiments of the present disclosure have been described above. In the exemplary embodiments described above, some components may be implemented as a "module". Here, the term 'module' means, but is not limited to, a software and/or hardware component, such as a Field Programmable Gate Array (FPGA) or Application Specific Integrated Circuit (ASIC), which performs certain tasks. A module may advantageously be configured to reside on the addressable storage medium and configured to execute on one or more processors.

Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The operations provided for in the components and modules may be combined into fewer components and modules or further separated into additional components and modules. In addition, the components and modules may be implemented such that they execute one or more CPUs in a device.

With that being said, and in addition to the above described exemplary embodiments, embodiments can thus be implemented through computer readable code/instructions in/on a medium, e.g., a computer readable medium, to control at least one processing element to implement any above described exemplary embodiment. The medium can correspond to any medium/media permitting the storing and/or transmission of the computer readable code.

The computer-readable code can be recorded on a medium or transmitted through the Internet. The medium may include Read Only Memory (ROM), Random Access Memory (RAM), Compact Disk-Read Only Memories (CD-ROMs), magnetic tapes, floppy disks, and optical recording medium. Also, the medium may be a non-transitory computer-readable medium. The media may also be a distributed network, so that the computer readable code is stored or transferred and executed in a distributed fashion. Still further, as only an example, the processing element could include at least one processor or at least one computer processor, and processing elements may be distributed and/or included in a single device.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

an ice making tray;

a cooling system;

a stirrer, at least a portion of the stirrer being submerged in the ice making tray, the stirrer comprising a stirring member and a scooping member, the stirring member having a different shape than the scooping member and being more flexible than the scooping member;

a stirring motor coupled to the stirrer; and a controller storing instructions and configured to execute the stored instructions to control the stirring motor to drive the stirrer while controlling the cooling system to cool water stored in the ice making tray, wherein while the cooling system cools the water stored in the ice making tray, the stirrer is configured to stir the water stored in the ice making tray.

2. The refrigerator of claim 1, wherein:

the stirrer further comprises a shaft, the stirring member protrudes from the shaft to stir water stored in the ice making tray while ice is being formed, and the scooping member protrudes from the shaft to separate ice from the ice making tray.

3. The refrigerator of claim 2, wherein:

the stirring member comprises at least one stirring blade, the at least one stirring blade protruding in a different direction from the scooping member.

4. The refrigerator of claim 2, wherein:

the stirring member comprises a plurality of stirring blades, the plurality of stirring blades spirally arranged along an outer surface of the shaft.

5. The refrigerator of claim 2, wherein:

the stirring member comprises a plurality of stirring blades, the plurality of stirring blades having different protruding lengths.

6. The refrigerator of claim 2, wherein:

the stirrer comprises an ice-maker heater arranged inside the shaft, the controller is further configured to activate the ice-maker heater while controlling the cooling system to cool water stored in the ice making tray.

7. The refrigerator of claim 1, wherein the ice making tray comprises:

a first ice making tray having a first heat conductivity, and a second ice making tray contacting a bottom surface of the first ice making tray and having a second heat conductivity, which is larger than the first heat conductivity.

8. The refrigerator of claim 1, wherein the ice making tray forms an ice making cell, and the ice making tray comprises:

a first ice making tray forming a side wall of the ice making cell and having a first heat conductivity, and a second ice making tray forming a bottom side of the ice making cell and having a second heat conductivity, which is larger than the first heat conductivity.

9. The refrigerator of claim 1, wherein the stirrer is further configured to:

rotate at a first speed in a first stage to stir the water stored in the ice making tray, and rotate at a second speed which is higher than the first speed in a second stage to stir the water stored in the ice making tray.

10. The refrigerator of claim 1, wherein:

the stirrer comprises:

a shaft, a first blade protruding from the shaft in a first direction and configured to stir water stored in the ice making tray in a first stage, and a second blade protruding from the shaft in a second direction and configured to stir the water stored in the ice making tray in a second stage, and a protruding length of the first blade is larger than a protruding length of the second blade.

11. The refrigerator of claim 1, wherein:

the stirrer is configured to:

rotate at a first speed to stir water stored in the ice making tray, and rotate at a second speed to separate ice from the ice making tray, and the first speed is higher than the second speed.

12. A control method of a refrigerator, the method comprising:

supplying water to an ice making tray;

stirring water stored in the ice making tray using a stirring member, at least a portion of which is submerged in the water while cooling the water stored in the ice making tray; and separating ice from the ice making tray using a scooping member having a different shape than the stirring member, where the stirring member is more flexible than the scooping member.

13. The method of claim 12, wherein:

the stirring of the water stored in the ice making tray comprises:

stirring the water stored in the ice making tray at first speed of the stirring member; and stirring the water stored in the ice making tray at second speed of the stirring member, the first speed is higher than the second speed.

14. The method of claim 12, wherein:

the stirring of the water stored in the ice making tray comprises:

stirring the water stored in the ice making tray using a first blade included in the stirring member; and stirring the water stored in the ice making tray using a second blade included in the stirring member, the first blade is longer than the second blade.

15. A refrigerator comprising:

a first ice making tray having a first heat conductivity;

a second ice making tray contacting a lower portion of a bottom surface of the first ice making tray and having a second heat conductivity;

a cooling system contacting the second ice making tray;

a stirrer, at least a portion of which is submerged in the first ice making tray; and a stirring motor coupled to the stirrer, wherein the second heat conductivity is higher than the first heat conductivity, wherein the stirrer comprises:

a shaft;

an ice-maker heater arranged inside the shaft;

a stirring member protruding from the shaft and configured to stir water stored in the first ice making tray; and a scooping member protruding from the shaft and configured to separate ice from the first ice making tray.

16. The refrigerator of claim 15, further comprising a transmission device configured to transfer rotation force generated by the stirring motor to the stirrer, wherein the transmission device comprises:

a plurality of reduction gears configured to output rotational force of the stirring motor at reduced speed; and a clutch device configured to selectively transfer rotation of one of the plurality of reduction gears to the stirrer.

17. The refrigerator of claim 16, wherein the clutch device is further configured to:

transfer rotation of the stirring motor to the stirrer in its original form to stir water stored in the first ice making tray, and transfer rotation of the stirring motor to the stirrer at reduced speed to separate ice from the first ice making tray.

18. The method of claim 12, further comprising heating an upper portion of water stored in the ice making tray using a heater included in the stirring member while the water is being cooled.

19. The refrigerator of claim 15, wherein the cooling system is configured to operate such that water stored in the first ice making tray is frozen from a bottom while the second ice making tray is being cooled.

* * * * *